US007588427B2

(12) United States Patent
Bae et al.

(10) Patent No.: US 7,588,427 B2
(45) **Date of Patent: *Sep. 15, 2009**

(54) VARIABLE CAPACITY ROTARY COMPRESSOR

(75) Inventors: Ji Young Bae, Busan (KR); Kyoung Jun Park, Changwon-si (KR); Chang Yong Jang, Gwangju (KR); Hyeon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 450 days.

This patent is subject to a terminal disclaimer.

(21) Appl. No.: 10/560,112

(22) PCT Filed: May 3, 2004

(86) PCT No.: PCT/KR2004/001028

§ 371 (c)(1),
(2), (4) Date: Mar. 7, 2006

(87) PCT Pub. No.: WO2004/109114

PCT Pub. Date: Dec. 16, 2004

(65) Prior Publication Data

US 2006/0210418 A1 Sep. 21, 2006

(30) Foreign Application Priority Data

Jun. 11, 2003 (KR) ..... 10-2003-0037662

(51) Int. Cl.
*F04C 2/00* (2006.01)
*F04C 28/18* (2006.01)

(52) U.S. Cl. ..... 418/32; 418/11; 418/23; 418/60; 417/218; 417/221

(58) Field of Classification Search ..... 418/11, 418/23, 32, 60, 63, 94, 97; 417/221, 223, 417/218

See application file for complete search history.

(56) References Cited

U.S. PATENT DOCUMENTS

| | | | | |
|---|---|---|---|---|
| 2,812,128 | A | | 11/1957 | Bosch et al. |
| 2,904,973 | A | | 9/1959 | Kosfeld |
| 3,723,024 | A | * | 3/1973 | Sawai et al. ..... 418/159 |
| 4,577,472 | A | * | 3/1986 | Pandeya et al. ..... 418/159 |
| 4,598,559 | A | | 7/1986 | Tomayko et al. |
| 4,629,403 | A | | 12/1986 | Wood |
| 6,213,732 | B1 | | 4/2001 | Fujio |

FOREIGN PATENT DOCUMENTS

| | | | |
|---|---|---|---|
| EP | 0652372 | | 4/1994 |
| EP | 0669464 | | 2/1995 |
| KR | 2005062217 A | * | 6/2005 |

* cited by examiner

*Primary Examiner*—Theresa Trieu
(74) *Attorney, Agent, or Firm*—KED & Associates, LLP

(57) ABSTRACT

A rotary compressor that has two compression capacities is provided. The rotary compressor includes a driving shaft having an eccentric portion and being rotatable in both clockwise and counterclockwise directions, a cylinder having a predetermined inner volume, and a roller rotatably installed on an outer circumferential surface of the eccentric portion so as to contact an inner circumferential surface of the cylinder. The roller performs a rolling motion along the inner circumferential surface of the cylinder and forms a fluid chamber therewith. A vane is elastically installed in the cylinder, contacting the roller, and upper and lower bearings are respectively installed at upper and lower portions of the cylinder to rotatably support the driving shaft and hermetically seal the inner volume of the cylinder. A compression mechanism forms different sizes of compressive spaces in the fluid chamber based on a rotational direction of the driving shaft.

48 Claims, 58 Drawing Sheets

VARIABLE CAPACITY ROTARY COMPRESSOR

TECHNICAL FIELD

The present invention relates to a rotary compressor, and more particularly, to a mechanism for changing compression capacity of a rotary compressor.

BACKGROUND ART

In general, compressors are machines that are supplied power from a power generator such as an electric motor, a turbine or the like and apply compressive work to a working fluid, such as air or refrigerant to elevate the pressure of the working fluid. Such compressors are widely used in a variety of applications, from electric home appliances such as air conditioners, refrigerators and the like to industrial plants.

The compressors are classified into two types according to their compressing methods: a positive displacement compressor, and a dynamic compressor (a turbo compressor). The positive displacement compressor is widely used in industry fields and configured to increase pressure by reducing its volume. The positive displacement compressors can be further classified into a reciprocating compressor and a rotary compressor.

The reciprocating compressor is configured to compress the working fluid using a piston that linearly reciprocates in a cylinder. The reciprocating compressor has an advantage of providing high compression efficiency with a simple structure. However, the reciprocation compressor has a limitation in increasing its rotational speed due to the inertia of the piston and a disadvantage in that a considerable vibration occurs due to the inertial force. The rotary compressor is configured to compress working fluid using a roller eccentrically revolving along an inner circumference of the cylinder, and has an advantage of obtaining high compression efficiency at a low speed compared with the reciprocating compressor, thereby reducing noise and vibration.

Recently, compressors having at least two compression capacities have been developed. These compressors have compression capacities different from each other according to the rotational directions (i.e., clockwise direction and counterclockwise direction) by using a partially modified compression mechanism. Since compression capacity can be adjusted differently according to loads required by these compressors, such a compressor is widely used to increase an operation efficiency of several equipments requiring the compression of working fluid, especially household electric appliances such as a refrigerator that uses a refrigeration cycle.

However, a conventional rotary compressor has separate a suction portion and discharge portion which communicate with a cylinder. The roller rolls from the suction portion to the discharge portion along an inner circumference of the cylinder, so that the working fluid is compressed. Accordingly, when the roller rolls in an opposite direction (i.e., from the discharge portion to the suction portion), the working fluid is not compressed. In other words, the conventional rotary compressor cannot have different compression capacities if the rotational direction is changed. Accordingly, there is a demand for a rotary compressor having variable compression capacities as well as the aforementioned advantages.

DISCLOSURE OF INVENTION

Accordingly, the present invention is directed to a rotary compressor that substantially obviates one or more problems due to limitations and disadvantages of the related art.

An object of the present invention is to provide a rotary compressor in which the compressing stroke is possibly performed to both or the clockwise and counterclockwise rotations of a driving shaft.

Another object of the present invention is to provide a rotary compressor whose compression capacity can be varied.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a rotary compressor comprising: a driving shaft being rotatable clockwise and counterclockwise, and having an eccentric portion of a predetermined size; a cylinder having a predetermined inner volume; a roller installed rotatably on an outer circumference of the eccentric portion so as to contact an inner circumference of the cylinder, performing a rolling motion along the inner circumference and forming a fluid chamber to suck and compress fluid along with the inner circumference; a vane installed elastically in the cylinder to contact the roller; upper and lower bearings installed respectively in upper and lower portions of the cylinder, for rotatably supporting the driving shaft and hermetically sealing the inner volume; suction and discharge ports communicating with the fluid chamber so as to suck and discharge the fluid; a suction plenum communicating with the suction ports and preliminarily storing the fluid; and a compression mechanism configured to form different sizes of compressive spaces in the fluid chamber depending on the rotational direction of the driving shaft.

Preferably, the compression mechanism compresses the fluid using the overall fluid chamber when the driving shaft rotates in any one of the clockwise direction and the counterclockwise direction.

In more detail, the compression mechanism compresses the fluid using a portion of the fluid chamber when the driving shaft rotates in the other of the clockwise direction and the counterclockwise direction.

In an aspect of the invention, the compression mechanism comprises a valve assembly, which rotates according to the rotational direction of the driving shaft to selectively open at least one of the suction ports.

In another aspect of the invention, the compression mechanism comprises a valve assembly selective opening at least one of the suction ports spaced apart from each other by using a pressure difference between the cylinder and inner and outer portions according to the rotational direction of the driving shaft.

In still another aspect of the invention, the compression mechanism comprises a first vane and a second vane that divide the fluid chamber into a first space configured such that the fluid is compressed while the driving shaft rotates bidirectionally, and a second space configured such that the fluid is compressed while the driving shaft rotates in any one direction.

In yet another aspect of the invention, the compression mechanism is comprised of clearances formed differently according to the rotational direction of the driving shaft between the roller and the inner circumference of the cylinder.

Meanwhile, the suction plenum accommodates oil separated from the stored fluid, and is installed at a lower portion of the bearing in the vicinity of the suction port.

It is preferable that the suction plenum has 100-400% a volume as large as the fluid chamber. It is also preferable that the suction plenum further comprises a penetration hole through which a sleeve of the bearing passes.

The suction plenum could be connected with a suction pipe through a predetermined fluid passage, and this fluid passage penetrates the cylinder and the lower bearing.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Figure 1:
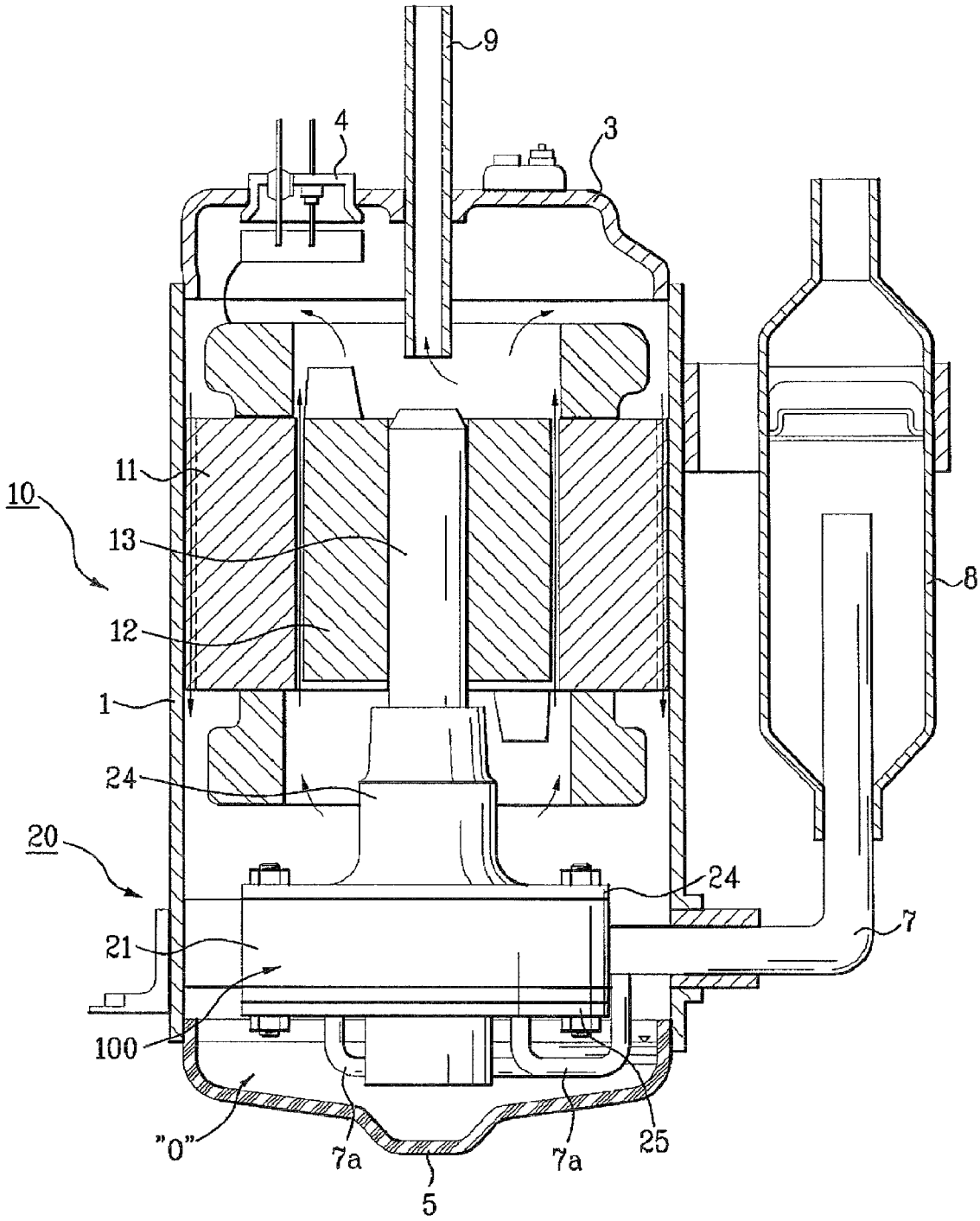
FIG. 1 is a partial longitudinal sectional view illustrating a rotary compressor according to a first embodiment of the present invention.

Reference will now be made in detail to the preferred embodiments of the present invention to achieve the objects, with examples of which are illustrated in the accompanying drawings. Wherever possible, the same reference numbers will be used throughout the drawings to refer to the same or like parts.

FIGS. 1, 16, 29 and 40 are longitudinal sectional views of rotary compressors according to first to fourth embodiments of the present invention.

First, as shown in the drawings, in each embodiment, a rotary compressor of the present invention includes a case 1, a power generator 10 positioned in the case 1 and a compressing unit 20. In the referenced figures, the power generator 10 is positioned on the upper portion of the rotary compressor and the compressing unit 20 is positioned on the lower portion of the rotary compressor. However, their positions may be changed if necessary. An upper cap 3 and a lower cap 5 are installed on the upper portion and the lower portion of the case 1 respectively to define a sealed inner space. A suction pipe 7 for sucking working fluid is installed on a side of the case 1 and connected to an accumulator 8 for separating lubricant from refrigerant. A discharge pipe 9 for discharging the compressed fluid is installed on the center of the upper cap 3. A predetermined amount of the lubricant "0" is filled in the lower cap 5 so as to lubricate and cool members that are moving frictionally. Here, an end of a driving shaft 13 is dipped in the lubricant.

The power generator 10 includes a stator 11 fixed in the case 1, a rotor 12 rotatably supported in the stator 11 and the driving shaft 13 inserted forcibly into the rotor 12. The rotor 12 is rotated due to electromagnetic force, and the driving shaft 13 delivers the rotation force of the rotor to the compressing unit 20. To supply external electric power to the stator 20, a terminal 4 is installed in the upper cap 3. In the present invention, the rotor 12 is configured to be rotatable clockwise and counterclockwise and accordingly the driving shaft 13 is rotatable together with the rotor 12 bidirectionally, i.e., clockwise and counterclockwise. Since the bidirectionally rotatable motor is conventional, its detailed description will be omitted.

The compressing unit 20 includes a cylinder 21 fixed to the case 1, and upper and lower bearings 24 and 25 respectively installed on upper and lower portions of the cylinder 21. Also, other elements for compression are included in the cylinder 21 and bearings 24 and 25, and combination of a part of the elements constitutes compression mechanisms 100, 200, 300 and 400 in each embodiment.

In the compression unit 20, the compression mechanisms 100, 200, 300 and 400 compress specific working fluid in all rotational directions (clockwise and counterclockwise) of the driving shaft 13 in combination with other elements. For instance, for bidirectional compression, in addition to the compression mechanisms, the aforementioned bidirectional rotational motor is applied to the compressor of the invention, and suction and discharge ports allow the fluid to be sucked into the compression unit 20 and to be discharged from the compression unit 20 in all rotational directions of the driving shaft 13. Further, the compression mechanisms 100, 200, 300 and 400 are configured to form compression spaces having different sizes substantially inside the compression unit 20 according to the rotational direction of the driving shaft 13. Accordingly, the compressor is allowed to have different compression capacities according to the rotational directions of the shaft 13.

In the rotary compressor of the invention, the power generator 10 is the same as that of a general rotary compressor, and any great modification is not required for the power generator 10 according to the embodiments of the invention. Accordingly, additional description on the power generator 10 is omitted and the compression mechanisms 100, 200, 300 and 400 schematically described in the above will be described in more detail with reference to drawings related with first to fourth embodiments.

First Embodiment

Figure 2:
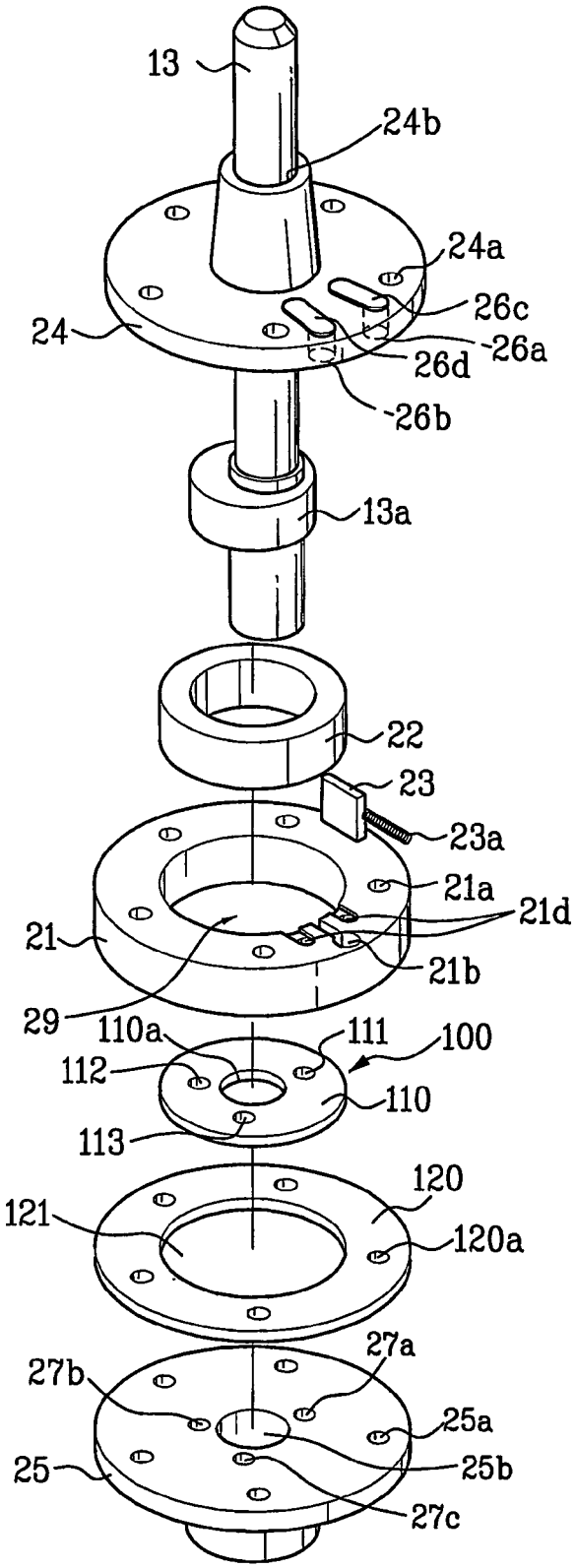
FIG. 2 is an exploded perspective view illustrating the compression unit of the rotary compressor according to a first embodiment of the present invention.
Figure 3:
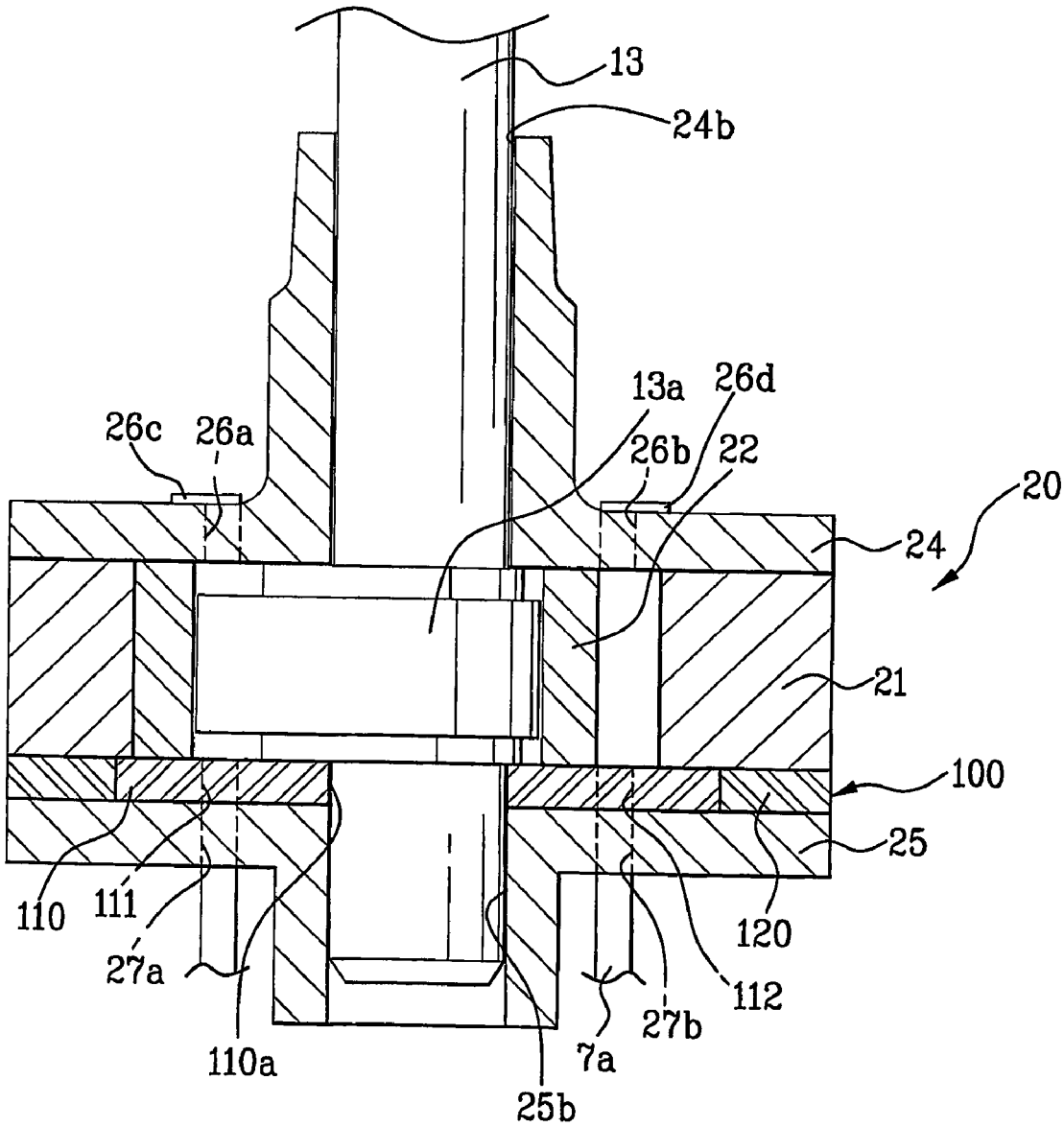
FIG. 3 is a sectional view illustrating the compressing unit according to a first embodiment of the present invention.

FIG. 2 is an exploded perspective view illustrating the compression unit of the rotary compressor according to a first embodiment of the present invention and FIG. 3 is a sectional view illustrating the compressing unit according to a first embodiment of the present invention.

In the compression unit 20 of the first embodiment, the cylinder 21 has a predetermined inner volume and a strength enough to endure the pressure of the fluid. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* extending by a predetermined depth from its inner circumference. A vane 23 to be described below is installed in the groove 21*b*. The groove 21*b* is long enough to accommodate the vane 23 completely.

Figure 4:
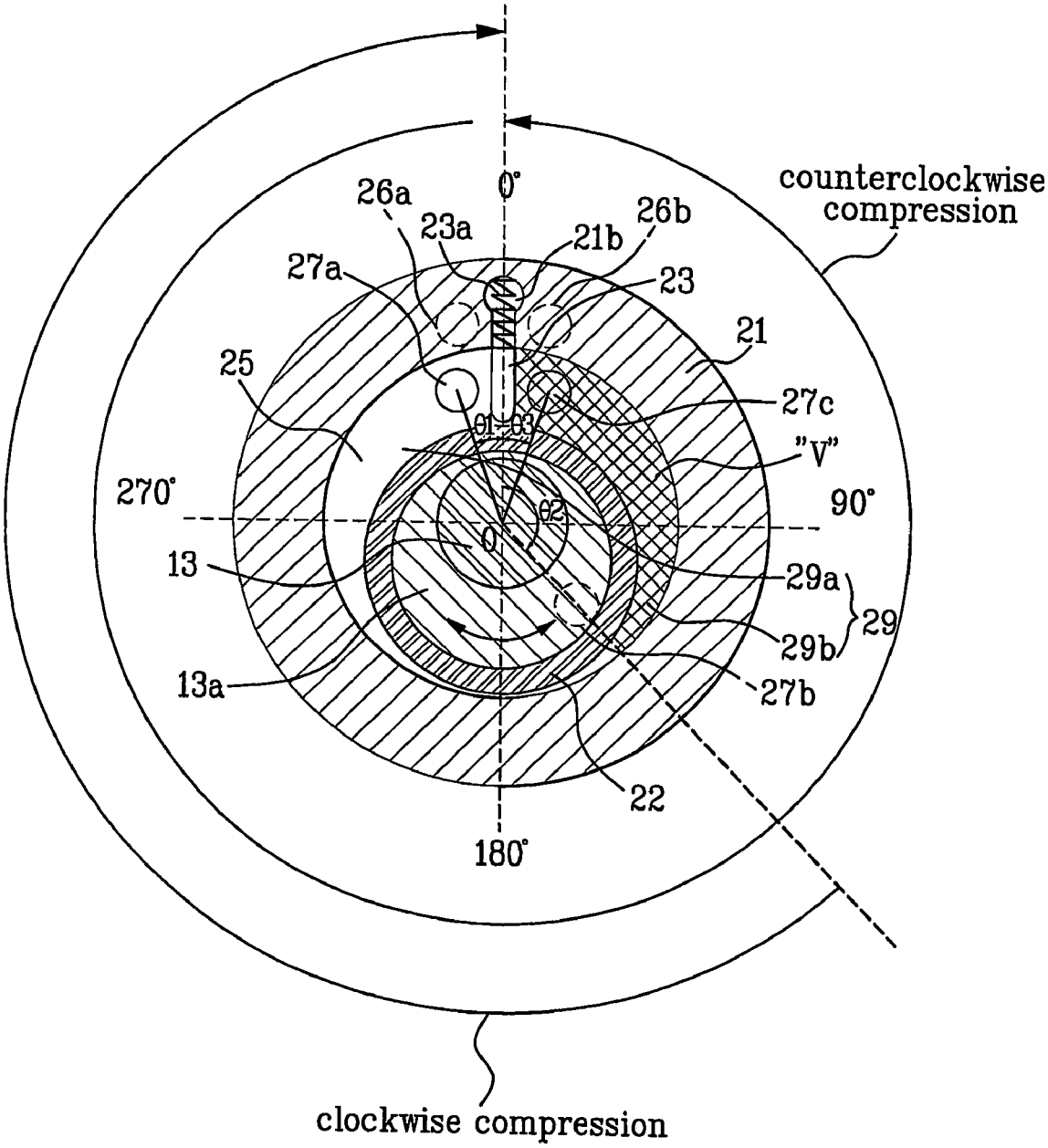
FIG. 4 is a cross-sectional view illustrating the inside of the cylinder according to a first embodiment of the present invention.

The roller 22 is a ring member that has an outer diameter less than the inner diameter of the cylinder 21. As shown in FIG. 4, the roller 22 contacts the inner circumference of the cylinder 21 and is rotatably coupled with the eccentric portion 13*a*. Accordingly, the roller 22 performs rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder form a separate fluid chamber 29 in the inner volume. The fluid chamber 29 is used to suck and compress the fluid in the rotary compressor.

The vane 23 is installed in the groove 21*b* of the cylinder 21 as described above. An elastic member 23*a* is installed in the groove 21*b* to elastically support the vane 23. The vane 23 continuously contacts the roller 22. In other words, the elastic member 23*a* has one end fixed to the cylinder 21 and the other end coupled with the vane 23, and pushes the vane 23 to the side of the roller 22. Accordingly, the vane 23 divides the fluid chamber 29 into two separate spaces 29*a* and 29*b* as shown in FIG. 4. While the driving shaft 13 rotates or the roller 22 revolves, the volumes of the spaces 29*a* and 29*b* are changed complementarily. In other words, if the roller 22 rotates clockwise, the space 29*a* gets smaller but the other space 29*b* gets larger. However, the total volume of the spaces 29*a* and 29*b* is constant and approximately the same as that of the predetermined fluid chamber 29. One of the spaces 29*a* and 29*b* works as a suction chamber for sucking the fluid and the other one works as a compression chamber for compressing the fluid relatively when the driving shaft 13 rotates in one direction (clockwise or counterclockwise). Accordingly, as described above, the compression chamber of the spaces 29*a* and 29*b* gets smaller to compress the previously sucked fluid and the suction chamber expands to suck the new fluid relatively according to the rotation of the roller 22. If the rotational direction of the roller 22 is reversed, the functions of the spaces 29*a* and 29*b* are exchanged. In the other words, if the roller 22 revolves counterclockwise, the right space 29*b* of the roller 22 becomes a compression chamber, but if the roller 22 revolves clockwise, the left space 29*a* of the roller 22 becomes a discharge chamber.

The upper bearing 24 and the lower bearing 25 are, as shown in FIG. 2, installed on the upper and lower portions of the cylinder 21 respectively, and rotatably support the driving shaft 13 using a sleeve and the penetrating holes 24*b* and 25*b* formed inside the sleeve. In more detail, the upper bearing 24, the lower bearing 25 and the cylinder 21 include a plurality of coupling holes 24*a*, 25*a* and 21*a* formed to correspond to each other respectively. The cylinder 21, the upper bearing 24 and the lower bearing 25 are coupled with one another to seal the cylinder inner volume, especially the fluid chamber 29 using coupling members such as bolts and nuts.

The discharge ports 26*a* and 26*b* are formed on the upper bearing 24. The discharge ports 26*a* and 26*b* communicate with the fluid chamber 29 so that the compressed fluid can be discharged. The discharge ports 26*a* and 26*b* can communicate directly with the fluid chamber 29 or can communicate with the fluid chamber 29 through a predetermined fluid passage 21*d* formed in the cylinder 21 and the upper bearing 24. Discharge valves 26*c* and 26*d* are installed on the upper bearing 24 so as to open and close the discharge ports 26*a* and 26*b*. The discharge valves 26*c* and 26*d* selectively open the discharge ports 26*a* and 26*b* only when the pressure of the chamber 29 is greater than or equal to a predetermined pressure. To achieve this, it is desirable that the discharge valves 26*c* and 26*d* are leaf springs of which one end is fixed in the vicinity of the discharge ports 26*a* and 26*b* and the other end can be deformed freely. Although not shown in the drawings, a retainer for restricting the deformable amount of the leaf spring may be installed on the upper portion of the discharge valves 26*c* and 26*d* so that the valves 26*c* and 26*d* can operate stably. In addition, a muffler (not shown) can be installed on the upper portion of the upper bearing 24 to reduce a noise generated when the compressed fluid is discharged.

The suction ports 27*a*, 27*b* and 27*c* communicating with the fluid chamber 29 are formed on the lower bearing 25. The suction ports 27*a*, 27*b* and 27*c* guide the compressed fluid to the fluid chamber 29. The suction ports 27*a*, 27*b* and 27*c* are connected to the suction pipe 7 so that the fluid outside the compressor can flow into the chamber 29. More particularly, the suction pipe 7 is branched into a plurality of auxiliary pipes 7*a* and the branched auxiliary pipes 7*a* are connected to suction ports 27 respectively. If necessary, the discharge ports 26*a* and 26*b* may be formed on the lower bearing 25 and the suction ports 27*a*, 27*b* and 27*c* may be formed on the upper bearing 24.

The suction and discharge ports 26 and 27 become the important factors in determining compression capacity of the rotary compressor, and will be described referring to FIGS. 4 and 5. FIG. 4 is a cross-sectional view illustrating the inside of the cylinder according to a first embodiment of the present invention.

First, the compressor of the present invention includes at least two discharge ports 26*a* and 26*b*. As shown in the drawing, even if the roller 22 revolves in any direction, a discharge port should exist between the suction port and vane 23 positioned in the revolution path to discharge the compressed fluid. Accordingly, one discharge port is necessary for each rotational direction. It causes the compressor of the present invention to discharge the fluid regardless of the revolution direction of the roller 22 (that is, the rotational direction of the driving shaft 13). Meanwhile, as described above, the compression chamber of the spaces 29*a* and 29*b* gets smaller to compress the fluid as the roller 22 approaches the vane 23. Accordingly, the discharge ports 26*a* and 26*b* are preferably formed facing each other in the vicinity of the vane 23 to discharge the maximum compressed fluid. In other words, as shown in the drawings, the discharge ports 26*a* and 26*b* are positioned on both sides of the vane 23 respectively. The discharge ports 26*a* and 26*b* are preferably positioned in the vicinity of the vane 23 if possible.

The suction port 27 is positioned properly so that the fluid can be compressed between the discharge ports 26*a* and 26*b* and the roller 22. Actually, the fluid is compressed from a suction port to a discharge port positioned in the revolution path of the roller 22. In other words, the relative position of the suction port for the corresponding discharge port determines the compression capacity and accordingly two compression capacities can be obtained using different suction ports 27 according to the rotational direction. Accordingly, the compression mechanism of the present invention has first and second suction ports 27*a* and 27*b* corresponding to two discharge ports 26*a* and 26*b* respectively and the suction ports 27*a* and 27*b* are spaced apart by a predetermined angle from each other with respect to the center 0 for two different compression capacities.

Figure 5A:
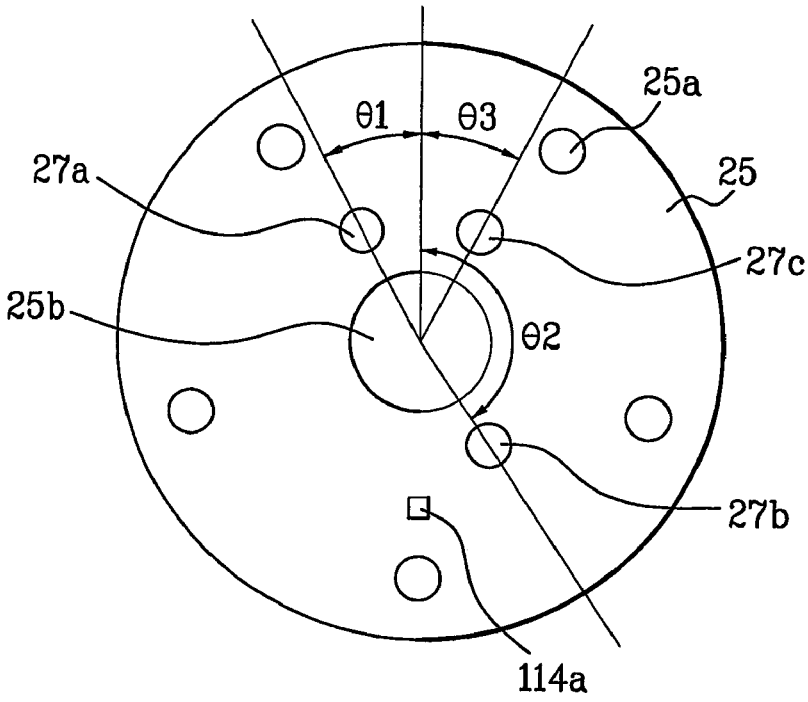
FIGS. 5A and 5B are plan views illustrating a lower bearing of the rotary compressor according to a first embodiment of the present invention.

Preferably, the first suction port 27*a* is positioned in the vicinity of the vane 23. Accordingly, the roller 22 compresses the fluid from the first suction port 27*a* to the second discharge port 26*b* positioned across the vane 23 in its rotation in one direction (counterclockwise in the drawing). The roller 22 compresses the fluid due to the first suction port 27*a* by using the overall chamber 29 and accordingly the compressor has a maximum compression capacity in the counterclockwise rotation. In other words, the fluid as much as overall volume of the chamber 29 is compressed. The first suction port 27*a* is actually spaced apart by an angle θ1 of 10° clockwise or counterclockwise from the vane 23 as shown in FIGS. 4 and 5A. The drawings of the present invention illustrate the first suction port 27*a* spaced apart by the angle θ1 counterclockwise. At this separating angle θ1, the overall fluid chamber 29 can be used to compress the fluid without interference of the vane 23.

The second suction port 27*b* is spaced apart by a predetermined angle from the first suction port 27*a* with respect to the center. The roller 22 compresses the fluid from the second suction port 27*b* to the first discharge port 26*a* in its rotation in counterclockwise direction. Since the second suction port 27*b* is spaced apart by a considerable angle clockwise from the vane 23, the roller 22 compresses the fluid by using a portion of the chamber 29 and accordingly the compressor has less compression capacity than it has during counterclockwise rotary motion. In other words, the fluid as much as a portion volume of the chamber 29 is compressed. The second suction port 27*b* is preferably spaced apart by an angle θ2 of a range of 90-180° clockwise or counterclockwise from the vane 23. The second suction port 27*b* is preferably positioned facing the first suction port 27*a* so that the difference between compression capacities can be made properly and the interference can be avoided for each rotational direction.

Figure 5B:
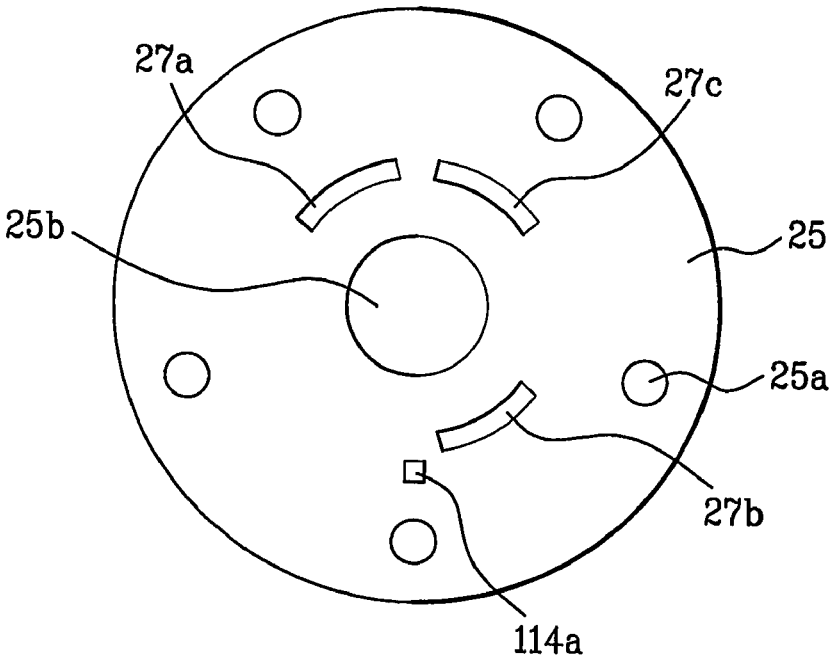

As shown in FIG. 5A, the suction ports 27*a* and 27*b* are generally in circular shapes whose diameters are, preferably 6-15 mm. In order to increase a suction amount of fluid, the suction ports 27*a* and 27*b* can also be provided in several shapes, including a rectangle. Further, as shown in FIG. 5B, the rectangular suction ports 27*a* and 27*b* may have a predetermined curvature. In this case, an interference with adjacent other parts, especially the roller 22, can be minimized in operation.

Meanwhile, in order to obtain desired compression capacity in each rotational direction, suction ports that are available in any one of rotational directions should be single. If there are two suction ports in the rotation path of the roller 22, compression does not occur between the suction ports. In other words, if the first suction port 27*a* is opened, the second suction port 27*b* should be closed, and vice versa. Accordingly, the valve assembly 100 is installed between the lower bearing 24 and the cylinder 21 to selectively open only one of the suction ports 27*a* and 27*b* according to the revolution direction (i.e., rotational direction of the driving shaft 13). Thus, by selectively opening a specific one of the suction ports, different compression spaces can be substantially formed in the fluid chamber 29 according to the rotational direction, so that the valve assembly 100 acts as the inventive compression mechanism previously defined.

As shown in FIGS. 2, 3 and 6A-6B, the valve assembly 100 includes first and second valves 110 and 120, which are installed between the cylinder 21 and the lower bearing 25 so as to allow it to be adjacent to the suction ports. If the suction ports 27*a*, 27*b* and 27*c* are formed on the upper bearing 24, the first and second valves 110 and 120 are installed between the cylinder 21 and the upper bearing 24.

The first valve 110, as shown in FIG. 3, is a disk member installed so as to contact the eccentric portion 13*a* more accurately than the driving shaft 13. Accordingly, if the driving shaft 13 rotates (that is, the roller 22 revolves), the first valve 110 rotates in the same direction. Preferably, the first valve 110 has a diameter larger than an inner diameter of the cylinder 21. As shown in FIG. 3, the cylinder 21 supports a portion (i.e., an outer circumference) of the first valve 110 so that the first valve 110 can rotate stably. Preferably, the first valve 110 is 0.5-5 mm thick.

Figure 6A:
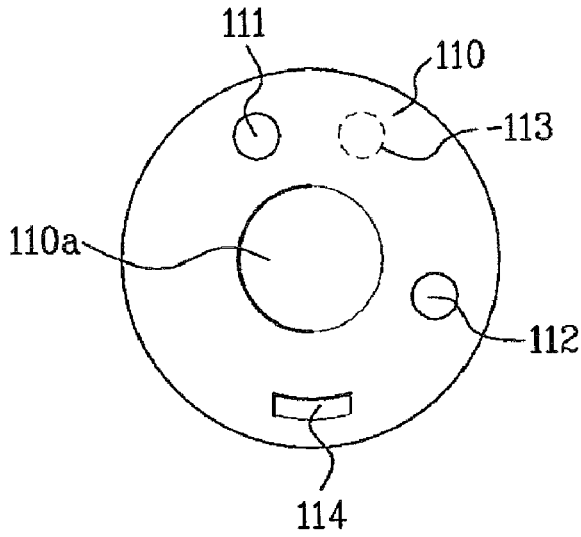
FIGS. 6A and 6B illustrate a valve assembly of the rotary compressor according to a first embodiment of the present invention.
Figure 7A:
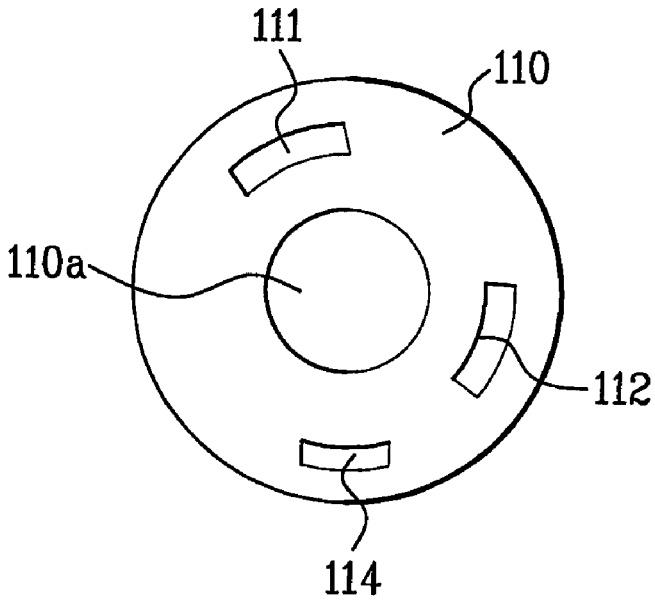
FIGS. 7A, 7B AND 7C are plan views illustrating modifications of a valve assembly.
Figure 7B:
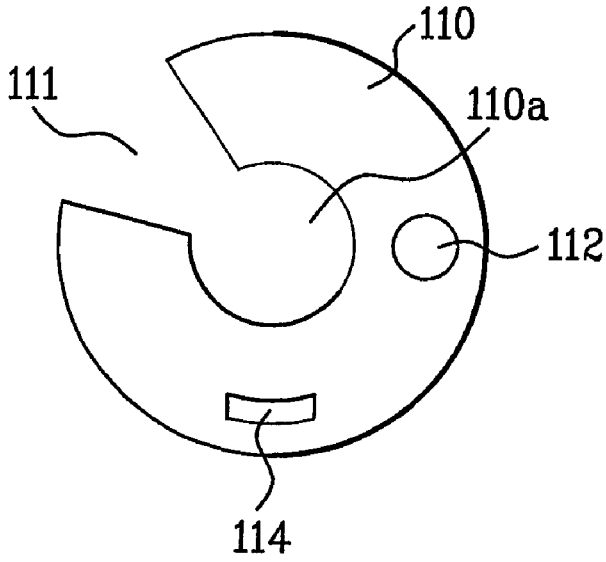
Figure 7C:
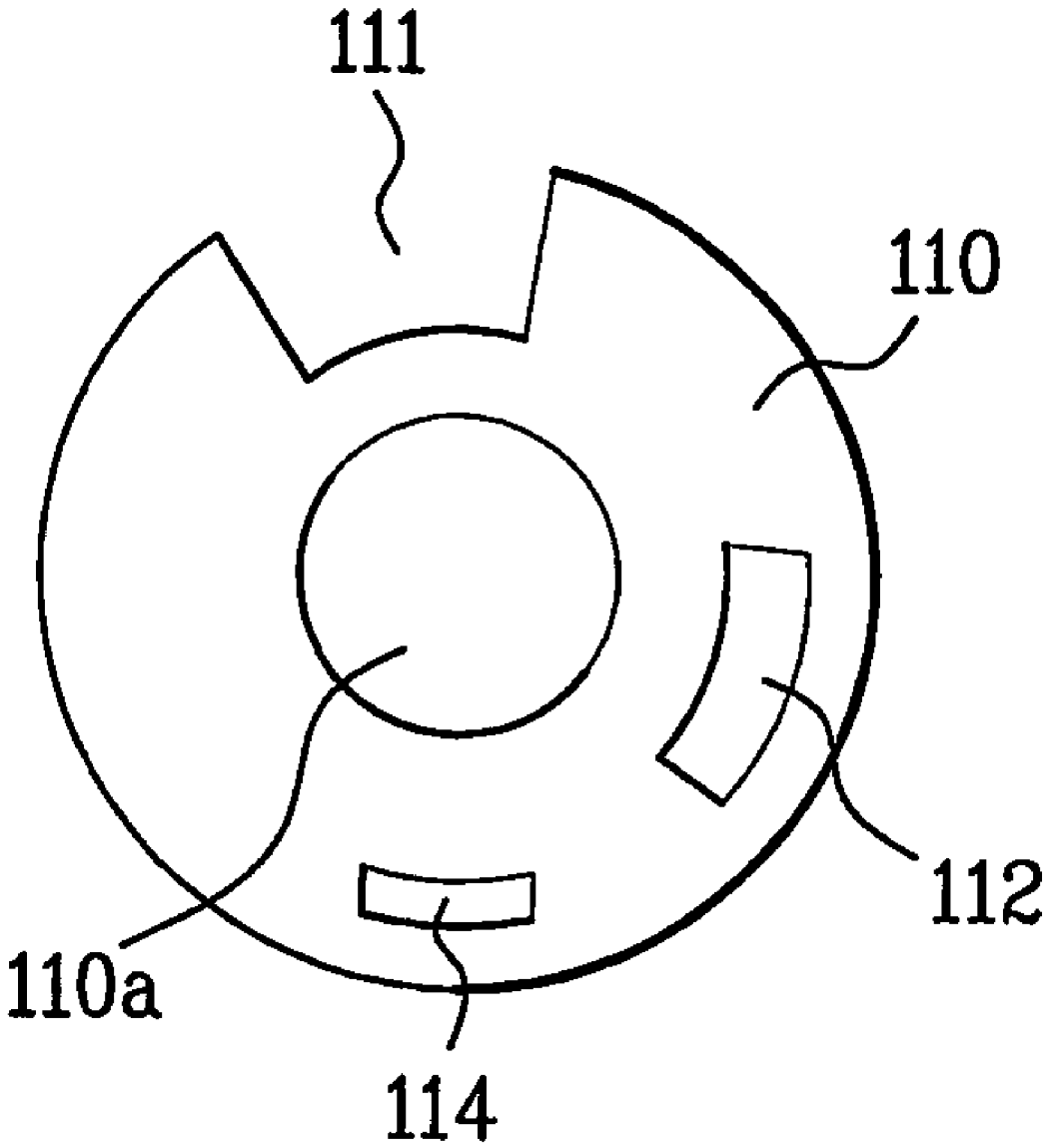

Referring to FIGS. 2 and 6A, the first valve 110 includes first and second openings 111 and 112 respectively communicating with the first and second suction ports 27*a* and 27*b* in a specific rotational direction, and a penetration hole 110*a* into which the driving shaft 13 is inserted. In more detail, when the roller 22 rotates in any one of the clockwise and counterclockwise directions, the first opening 111 communicates with the first suction port 27*a* by the rotation of the first valve 110, and the second suction port 27*b* is closed by the body of the first valve 110. When the roller 22 rotates in the other of the clockwise and counterclockwise directions, the second opening 112 communicates with the second suction port 27*b*. At this time, the first suction port 27*a* is closed by the body of the first valve 110. These first and second openings 111 and 112 can be in circular or polygonal shapes. In case the openings 111 and 112 are the circular shapes, it is desired that the openings 111 and 112 are 6-15 mm in diameter. Additionally, the openings 111 and 112 can be rectangular shapes having predetermined curvature as shown in FIG. 7A, or cut-away portions as shown in FIG. 7B. As a result, the openings are enlarged, such that fluid is sucked smoothly. If these openings 111 and 112 are formed adjacent to a center of the first valve 110, a probability of interference between the roller 22 and the eccentric portion 13*a* increases. In addition, there is the probability of the fluid leaking out along the driving shaft 13, since the openings 111 and 112 communicate with a space between the roller 22 and the eccentric portion 13*a*. For these reasons, as shown in FIG. 7C, it is preferable that the openings 111 and 112 are positioned in the vicinity of the outer circumference of the first valve 110. Meanwhile, the first opening 111 may open each of the first and second suction ports 27*a* and 27*b* at each rotational direction by adjusting the rotation angle of the first valve 110. In other words, when the driving shaft 13 rotates in any one of the clockwise and counterclockwise directions, the first opening 111 communicates with the first suction port 27*a* while closing the second suction port 27*b*. When the driving shaft 13 rotates in the other of the clockwise and counterclockwise directions, the first opening 111 communicates with the second suction port 27*b* while closing the first suction port 27*a*. It is desirable to control the suction ports using such a single opening 111, since the structure of the first valve 110 is simplified much more.

Figure 6B:
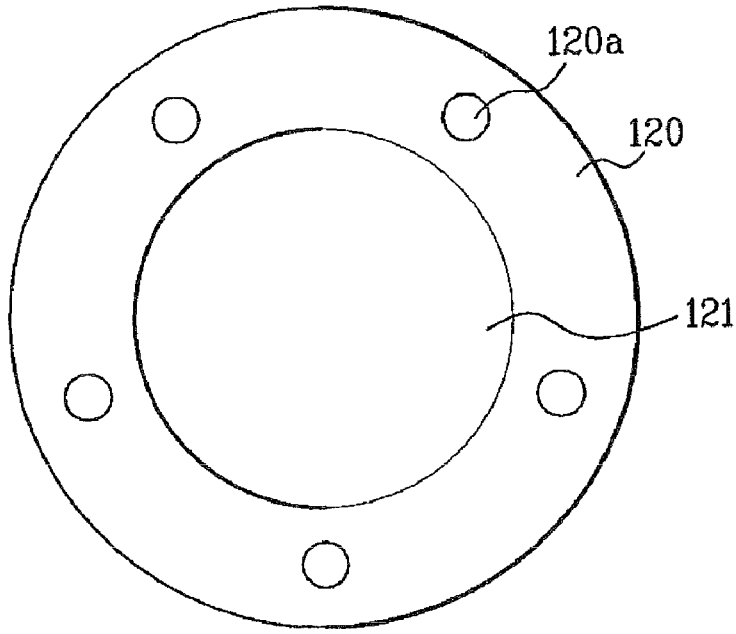

Referring to FIGS. 2, 3 and 6B, the second valve 120 is fixed between the cylinder 21 and the lower bearing 25 so as to guide a rotary motion of the first valve 110. The second valve 120 is a ring-shaped member having a site portion 121 which receives rotatably the first valve 110. The second valve 120 further includes a coupling hole 120*a* through which it is coupled with the cylinder 21 and the upper and lower bearings 24 and 25 by a coupling member. Preferably, the second valve 120 has the same thickness as the first valve 110 in order for a prevention of fluid leakage and a stable support. In addition, since the first valve 110 is partially supported by the cylinder 21, the first valve 110 may have a thickness slightly smaller than the second valve 120 in order to form a gap for the smooth rotation of the second valve 120.

Meanwhile, referring to FIG. 4, in the case of the clockwise rotation, the fluid's suction or discharge between the vane 23 and the roller 22 does not occur while the roller 22 revolves from the vane 23 to the second suction port 27*b*. Accordingly, a region V becomes a vacuum state. The vacuum region V causes a power loss of the driving shaft 13 and a loud noise. Accordingly, in order to overcome the problem in the vacuum region V, a third suction port 27*c* is provided at the lower bearing 25. The third suction port 27*c* is formed between the second suction port 27*b* and the vane 23, supplying fluid to the space between the roller 22 and the vane 23 so as not to form the vacuum state before the roller 22 passes through the second suction port 27*b*. Preferably, the third suction port 27*c* is formed in the vicinity of the vane 23 so as to remove quickly the vacuum state. However, the third suction port 27*c* is positioned to face the first suction port 27*a* since the third suction port 27*c* operates at a different rotational direction from the first suction port 27*a*. In reality, the third suction port 27*c* is positioned spaced by an angle (θ3) of approximately 10° from the vane 23 clockwise or counterclockwise. In addition, as shown in FIGS. 5A and 5B, the third suction port 27*c* can be circular shapes or curved rectangular shapes.

Since the aforementioned third suction port 27*c* operates along with the second suction port 27*b*, the suction ports 27*b* and 27*c* should be simultaneously opened while the roller 22 revolves in any one of the clockwise and counterclockwise directions. Accordingly, the first valve 110 further includes a third opening 113 configured to communicate with the third suction port 27*c* at the same time when the second suction port 27*b* is opened. According to the present invention, the third opening 113 can be formed independently, which is represented with a dotted line in FIG. 6A. However, since the first and third suction ports 27*a* and 27*c* are adjacent to each other, it is desirable to open both the first and third suction ports 27*a* and 27*c* according to the rotational direction of the first opening 111 by increasing the rotation angle of the first valve 110.

The first valve 110 may open the suction ports 27*a*, 27*b* and 27*c* according to the rotational direction of the roller 22, but the corresponding suction ports should be opened accurately in order to obtain desired compression capacity. The accurate opening of the suction ports can be achieved by controlling the rotation angle of the first valve 110. Thus, preferably, the valve assembly 100 further includes means for controlling the rotation angle of the first valve 110, which will be described in detail with reference to FIGS. 8 to 11. FIGS. 8 to 11 illustrate the valve assembly connected with the lower bearing 25 in order to clearly explain the control means.

Figure 8A:
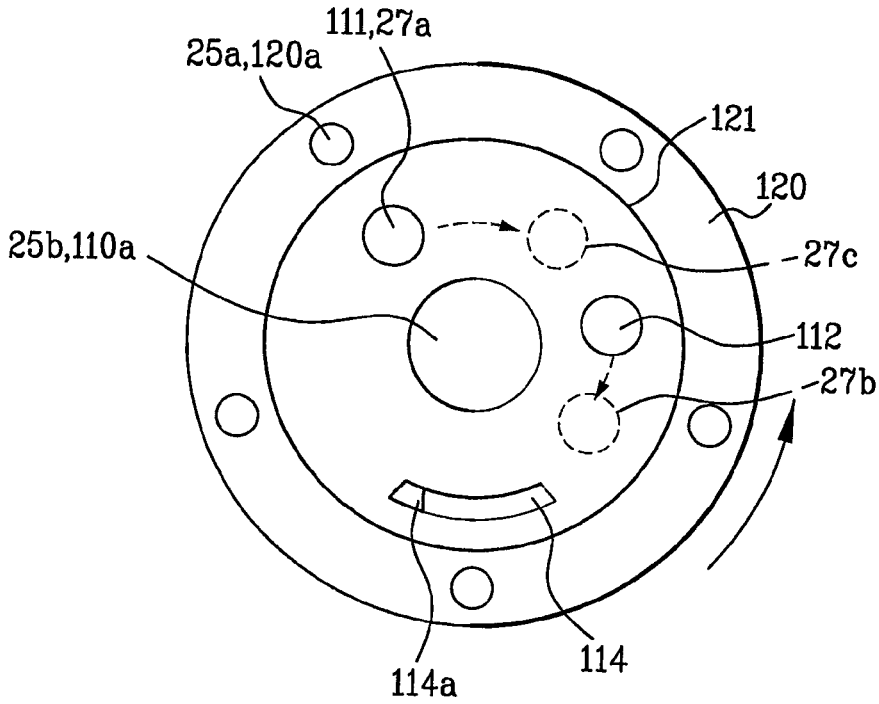
FIGS. 8A and 8B are plan views illustrating a revolution control means.
Figure 8B:
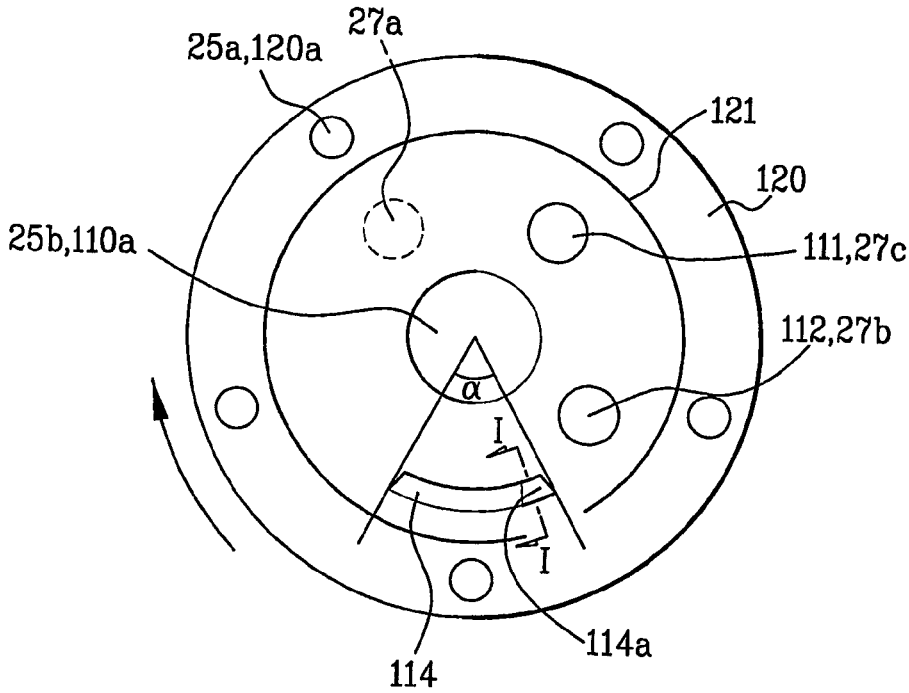
Figure 8C:
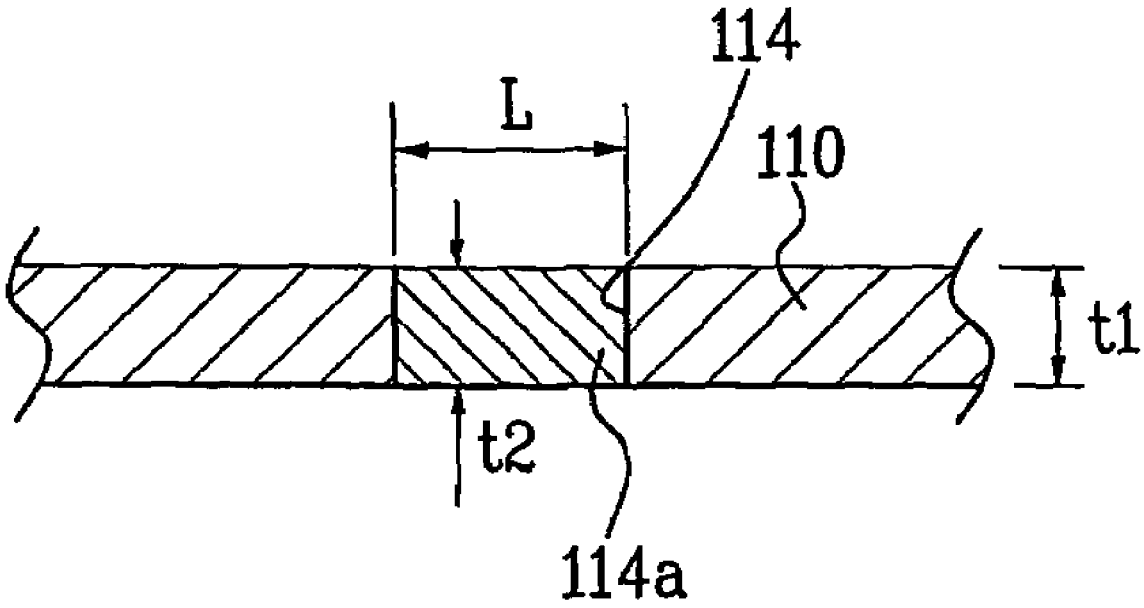
FIG. 8C is a partial sectional view of FIG. 8B.

As shown in FIGS. 8A and 8B, the control means includes a groove 114 formed at the first valve 110 and having a predetermined length, and a stopper 114*a* formed on the lower bearing 25 and inserted into the groove 114. The groove 114 and the stopper 114*a* are illustrated in FIGS. 5A, 5B and 6. The groove 114 serves as locus of the stopper 114*a* and can be a straight groove or a curved groove. If the groove 114 is exposed to the chamber 29 during operation, it becomes a dead volume causing a re-expansion of fluid. Accordingly, it is desirable to make the groove 114 adjacent to a center of the first valve 110 so that large portion of the groove 114 can be covered by the revolving roller 22. Preferably, an angle (α) between both ends of the groove 114 is of 30-120° in the center of the first valve 110. In addition, if the stopper 114*a* is protruded from the groove 114, it interferes with the roller 22. Accordingly, it is desirable that a thickness t2 of the stopper 114*a* is equal to a thickness t1 of the valve 110, as shown in FIG. 5C. Preferably, a width L of the stopper 114*a* is equal to a width of the groove 114 such that the first valve 110 rotates stably.

In case of using the control means, the first valve 110 rotates counterclockwise together with the eccentric portion 13*a* of the driving shaft 13 when the driving shaft 13 rotates counterclockwise. As shown in FIG. 8A, the stopper 114*a* is then latched to one end of the groove 114 to thereby stop the first valve 110. At this time, the first opening 111 accurately communicates with the first suction port 27*a*, and the second and third suction ports 27*b* and 27*c* are closed. As a result, fluid is introduced into the cylinder 21 through the first suction port 27*a* and the first opening 111, which communicate with each other. On the contrary, if the driving shaft 13 rotates clockwise, the first valve 110 also rotates clockwise. At the same time, the first and second openings 111 and 112 also rotate clockwise, as represented with a dotted arrow in FIG. 8A. As shown in FIG. 8B, if the stopper 114*a* is latched to the other end of the groove 114, the first and second openings 111 and 112 are opened together with the third and second suction ports 27*c* and 27*b*. Then, the first suction port 27*a* is closed by the first valve 110. Accordingly, fluid is introduced through the second suction port 27*b*/the second opening 112 and the third suction port 27*c*/the first opening 111, which communicate with each other.

Figure 9A:
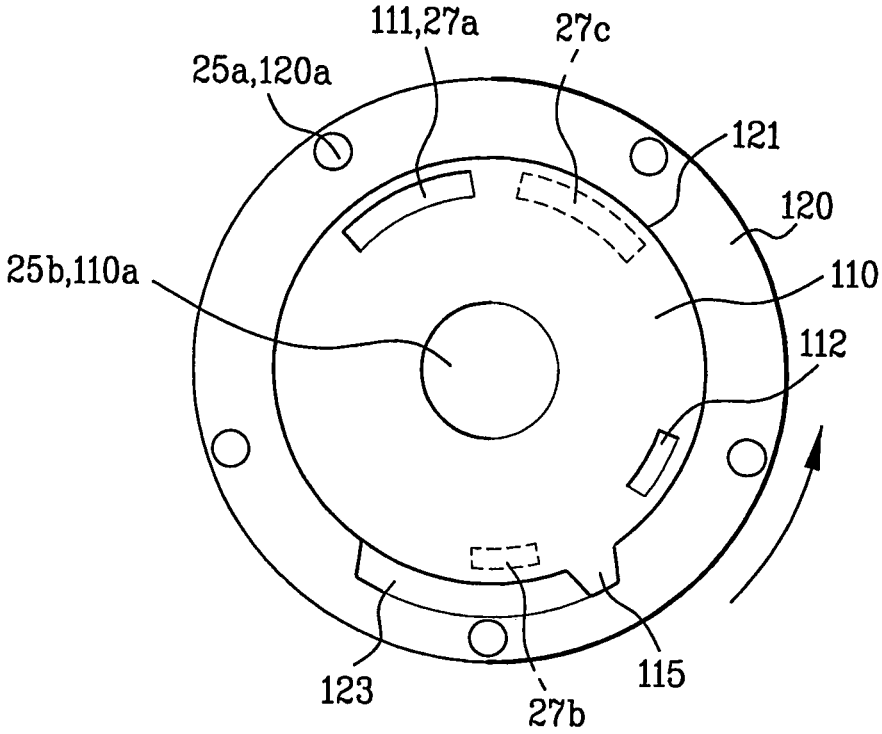
FIGS. 9A and 9B are plan views of modifications of the revolution control means of the valve assembly.
Figure 9B:
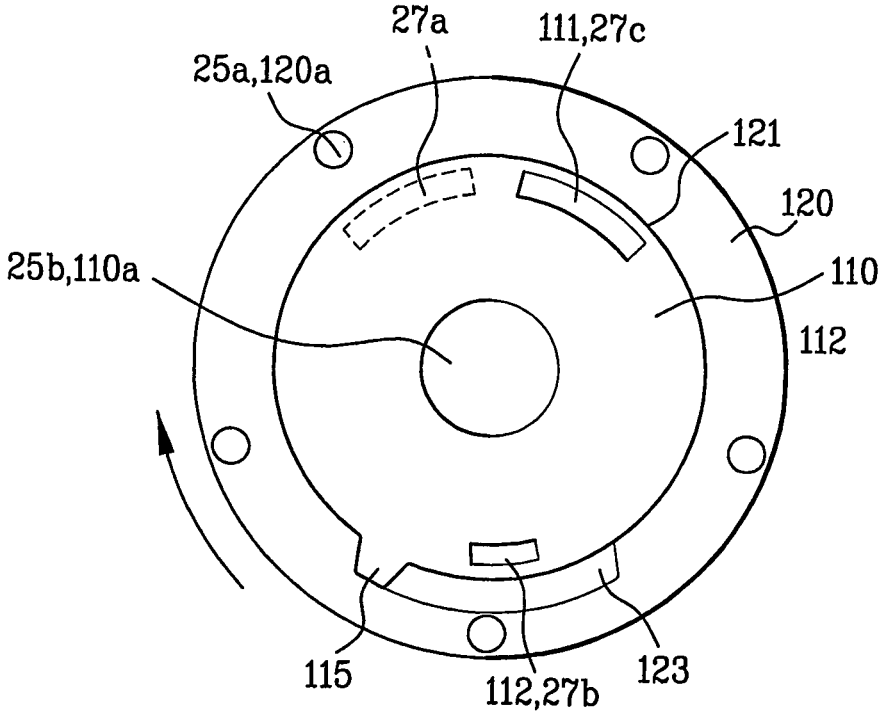

As shown in FIGS. 9A and 9B, the control means can be provided with a projection 115 formed on the first valve 110 and projecting in a radial direction of the first valve 110, and a groove 123 formed on the second valve 120 and receiving the projection 115 movably. Here, the groove 123 is formed on the second valve 120 so that it is not exposed to the inner volume of the cylinder 21. Therefore, a dead volume is not formed inside the cylinder 21. In addition, as shown in FIGS. 10A and 10B, the control means can be provided with a projection 124 formed on the second valve 120 and projecting in a radial direction of the second valve 120, and a groove 116 formed on the first valve 110 and receiving the projection 124 movably.

Figure 10A:
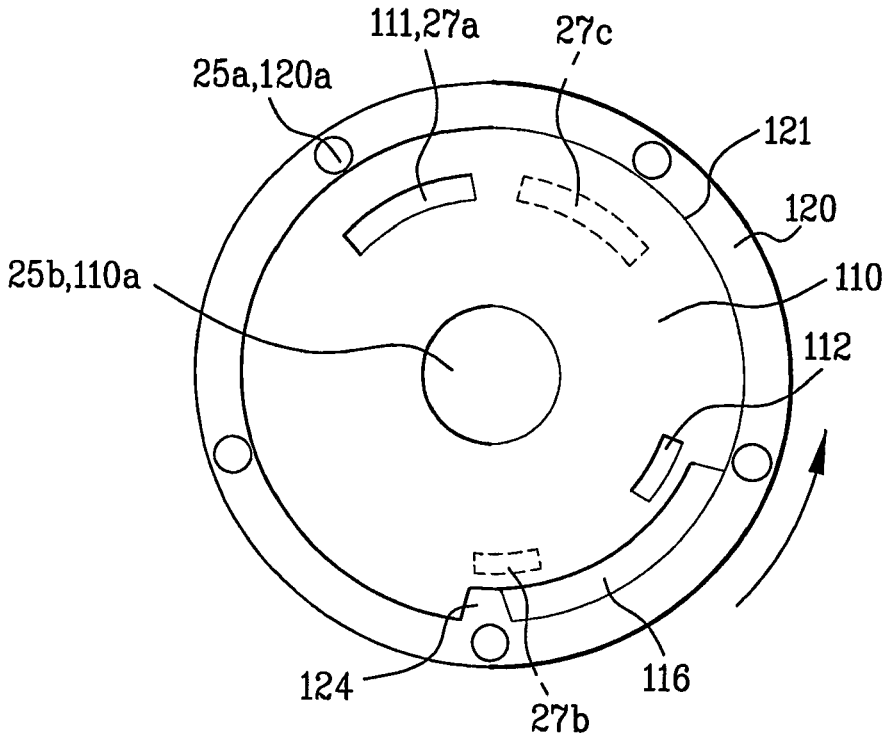
FIGS. 10A and 10B are plan views of another modifications of the revolution control means of the valve assembly.
Figure 10B:
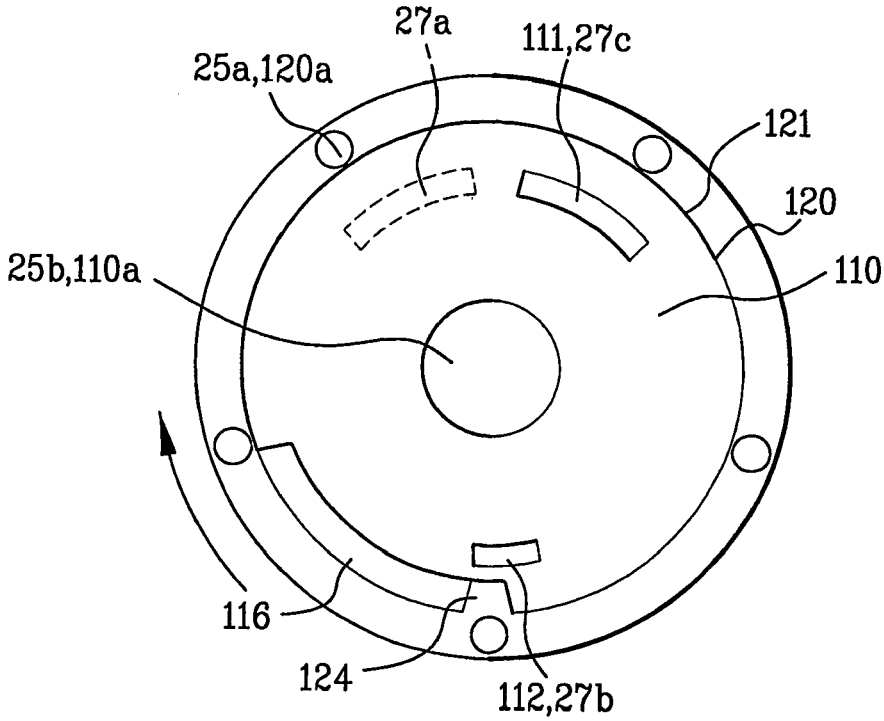

In case of using such control means, the projections 115 and 124 are latched to one end of each groove 123 and 116 as shown in FIGS. 9A and 10A if the driving shaft 13 rotates counterclockwise. Accordingly, the first opening 111 communicates with the first suction port 27*a* so as to allow the suction of fluid, and the second and third suction ports 27*b* and 27*c* are closed. On the contrary, as shown in FIGS. 9B and 10B, if the driving shaft 13 rotates clockwise, the projections 115 and 124 are latched to the other end of each groove 123 and 116, and the first and second openings 111 and 112 simultaneously open the third and second suction ports 27*c* and 27*b* so as to allow the suction of fluid. The first suction port 27*a* is closed by the first valve 110.

Figure 11A:
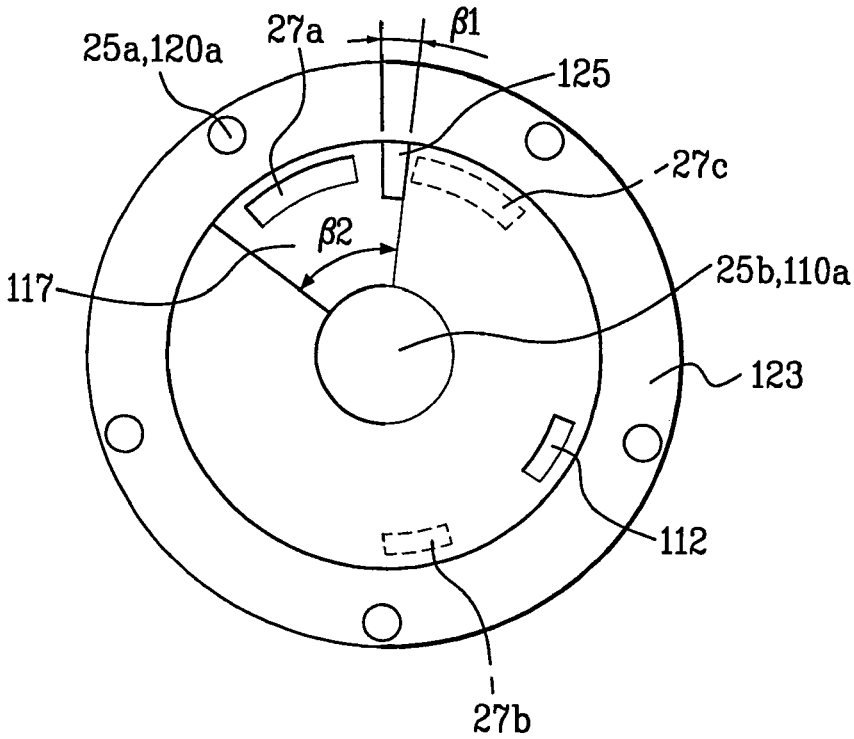
FIGS. 11A and 11B are plan views of another modifications of the revolution control means of the valve assembly.
Figure 11B:
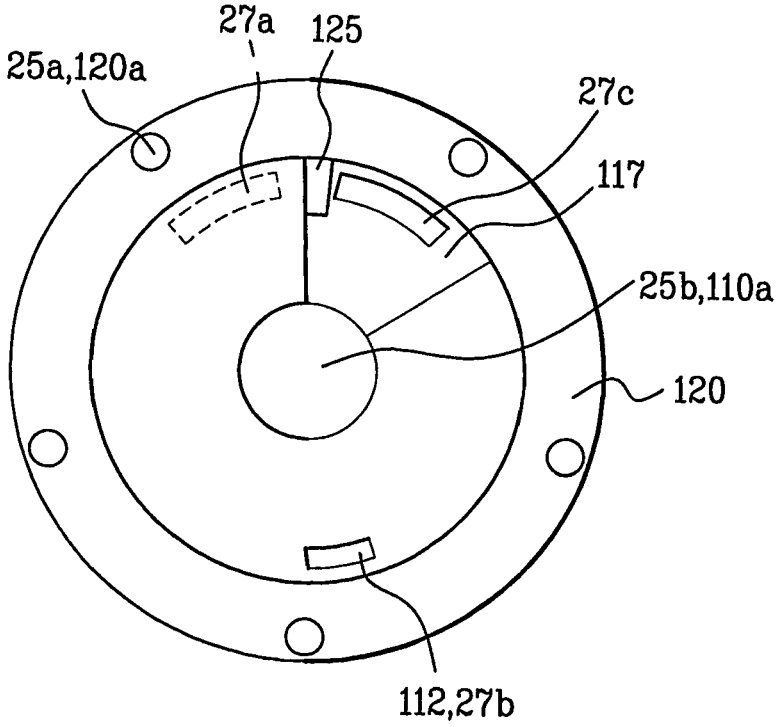

In addition, as shown in FIGS. 11A and 11B, the control means can be provided with a projection 125 formed on the second valve 120 and projecting toward a center of the second valve 120, and a cut-away portion 117 formed on the first valve 110 and movably accommodating the projection 125. In such control means, a clearance between the projection 125 and the cut-away portion 117 allows the first and second suction ports 27*a* and 27*b* to be opened by forming the cut-away portion 117 largely in a properly large size. Accordingly, the control means decreases the dead volume substantially since the grooves of the above-described control means are omitted.

In more detail, if the driving shaft 13 rotates counterclockwise, one end of the projection 125 contacts one end of the cut-away portion 17 as shown in FIG. 11A. Accordingly, a clearance between the other ends of the projection 125 and the cut-away portion 117 allows the first suction port 27*a* to be opened. In addition, as shown in FIG. 11B, if the driving shaft 13 rotates clockwise, the projection 125 is latched to the cut-away portion 117. At this time, the second opening 112 opens the second suction port 27*b*, and simultaneously, the clearance between the projection 125 and the cut-away portion 117 allows the third suction port 27*c* to be opened as described above. In such control means, the projection 125 preferably has an angle β1 of approximately 10° between both ends thereof and the cut-away portion 117 has an angle β2 of 30-120° between both ends thereof.

Figure 12:
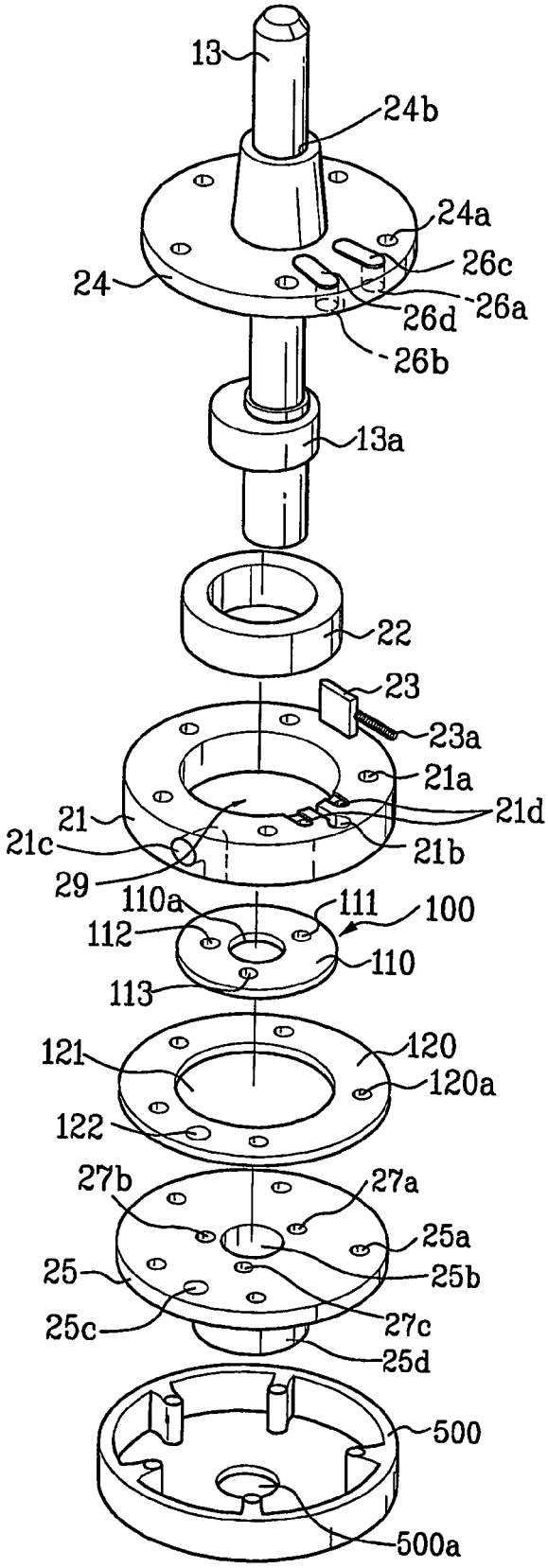
FIG. 12 is an exploded perspective view of a compressing unit of a rotary compressor including a suction plenum according to a first embodiment of the present invention.
Figure 13:
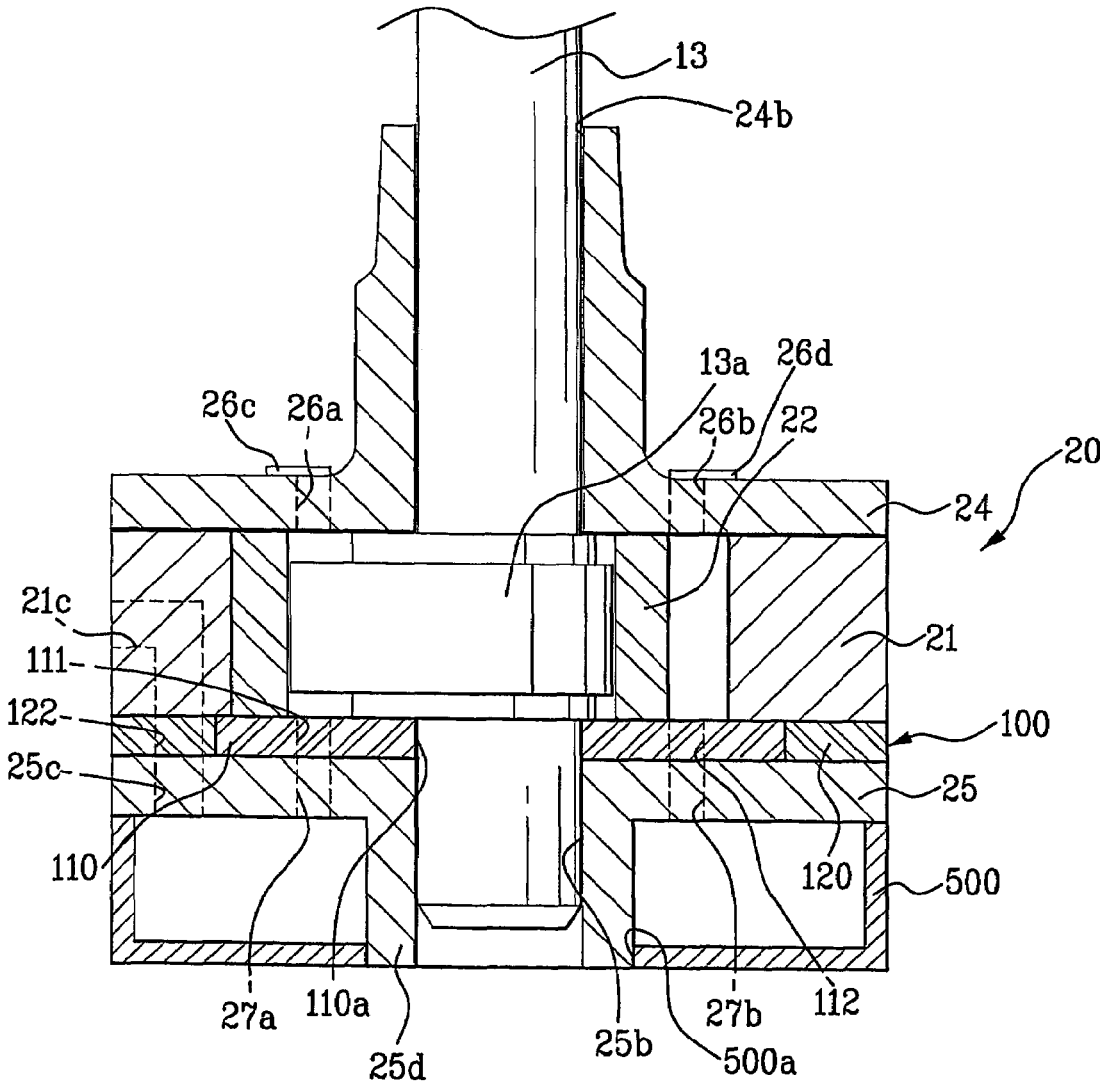
FIG. 13 is a cross-sectional view of the compressing unit shown in FIG. 12.

Meanwhile, as described above with reference to FIGS. 2 and 3, the suction ports 27*a*, 27*b* and 27*c* are individually connected with a plurality of suction pipes 7*a* so as to supply fluid to the fluid chamber 29 installed inside the cylinder 21. However, the number of parts increases due to these suction pipes 7*a*, thus making the structure complicated. In addition, fluid may not be properly supplied to the cylinder 21 due to a change in a compression state of the suction pipes 7*a* separated during operation. Accordingly, as shown in FIG. 12, it is preferable that the compressor includes a suction plenum 500 for preliminarily storing fluid to be sucked by the compressor.

The suction plenum 500 directly communicates with all of the suction ports 27*a*, 27*b* and 27*c* so as to supply the fluid. Accordingly, the suction plenum 500 is installed in a lower portion of the lower bearing 25 in the vicinity of the suction ports 27*a*, 27*b* and 27*c*. Although there is shown in the drawing that the suction ports 27*a*, 27*b* and 27*c* are formed at the lower bearing 25, they can be formed at the upper bearing 24 if necessary. In this case, the suction plenum 500 is installed in the upper bearing 24. The suction plenum 500 can be directly fixed to the bearing 25 by welding. In addition, a coupling member can be used to couple the suction plenum 500 with the cylinder 21, the upper and lower bearings 24 and 25 and the valve assembly 100. In order to lubricate the driving shaft 13, a sleeve 25*d* of the lower bearing 25 should be soaked into a lubricant which is stored in a lower portion of the case 1. Accordingly, the suction plenum 500 includes a penetration hole 500*a* for the sleeve 25*d* so that the sleeve 25*d* can reach the lubricant through the hole 500*a*. Preferably, the suction plenum 500 has 100-400% a volume as large as the fluid chamber 29 so as to supply the fluid stably. The suction plenum 500 is also connected with the suction pipe 7 so as to store the fluid. In more detail, the suction plenum 500 can be connected with the suction pipe 7 through a predetermined fluid passage. In this case, as shown in FIG. 12, the fluid passage penetrates the cylinder 21, the valve assembly 100 and the lower bearing 25. In other words, the fluid passage includes a suction hole 21*c* of the cylinder 21, a suction hole 122 of the second valve, and a suction hole 25*c* of the lower bearing. Alternatively, the fluid passage may penetrate only the cylinder 21 and the lower bearing 25, and thereby the fluid passage includes a suction hole 21*c* of the cylinder 21 and a suction hole 25*c* of the lower bearing.

Such a suction plenum 500 forms a space in which a predetermined amount of fluid is always stored, so that a pressure variation of the sucked fluid is buffered to stably supply the fluid to the suction ports 27*a*, 27*b* and 27*c*. In addition, the suction plenum 500 can accommodate oil separated from the stored fluid (for example, the lubricant included in the fluid) and thus assist or substitute for the accumulator 8.

Hereinafter, operation of a rotary compressor according to a first embodiment of the present invention will be described in more detail.

Figure 14A:
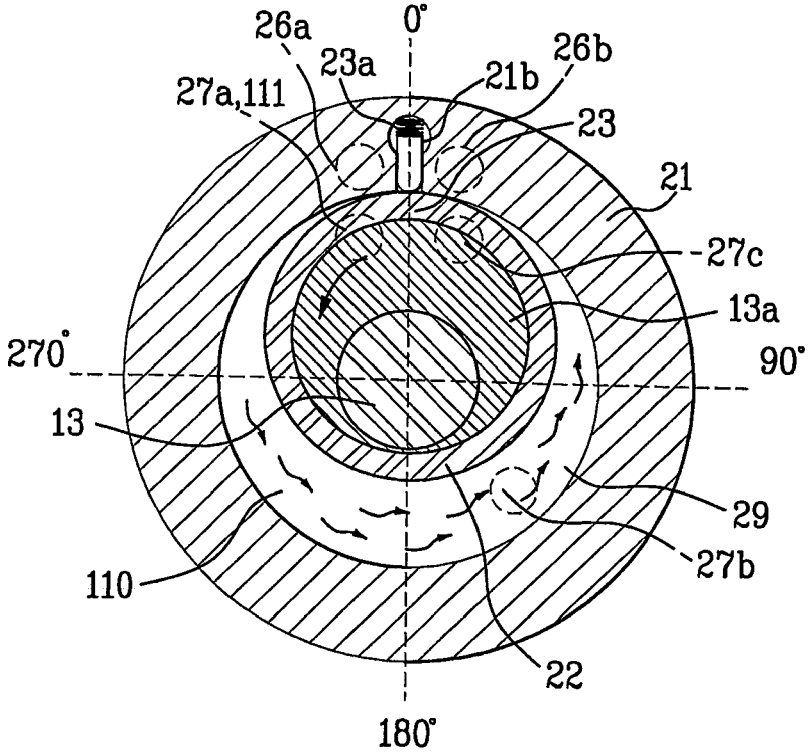
FIGS. 14A to 14C are cross-sectional views sequentially illustrating insides of the cylinder when the roller revolves in the counterclockwise direction in the rotary compressors according to a first embodiment of the present invention.
Figure 14B:
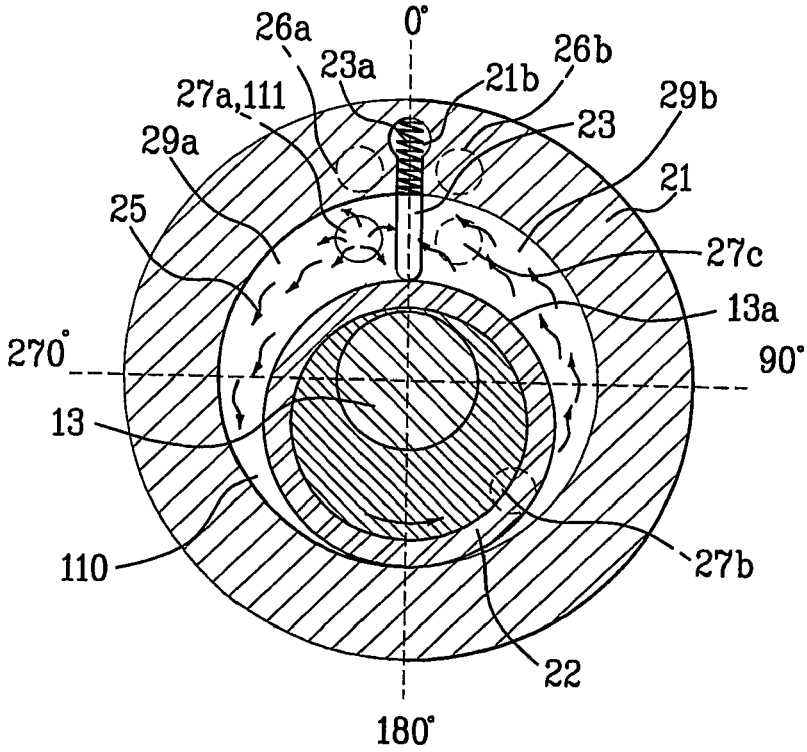
Figure 14C:
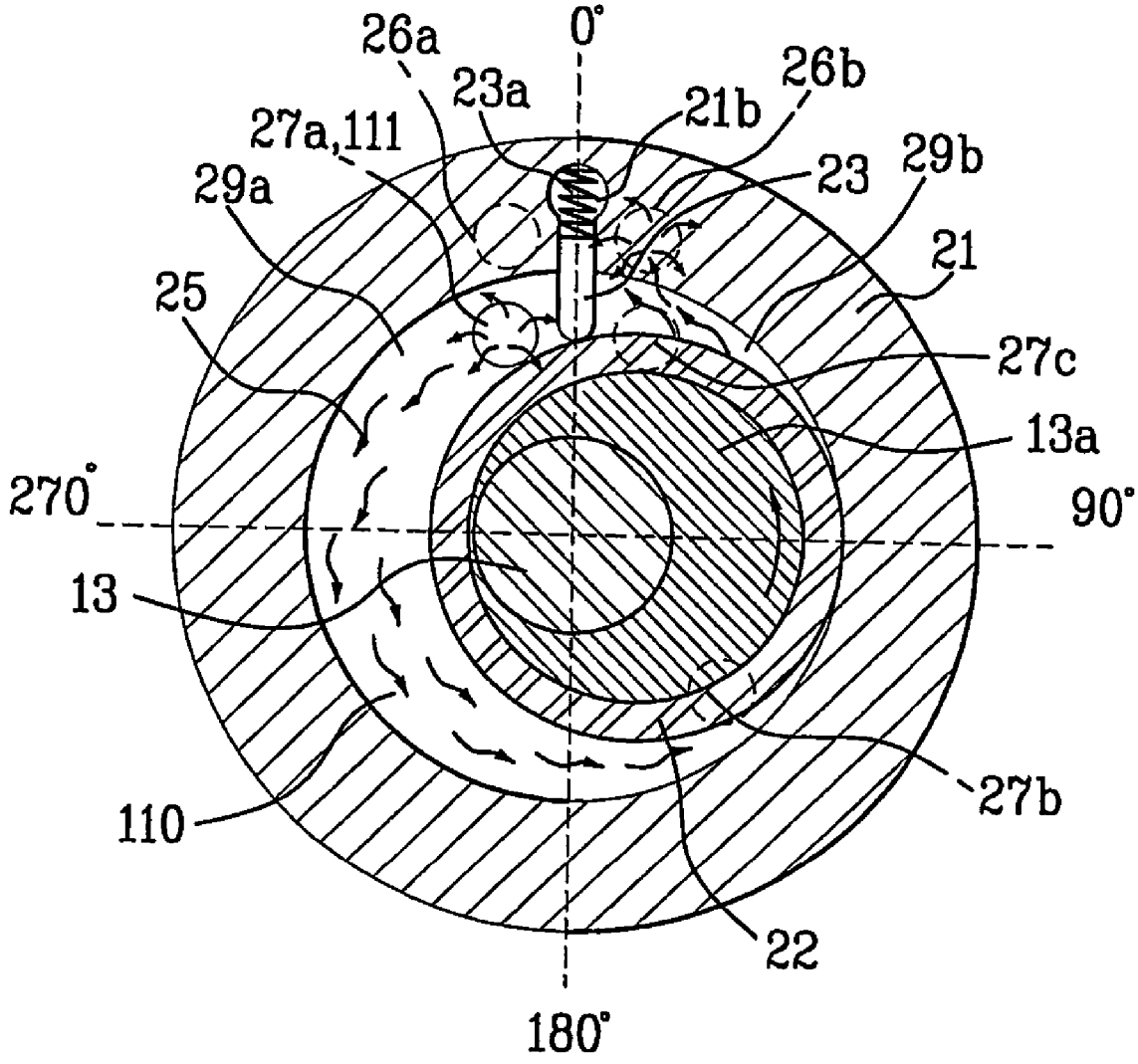

FIGS. 14A to 14C are cross-sectional views sequentially illustrating insides of the cylinder when the roller revolves in the counterclockwise direction in the rotary compressors according to a first embodiment of the present invention.

First, in FIG. 14A, there are shown states of respective elements inside the cylinder 21 when the driving shaft 13 rotates in the counterclockwise direction. First, the first suction port 27*a* communicates with the first opening 111, and the remaining second suction port 27*b* and third suction port 27*c* are closed. Detailed description on the state of the suction ports in the counterclockwise direction will be omitted since it has been described with reference to FIGS. 8A, 9A, 10A and 11A.

In a state that the first suction port 27*a* is opened, the roller 22 revolves counterclockwise with performing a rolling motion along the inner circumference of the cylinder 21 due to the rotation of the driving shaft 13. As the roller 22 continues to revolve, the size of the space 29*b* is reduced as shown in FIG. 14B and thus the fluid that has been sucked is compressed. In this stroke, the vane 23 moves up and down elastically by the elastic member 23*a* to thereby hermetically partition the fluid chamber 29 into the two sealed spaces 29*a* and 29*b*. At the same time, new fluid continues to be sucked into the space 29*a* through the first suction port 27*a* (first opening 111) so as to be compressed in a next stroke.

When the fluid pressure in the space 29*b* is above a predetermined value, the second discharge valve 26*d* shown in FIG. 2 is opened. Accordingly, as shown in FIG. 14C, the fluid is discharged through the second discharge port 26*b*. As the roller 22 continues to revolve, all the fluid in the space 29*b* is discharged through the second discharge port 26*b*. After the fluid is completely discharged, the second discharge valve 26*d* closes the second discharge port 26*b* by its self-elasticity.

Thus, after a single stroke is ended, the roller 22 continues to revolve counterclockwise and discharges the fluid by repeating the same stroke. In the counterclockwise stroke, the roller 22 compresses the fluid with revolving from the first suction port 27*a* to the second discharge port 26*b*. As aforementioned, since the first suction port 27*a* (the first opening 111) and the second discharge port 26*b* are positioned in the vicinity of the vane 23 to face each other, the fluid is compressed using the overall volume of the fluid chamber 29 in the counterclockwise stroke. In other words, a compressive space corresponding to the entire volume of the fluid chamber 29 is created during the counterclockwise stroke, so that a maximal compression capacity is obtained.

Figure 15A:
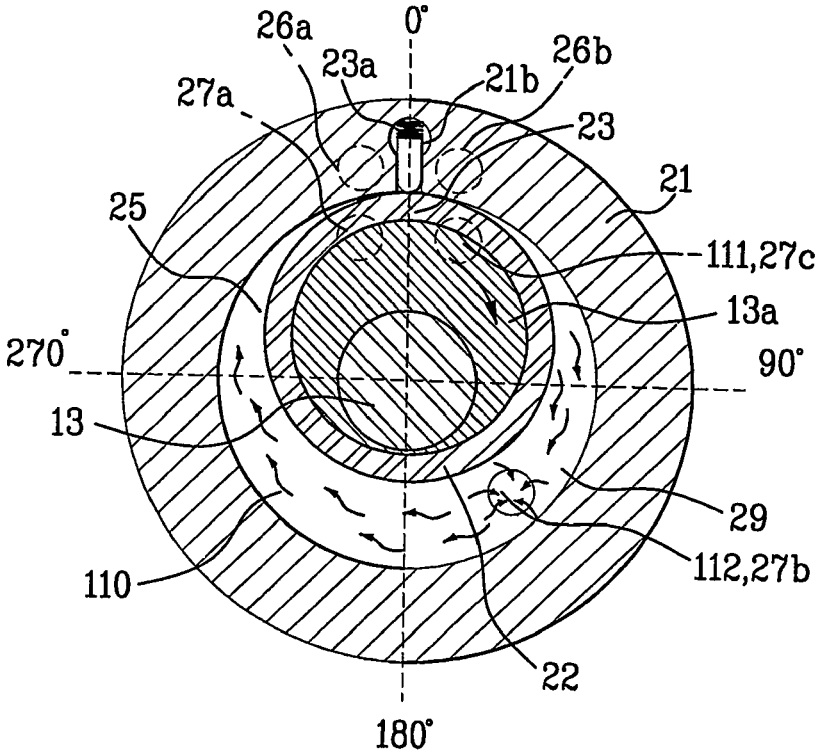
FIGS. 15A to 15C are cross-sectional views sequentially illustrating insides of the cylinder when the roller revolves in the clockwise direction in the rotary compressors according to a first embodiment of the present invention.
Figure 15B:
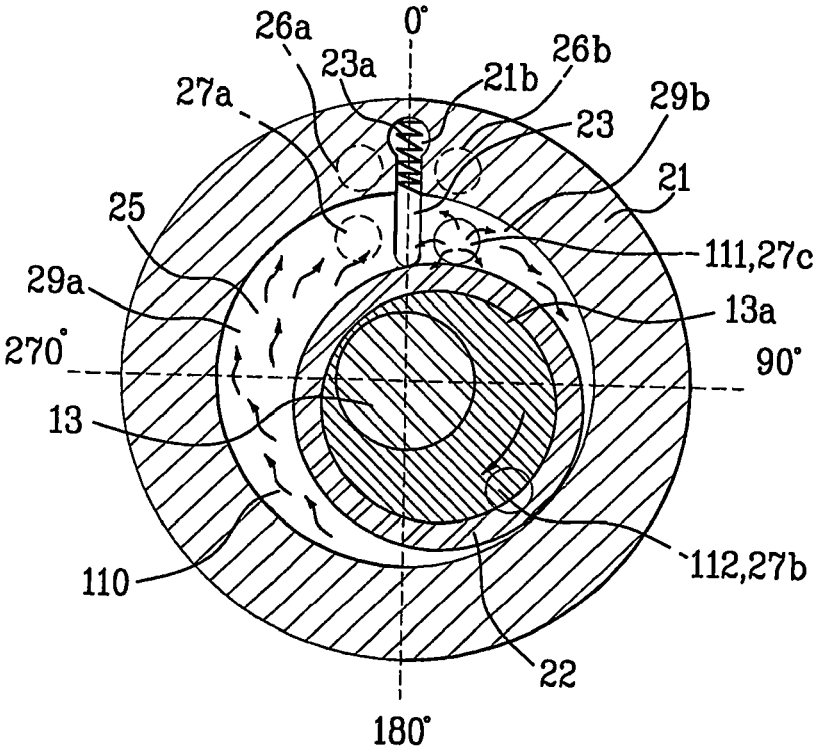
Figure 15C:
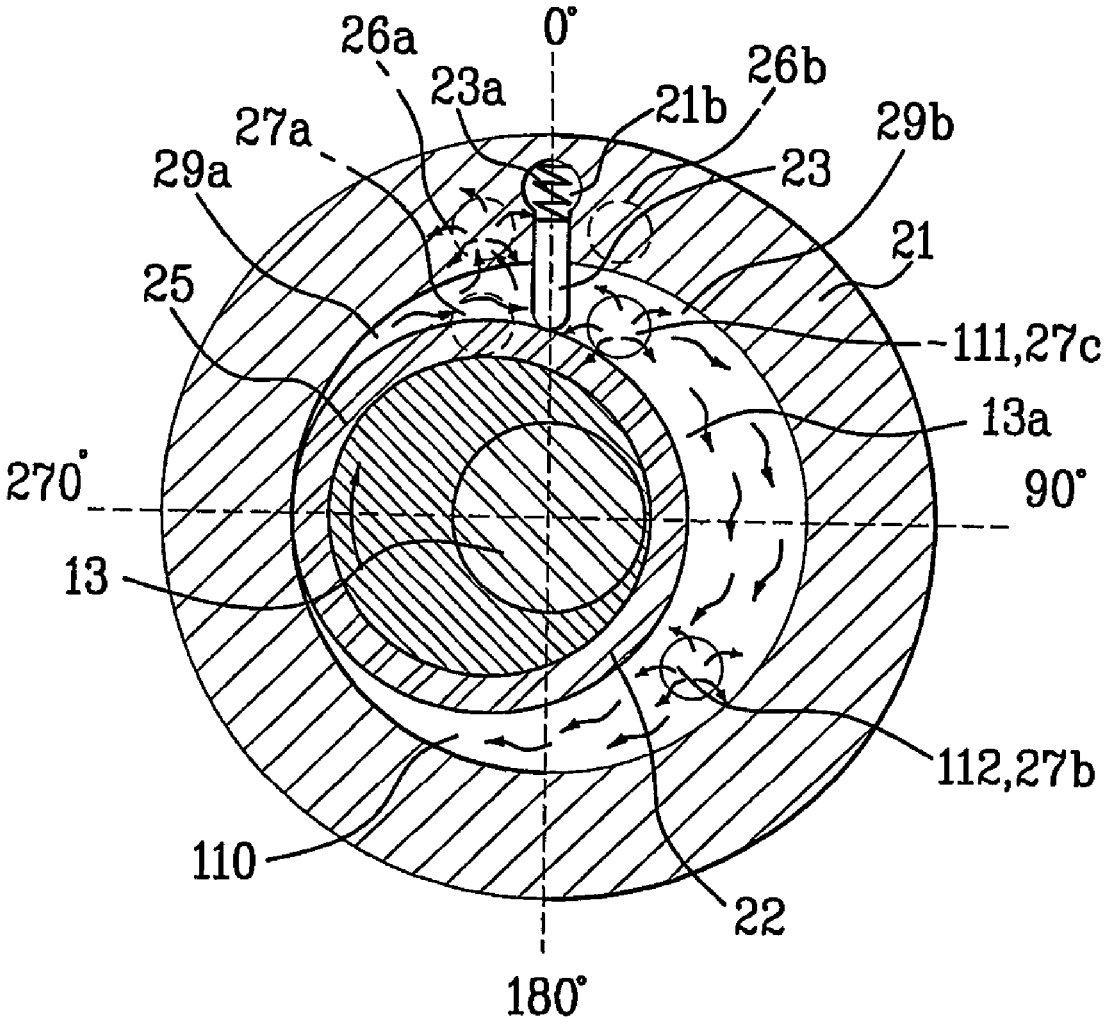
Figure 16:
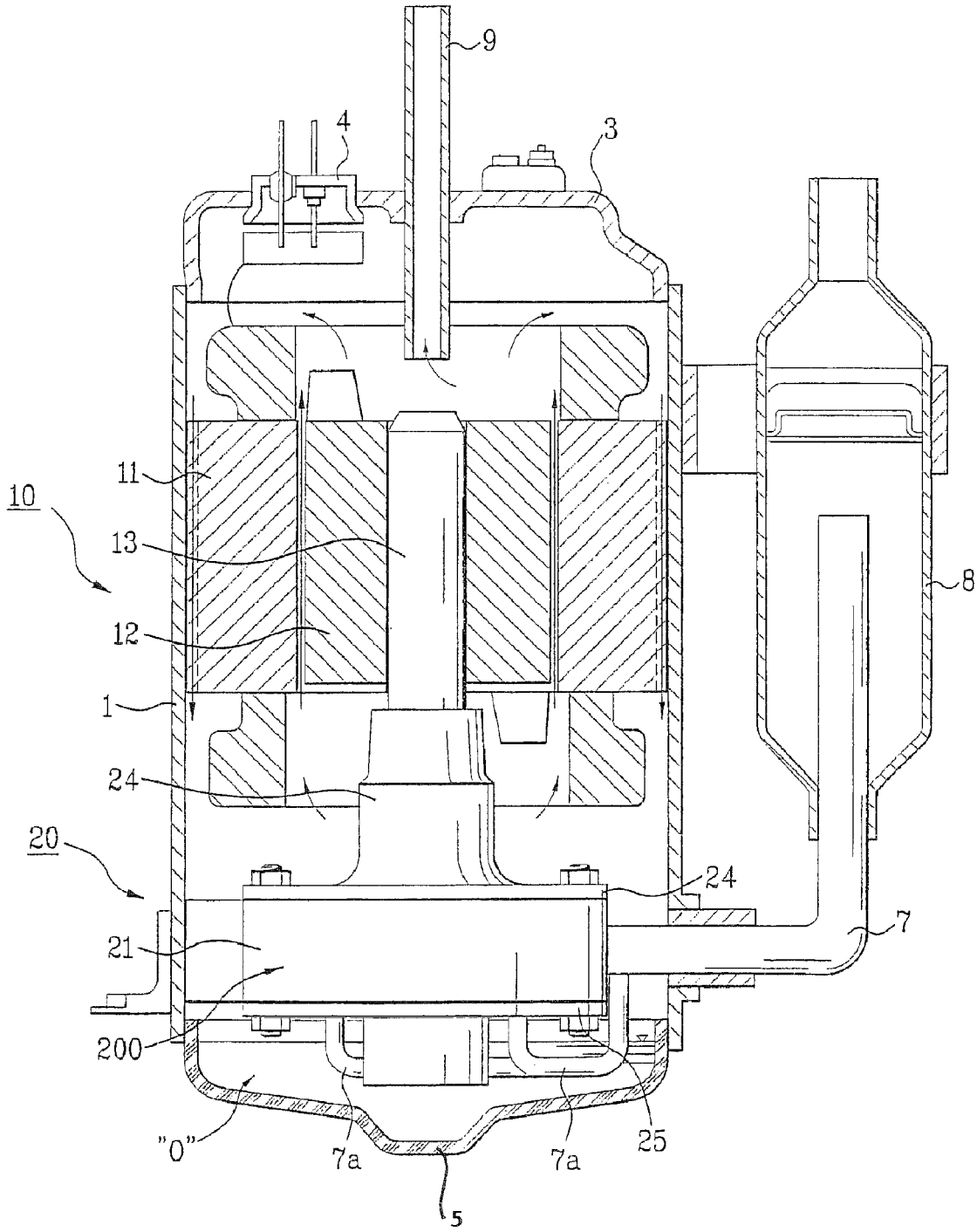
FIG. 16 is a partial longitudinal sectional view illustrating a rotary compressor according to a second embodiment of the present invention.

FIGS. 15A to 15C are cross-sectional views sequentially illustrating insides of the cylinder when the roller revolves in the clockwise direction in the rotary compressors according to a first embodiment of the present invention.

First, in FIG. 15A, there are shown states of respective elements inside the cylinder 21 when the driving shaft 13 rotates in the clockwise direction. The first suction port 27*a* is closed, and the second suction port 27*b* and third suction port 27*c* communicate with the second opening 112 and the first opening 111 respectively. If the first valve 110 has the third opening 113 additionally (refer to FIG. 6A), the third suction port 27*c* communicates with the third opening 113. Detailed description on the state of the suction ports in the clockwise direction will be omitted since it has been described with reference to FIGS. 5B, 9B, 10B and 11B.

In a state that the second and third suction ports 27*b* and 27*c* are opened (i.e., a state that the first and second openings 111 and 112 communicate), the roller 22 begins to revolve clockwise with performing a rolling motion along the inner circumference of the cylinder 21 due to the clockwise rotation of the driving shaft 13. In such an initial stage revolution, the fluid sucked until the roller 22 reaches the second suction port 27*b* is not compressed but is forcibly exhausted outside the cylinder 21 by the roller 22 through the second suction port 27*b* as shown in FIG. 15A. Accordingly, the fluid begins to be compressed after the roller 22 passes the second suction port 27*b* as shown in FIG. 15B. At the same time, a space between the second suction port 27*b* and the vane 23, i.e., the space 29*b* is made in a vacuum state. However, as aforementioned, as the revolution of the roller 22 starts, the third suction port 27*c* communicates with the first opening 111 (or third opening 113) so as to suck the fluid and thus is opened. Accordingly, the vacuum state is eliminated by the sucked fluid and thus occurrence of noise and loss of power are suppressed.

As the roller 22 continues to revolve, the size of the space 29*a* is reduced and the fluid that has been sucked is compressed. In this compression stroke, the vane 23 moves up and down elastically by the elastic member 23*a* to thereby partition the fluid chamber 29 into the two sealed spaces 29*a* and 29*b*. Also, new fluid is continuously sucked into the space 29*b* through the second and third suction ports 27*b* and 27*c* (first and second openings 111 and 112) so as to be compressed in a next stroke.

When the fluid pressure in the space 29*a* is above a predetermined value, the first discharge valve 26*c* (see FIG. 2) is opened as shown in FIG. 15C and accordingly the fluid is discharged through the first discharge port 26*a*. After the fluid is completely discharged, the first discharge valve 26*c* closes the first discharge port 26*a* by its self-elasticity.

Thus, after a single stroke is ended, the roller 22 continues to revolve clockwise and discharges the fluid by repeating the same stroke. In the counterclockwise stroke, the roller 22 compresses the fluid with revolving from the second suction port 27*b* to the first discharge port 26*a*. Accordingly, the fluid is compressed using a part of the overall fluid chamber 29 in the clockwise stroke, so that a compression space that is different in size than that in the counterclockwise stroke is obtained. In more detail, a compression space smaller than that in the counterclockwise stroke is formed and thus a compression capacity smaller than that in the counterclockwise stroke is obtained.

In each of the aforementioned strokes (i.e., the clockwise stroke and the counterclockwise stroke), the discharged compressive fluid moves upward through the space between the rotor 12 and the stator 11 inside the case 1 and the space between the stator 11 and the case 1. Finally, the compressed fluid is discharged through the discharge pipe 9 out of the compressor.

In the above first embodiment, the inventive rotary compressor has suction and discharge ports properly arranged, and valve assembly having the simple structure and for selectively opening the suction ports according to the rotational direction of the driving shaft. Accordingly, although the driving shaft rotates in any one of the counterclockwise direction and clockwise direction, the fluid can be compressed. And, different sizes of compression spaces are formed depending on the rotational direction of the driving shaft such that different compression capacities are obtained in its operation. In particular, any one of the compression capacities is formed using the predesigned entire fluid chamber. In addition, the compressor of the present invention has the plenum for preliminarily storing the fluid so that this fluid could be stably provided to the cylinder.

Second Embodiment

Figure 17:
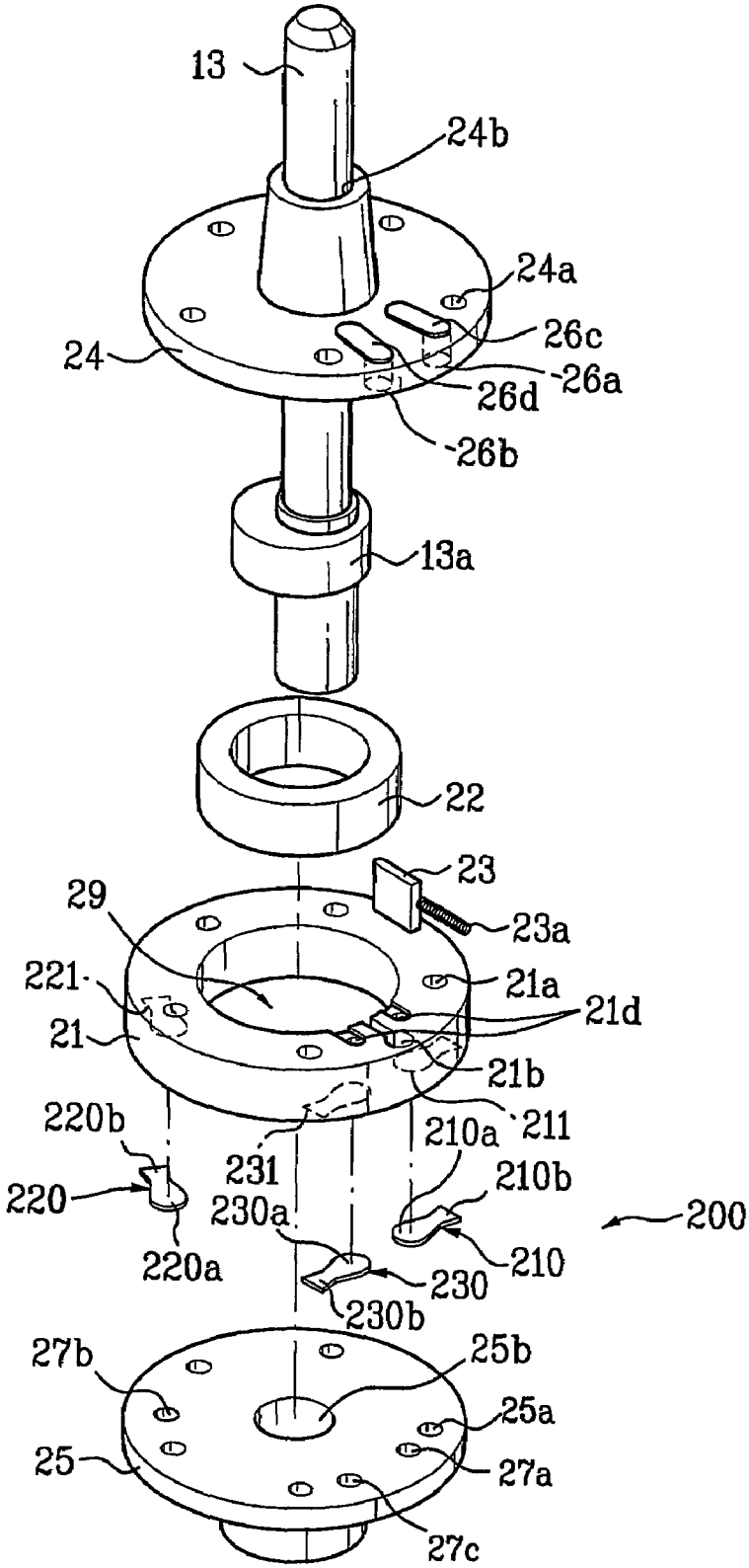
FIG. 17 is an exploded perspective view illustrating the compression unit of the rotary compressor according to a second embodiment of the present invention.
Figure 18:
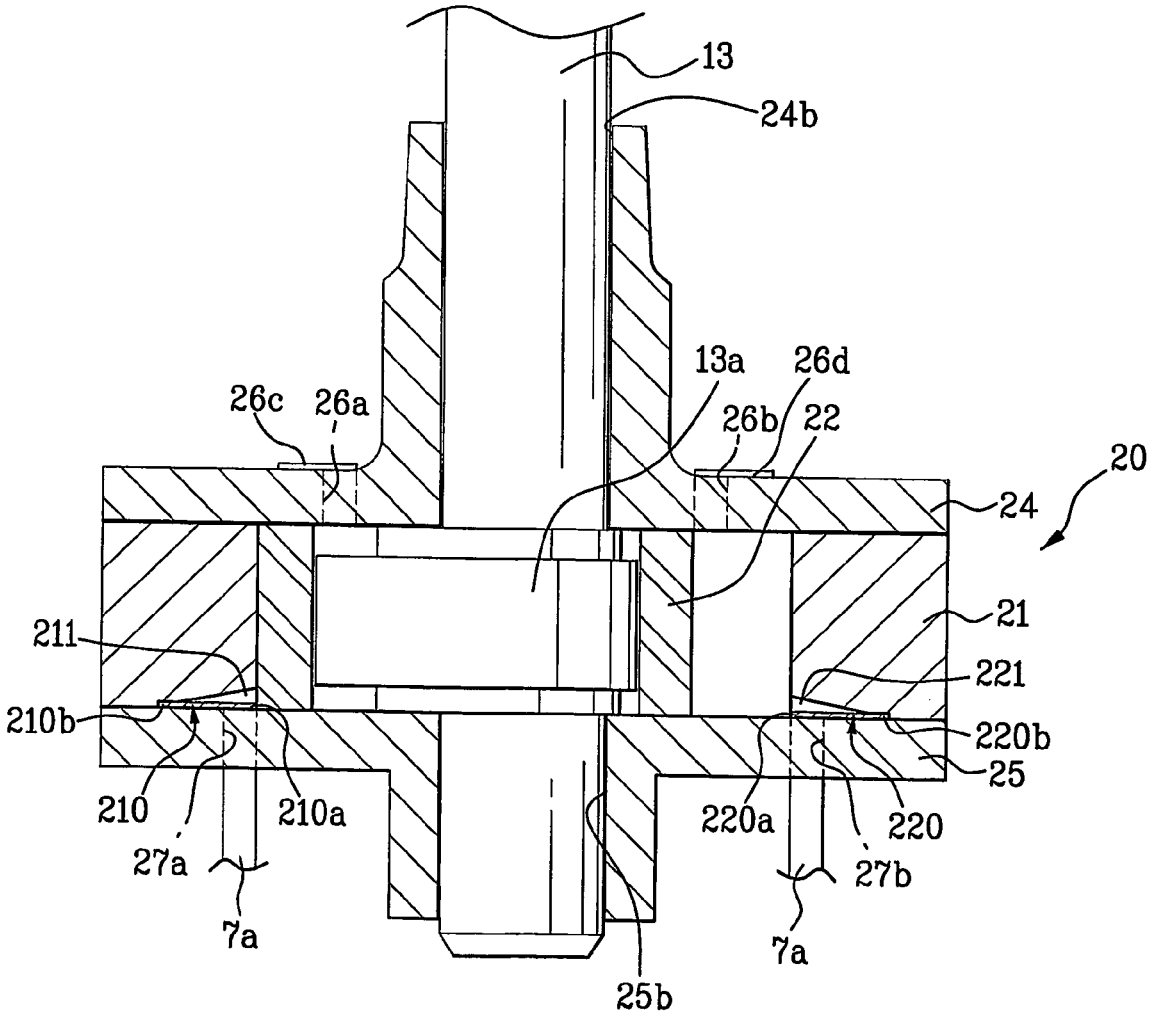
FIG. 18 is a sectional view illustrating the compressing unit according to a second embodiment of the present invention.

FIG. 17 is an exploded perspective view illustrating the compression unit of the rotary compressor according to a second embodiment of the present invention and FIG. 18 is a sectional view illustrating the compressing unit according to a second embodiment of the present invention.

In the compression unit 20 of the second embodiment, the cylinder 21 has a predetermined inner volume and a strength enough to endure the pressure of the fluid to be compressed. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* extending by a predetermined depth from its inner circumference. A vane 23 to be described below is installed in the groove 21*b*. The groove 21*b* is long enough to accommodate the vane 23 completely.

Figure 19:
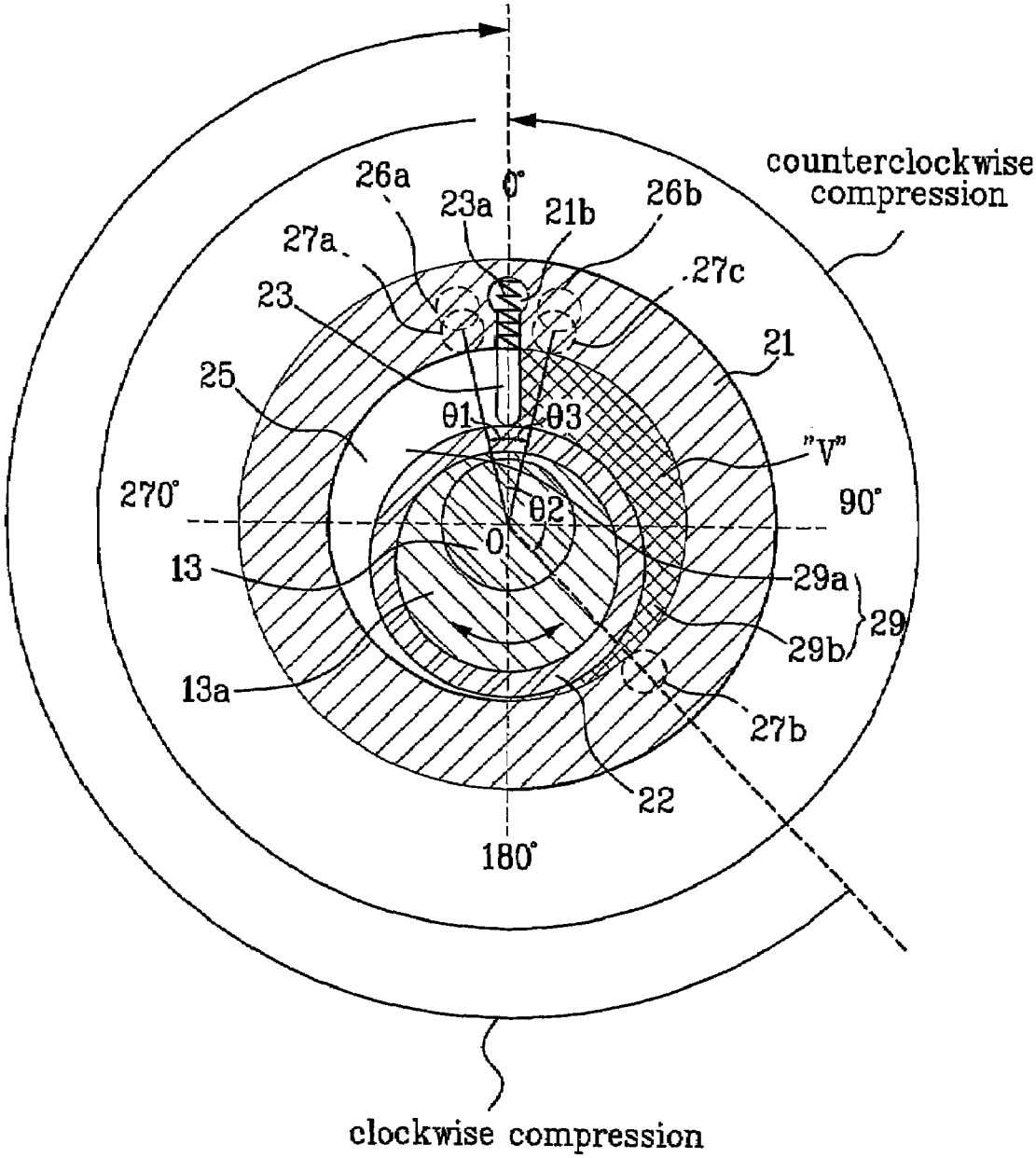
FIG. 19 is a cross-sectional view illustrating the inside of the cylinder according to a second embodiment of the present invention.

The roller 22 is a ring member that has an outer diameter less than the inner diameter of the cylinder 21. As shown in FIG. 19, the roller 22 contacts the inner circumference of the cylinder 21 and is rotatably coupled with the eccentric portion 13*a*. Accordingly, the roller 22 performs rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder 21 form a separate fluid chamber 29 in the inner volume. The fluid chamber 29 is used to suck and compress the fluid in the rotary compressor.

The vane 23 is installed in the groove 21*b* of the cylinder 21 as described above. An elastic member 23*a* is installed in the groove 21*b* to elastically support the vane 23. The vane 23 continuously contacts the roller 22. In other words, the elastic member 23*a* has one end fixed to the cylinder 21 and the other end coupled with the vane 23, and pushes the vane 23 to the side of the roller 22. Accordingly, the vane 23 divides the fluid chamber 29 into two separate spaces 29*a* and 29*b* as shown in FIG. 19. While the driving shaft 13 rotates or the roller 22 revolves, the volumes of the spaces 29*a* and 29*b* are changed complementarily. In other words, if the roller 22 rotates clockwise, the space 29*a* gets smaller but the other space 29*b* gets larger. However, the total volume of the spaces 29*a* and 29*b* is constant and approximately same as that of the predetermined fluid chamber 29. One of the spaces 29*a* and 29*b* works as a suction chamber for sucking the fluid and the other one works as a compression chamber for compressing the fluid relatively when the driving shaft 13 rotates in one direction (clockwise or counterclockwise). Accordingly, as described above, the compression chamber of the spaces 29*a* and 29*b* gets smaller to compress the previously sucked fluid and the suction chamber expands to suck the new fluid relatively according to the rotation of the roller 22. If the rotational direction of the roller 22 is reversed, the functions of the spaces 29*a* and 29*b* are exchanged. In the other words, if the roller 22 revolves counterclockwise, the right space 29*b* of the roller 22 becomes a compression chamber, but if the roller 22 revolves clockwise, the left space 29*a* of the roller 22 becomes a discharge chamber.

The upper bearing 24 and the lower bearing 25 are, as shown in FIG. 17, installed on the upper and lower portions of the cylinder 21 respectively, and rotatably support the driving shaft 12 using a sleeve and the penetrating holes 24*b* and 25*b* formed inside the sleeve. In more detail, the upper bearing 24, the lower bearing 25 and the cylinder 21 include a plurality of coupling holes 24*a*, 25*a* and 21*a* formed to correspond to each other respectively. The cylinder 21, the upper bearing 24 and the lower bearing 25 are coupled with one another to seal the cylinder inner volume, especially the fluid chamber 29 using coupling members such as bolts and nuts.

Referring to FIGS. 17 and 18, discharge ports 26*a* and 26*b* are formed on the upper bearing 24. The discharge ports 26*a* and 26*b* communicate with the fluid chamber 29 so that the compressed fluid can be discharged. The discharge ports 26*a* and 26*b* can communicate directly with the fluid chamber 29 or can communicate with the fluid chamber 29 through a predetermined fluid passage 21*d* formed in the cylinder 21 and the upper bearing 24. As shown in the drawings, the discharge ports 26*a* and 26*b* are formed on the upper bearing 24, but if necessary, may be formed on the lower bearing 25. Also, the discharge ports 26*a* and 26*b* may be formed in the cylinder 21 so as to communicate with the inside of the cylinder 21 easily. Discharge valves 26*c* and 26*d* are installed in the upper bearing 24 so as to open and close the discharge ports 26*a* and 26*b*.

Figure 23A:
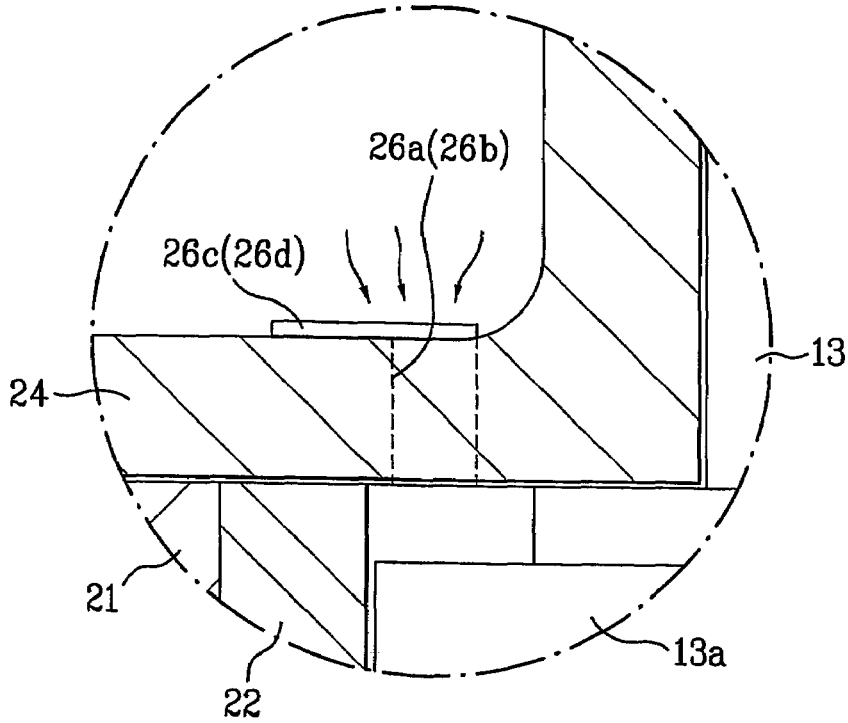
FIGS. 23A and 23B are sectional views illustrating operation of discharge valves of a rotary compressor according to a second embodiment of the present invention.
Figure 23B:
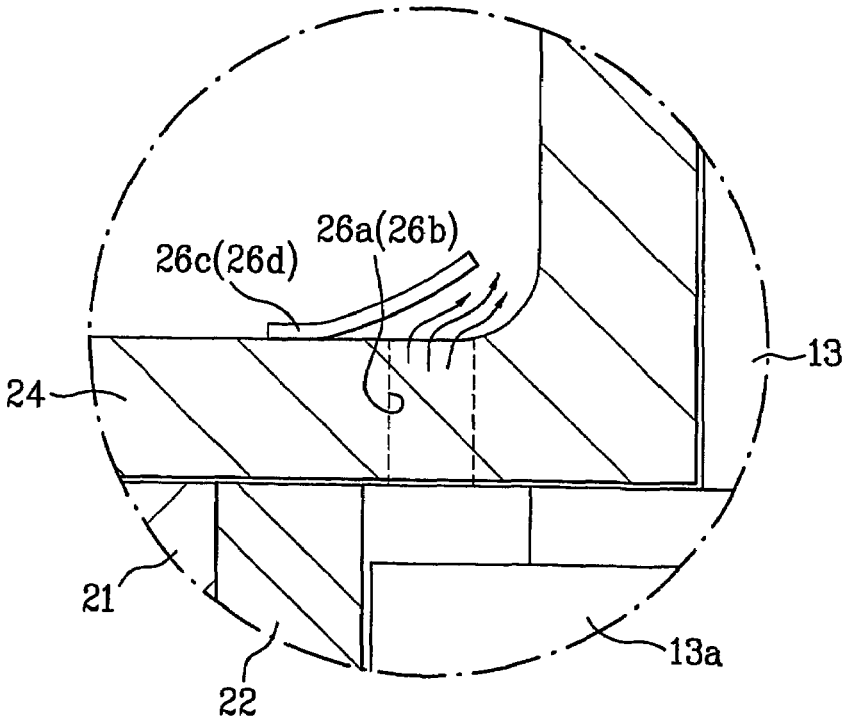

FIGS. 23A and 23B are sectional views illustrating operations of these discharge valves 26*c* and 26*d*.

The discharge valves 26*c* and 26*d* are configured to open the discharge ports 26*a* and 26*b* when a positive pressure which is greater than or equal to a predetermined pressure is generated in the inside of the cylinder 21. To achieve this, it is desirable that the discharge valves 26*c* and 26*d* are a plate valve of which one end is fixed in the vicinity of the discharge ports 26*a* and 26*b* and the other end can be deformed freely. These discharge valves 26*c* and 26*d* are deformed toward a relatively low pressure by a relatively high pressure. However, in case a relatively high pressure is generated outside the cylinder 21, the discharge valves 26*c* and 26*d* are confined by the upper bearing 24. In more detail, as shown in FIG. 23A, if a negative pressure is generated inside the cylinder 21, the discharge valves 26*c* and 26*d* are deformed toward the cylinder 21 due to the pressure (atmospheric pressure) outside the cylinder 21 that is relatively high. However, the discharge valves 26*c* and 26*d* are confined by the upper bearing 24 and are not deformed but close the discharge ports 26*a* and 26*b* more firmly on its behalf. Also, in case a relatively low positive pressure is generated in the cylinder 21, the discharge ports 26*a* and 26*b* continue to be closed by the self-elasticity of the discharge valves 26*c* and 26*d*. After that, if a positive pressure above a predetermined value, i.e., a positive pressure that is larger than the elasticity of the discharge valves 26*c* and 26*d* is generated, the discharge valves 26*c* and 26*d* are deformed so as to open the discharge ports 26*a* and 26*b* as shown in FIG. 23B. Accordingly, only when the pressure of the chamber 29 is above a predetermined positive pressure, the discharge valves 26*c* and 26*d* selectively open the discharge ports 26*a* and 26*b*. Although not shown in the drawings, a retainer for limiting the deformable amount may be installed on the upper portion of the discharge valves 26*c* and 26*d* so that the valves can operate stably. In addition, a muffler (not shown) may be installed on the upper portion of the upper bearing 24 to reduce a noise generated when the compressed fluid is discharged.

Referring to FIGS. 17 and 18, suction ports 27*a*, 27*b* and 27*c* communicating with the fluid chamber 29 are formed on the lower bearing 25. The suction ports 27*a*, 27*b* and 27*c* guide the fluid to be compressed to the fluid chamber 29. The suction ports 27*a*, 27*b* and 27*c* are connected to the suction pipe 7 so that the fluid outside the compressor can flow into the chamber 29. More specifically, the suction pipe 7 is branched into a plurality of auxiliary pipes 7*a* and the auxiliary pipes 7*a* are connected to suction ports 27*a* and 27*b* respectively. If necessary, the discharge ports 26*a* and 26*b* may be formed in the cylinder 21 so as to communicate with the inside of the cylinder 21 with ease like the aforementioned discharge ports 26*a* and 26*b*. Also, the discharge ports 26*a* and 26*b* may be formed on the lower bearing 25 and the suction ports 27*a*, 27*b* and 27*c* may be formed on the upper bearing 24.

These suction and discharge ports 26 and 27 become the important factors in determining compression capacity of the rotary compressor, and will be described referring to FIGS. 19 and 20. FIG. 19 is a cross-sectional view illustrating the inside of the cylinder according to a second embodiment of the present invention.

First, the compressor of the present invention includes at least two discharge ports 26*a* and 26*b*. As shown in the drawing, even if the roller 22 revolves in any direction, a discharge port should exist between the suction port and vane 23 positioned in the revolution path to discharge the compressed fluid. Accordingly, one discharge port is necessary for each rotational direction, and allows the compressor of the present invention to discharge the fluid regardless of the revolution direction of the roller 22 (that is, the rotational direction of the driving shaft 13). Meanwhile, as described above, the compression chamber of the spaces 29*a* and 29*b* gets smaller to compress the fluid as the roller 22 approaches the vane 23. Accordingly, the discharge ports 26*a* and 26*b* are preferably formed facing each other in the vicinity of the vane 23 to discharge the maximum compressed fluid. In other word, as shown in the drawings, the discharge ports 26*a* and 26*b* are positioned on both sides of the vane 23 respectively. The discharge ports 26*a* and 26*b* are preferably positioned in the vicinity of the vane 23 if possible.

The suction port 27 is positioned properly so that the fluid can be compressed between the discharge ports 26*a* and 26*b* and the roller 22. Actually, the fluid is compressed from a suction port to a discharge port positioned in the revolution path of the roller 22. In other words, the relative position of the suction port for the corresponding discharge port determines the compression capacity and accordingly two compression capacities can be obtained using different suction ports 27 according to the rotational direction. Accordingly, the compression of the present invention has first and second suction ports 27*a* and 27*b* corresponding to two discharge ports 26*a* and 26*b* respectively and the suction ports are spaced apart by a predetermined angle from each other with respect to the center 0 for two different compression capacities.

Preferably, the first suction port 27*a* is positioned in the vicinity of the vane 23. Accordingly, the roller 22 compresses the fluid from the first suction port 27*a* to the second discharge port 26*b* positioned across the vane 23 in its rotation in one direction (counterclockwise in the drawing). The roller 22 compresses the fluid due to the first suction port 27*a* by using the overall chamber 29 and accordingly the compressor has a maximum compression capacity in the counterclockwise rotation. In other words, the fluid as much as overall volume of the chamber 29 is compressed. The first suction port 27*a* is actually spaced apart by an angle θ1 of 10° clockwise or counterclockwise from the vane 23 as shown in FIGS. 19 and 20. The drawings of the present invention illustrate the first suction port 27*a* spaced apart by the angle θ1 counterclockwise. At this separating angle θ1, the overall fluid chamber 29 can be used to compress the fluid without interference of the vane 23.

The second suction port 27*b* is spaced apart by a predetermined angle from the first suction port 27*a* with respect to the center. The roller 20 compresses the fluid from the second suction port 27*b* to the first discharge port 26*a* in its rotation in counterclockwise direction. Since the second suction port 27*b* is spaced apart by a considerable angle clockwise from the vane 23, the roller 22 compresses the fluid by using a portion of the chamber 29 and accordingly the compressor has less compression capacity than it has during counterclockwise rotary motion. In other words, the fluid as much as a portion volume of the chamber 29 is compressed. The second suction port 27*b* is preferably spaced apart by an angle θ2 of a range of 90-180° clockwise or counterclockwise from the vane 23. The second suction port 27*b* is preferably positioned facing the first suction port 27*a* so that the difference between compression capacities can be made properly and the interference can be avoided for each rotational direction.

Figure 20:
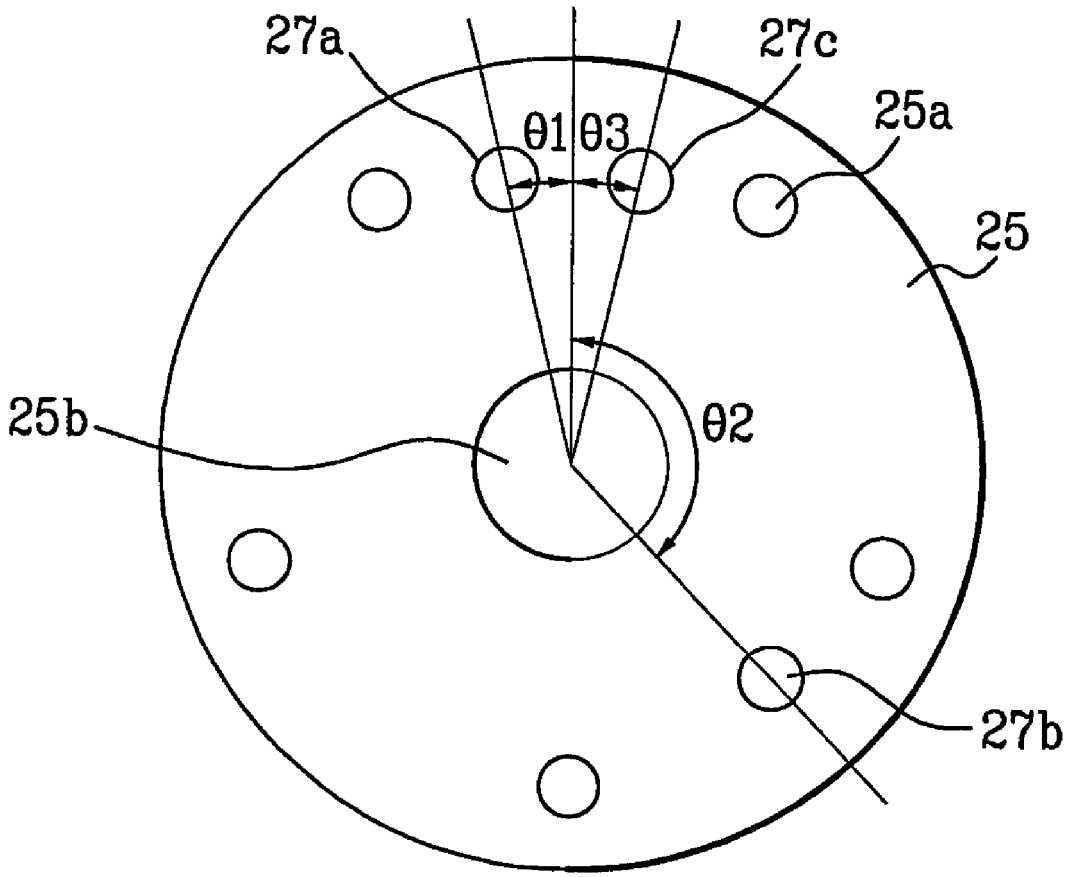
FIG. 20 is a plan view illustrating a lower bearing of the rotary compressor according to a second embodiment of the present invention.

As shown in FIG. 20, the suction ports 27*a* and 27*b* are generally in circular shapes whose diameters are, preferably, 6-15 mm. In order to increase a suction amount of fluid, the suction ports 27*a* and 27*b* can also be provided in several shapes, including a rectangle. Further, the rectangular suction ports 27*a* and 27*b* may have a predetermined curvature.

Meanwhile, in order to obtain desired compression capacity in each rotational direction, suction ports that are available in any one of rotational directions should be single. If there are two suction ports in revolution path of the roller 22, the compression does not occur between the suction ports. In other words, if the first suction port 27*a* is opened, the second suction port 27*b* should be closed, and vice versa. Accordingly, a valve assembly 200 is installed between the lower bearing 24 and the cylinder 21 to selectively open only one of the suction ports 27*a* and 27*b* according to the revolution direction (i.e., rotational direction of the driving shaft 13). Thus, by selectively opening a specific one of the suction ports, different compression spaces can be substantially formed in the fluid chamber 29 according to the rotational direction, so that the valve assembly 200 acts as the inventive compression mechanism previously defined.

As shown in FIGS. 17 and 18, the valve assembly 200 includes first and second valves 210 and 220, which are installed between the cylinder 21 and the lower bearing 25 so as to allow it to be adjacent to the suction ports. If the suction ports 27*a*, 27*b* and 27*c* are formed on the upper bearing 24, the first and second valves 210 and 220 are installed between the cylinder 21 and the upper bearing 24.

Basically, to allow fluid to be sucked into the inside of the cylinder 21, i.e., into the inside of the fluid chamber 29, the inner pressure of the cylinder 21 should be lower than the outer pressure (atmospheric pressure) of the cylinder 21. Accordingly, the first and second valves 210 and 220 are configured to open the suction ports 27*a* and 27*b* when a pressure difference between the inside and the outside of the cylinder 21, more precisely, a negative pressure above a predetermined pressure is generated in the cylinder 21. To achieve this, the first and second valves 210 and 220 may be a check valve allowing one directional flow due to a pressure difference, i.e., fluid flow into the inside of the cylinder 21. In the meanwhile, the first and second valves 210 and 220 may be a plate valve similarly with the discharge valves 26*c* and 26*d*. In the invention, the plate valve is preferable since it can perform the same function with more simple and higher response. The first and second valves 210 and 220 as the plate valves have second ends 210*b* and 220*b* fixed around the discharge ports 26*a* and 26*b* and first ends 210*a* and 220*a* that are freely deformable. The first and second valves 210 and 220 are deformable by an external pressure of the cylinder 21 that is relatively high, only when a negative pressure is generated inside the cylinder 21. On the contrary, in case a positive pressure is generated inside the cylinder 21, the first and second valves 210 and 220 are confined by the lower bearing 25 so as not to be deformed. Also, the first and second valves 210 and 220 may be provided with a retainer for restricting deformation of the first ends 210*a* and 220*a*. In the present invention, the retainer may be an independent member but is preferably simple structured grooves 211, 221 formed in the cylinder 21. The grooves 211, 221 extend with a slope in the length direction of the valves 210 and 220, and the valves 210 and 220, more accurately, the first ends 210*a* and 220*a*, are received in the grooves 211 and 221 as deformed. Accordingly, the grooves 211 and 221 restrict an excessive deformation due to an abrupt pressure variation to thereby allow the valves 210 and 220 to operate stably.

In the meanwhile, referring to FIG. 19, in the case of the clockwise rotation, the fluid's suction or discharge between the vane 23 and the roller 22 does not occur while the roller 22 revolves from the vane 23 to the second suction port 27*b*. Accordingly, a region V becomes a vacuum state. The vacuum region V causes a power loss of the driving shaft 13 and a loud noise. Accordingly, in order to overcome the problem in the vacuum region V, a third suction port 27*c* is provided at the lower bearing 25. The third suction port 27*c* is formed between the second suction port 27*b* and the vane 23, supplying fluid to the space between the roller 22 and the vane 23 so as not to form the vacuum state before the roller 22 passes through the second suction port 27*b*. Preferably, the third suction port 27*c* is formed in the vicinity of the vane 23 so as to remove quickly the vacuum state. However, the third suction port 27*c* is positioned to face the first suction port 27*a* since the third suction port 27*c* operates at a different rotational direction from the first suction port 27*a*. In reality, the third suction port 27*c* is positioned spaced by an angle (θ3) of approximately 10° from the vane 23 clockwise or counterclockwise. Also, the third suction port 27*c* may be a circular shape or a curved rectangular shape like the first and second suction ports 27*a* and 27*b*.

Since the aforementioned third suction port 27*c* operates along with the second suction port 27*b*, the suction ports 27*b* and 27*c* should be simultaneously opened while the roller 22 revolves in any one of the clockwise and counterclockwise directions. Accordingly, the valve assembly 200 further includes a third valve 230 configured to open the third suction port 27*c* as soon as the second suction port 27*b* is opened. Like the first and second valves 210 and 220, the third valve 230 is configured to open the third suction port 27*c* when a negative pressure above a predetermined pressure is generated in the cylinder 21. The third valve 230 may be a check valve or a plate valve. In case the third valve 230 is a plate valve, it has a first end 230*a* and a second end 230*b* like the first and second valves 210 and 220. Also, the third valve 230 as the plate valve may have a groove 231 as a retainer. Since characteristics of this third valve 230 are the same as those of the first and second valves 210 and 220 as described above, its detailed description will be omitted.

Figure 21:
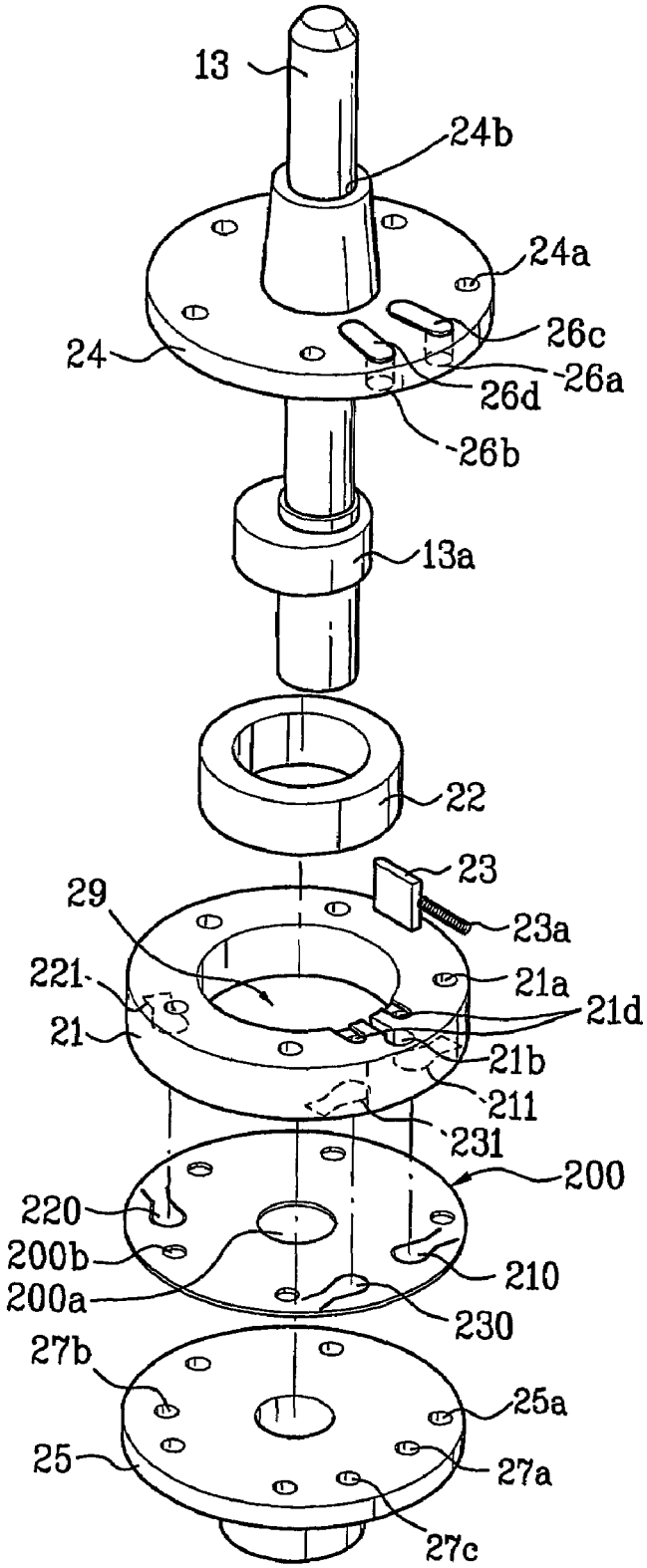
FIG. 21 is an exploded perspective view of a rotary compressor including a modified valve assembly according to a second embodiment of the present invention.
Figure 22:
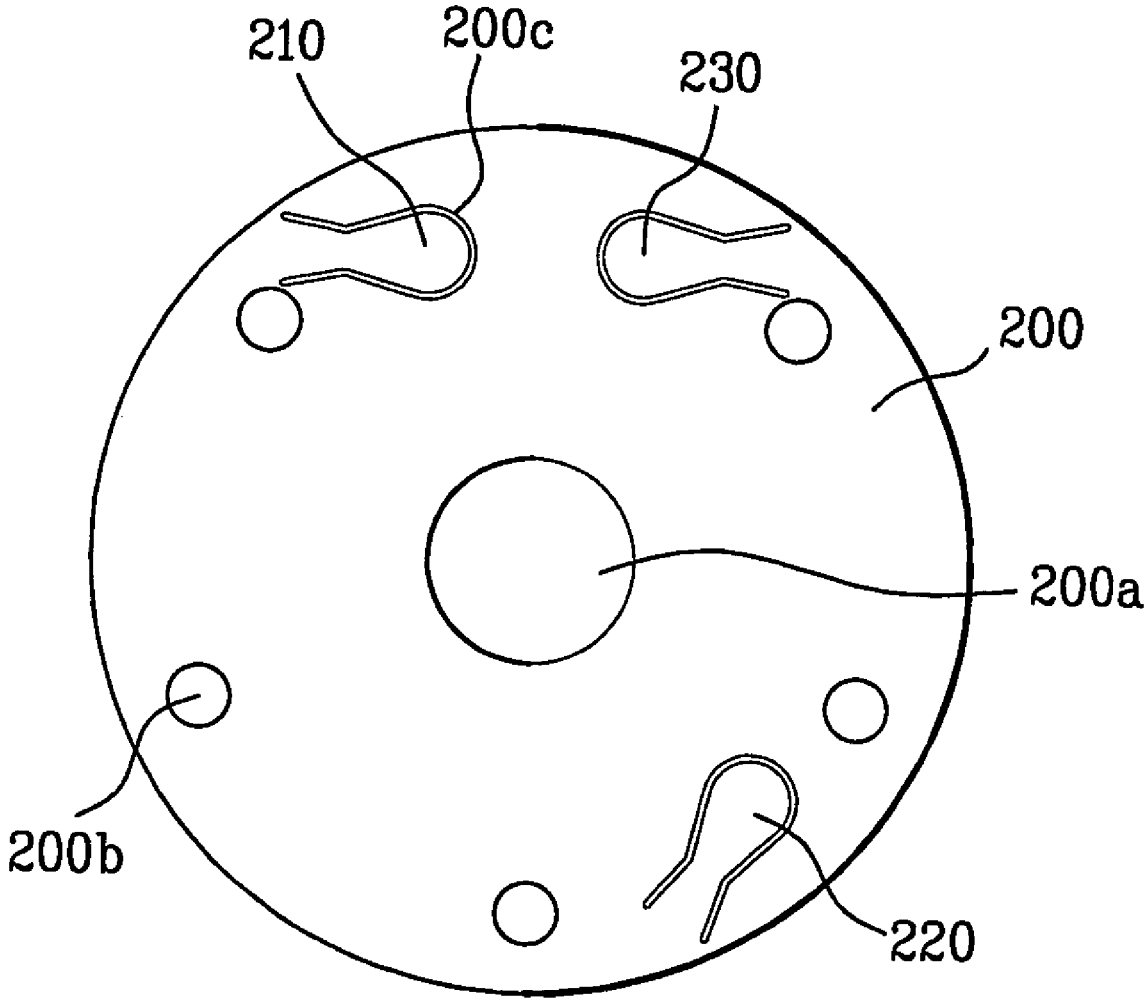
FIG. 22 is a plan view illustrating the valve assembly of FIG. 6.

In FIGS. 17 and 18, the valve assembly 200 is shown as divided valves 210, 220 and 230. In case the valves 210, 220 and 230 are a plate valve, the valve assembly 200 is preferably a single plate member which the plurality of valves 210, 220 and 230 are connected with one another as shown in FIGS. 21 and 22. In more detail, the valves 210, 220 and 230 of the valve assembly 200 can be easily formed by grooves 200*c* formed in the plate member. Also, the valve assembly 200 includes a penetration hole 200*a* through which the driving shaft 13 passes. Further, the valve assembly 200 has a coupling hole 200*b* corresponding to coupling holes 21*a*, 24*a* and 25*a* of the cylinder 21 and the upper and lower bearings 25 and 25, and can be coupled with the cylinder 21 and the upper and lower bearings 24 and 25 by using a proper coupling member. Since the valve assembly 200 can be assembled or fabricated with ease, it is possible to decrease production costs and enhance productivity.

Figure 24A:
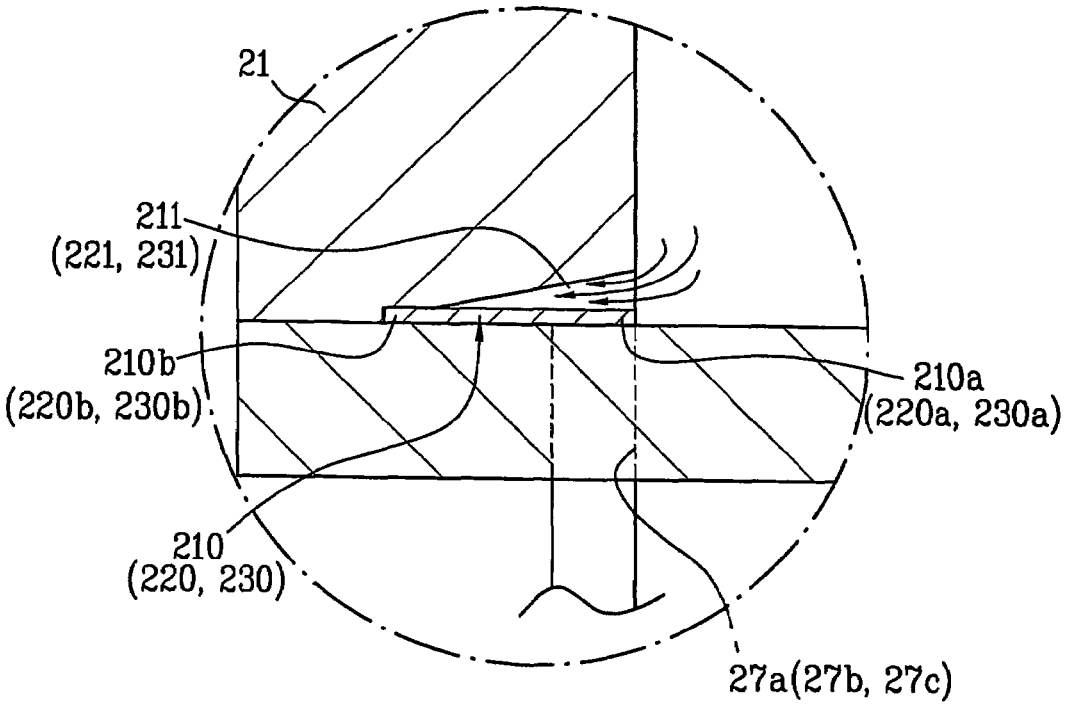
FIGS. 24A and 24B are sectional views illustrating operation of a valve assembly of a rotary compressor according to a second embodiment of the present invention.
Figure 24B:
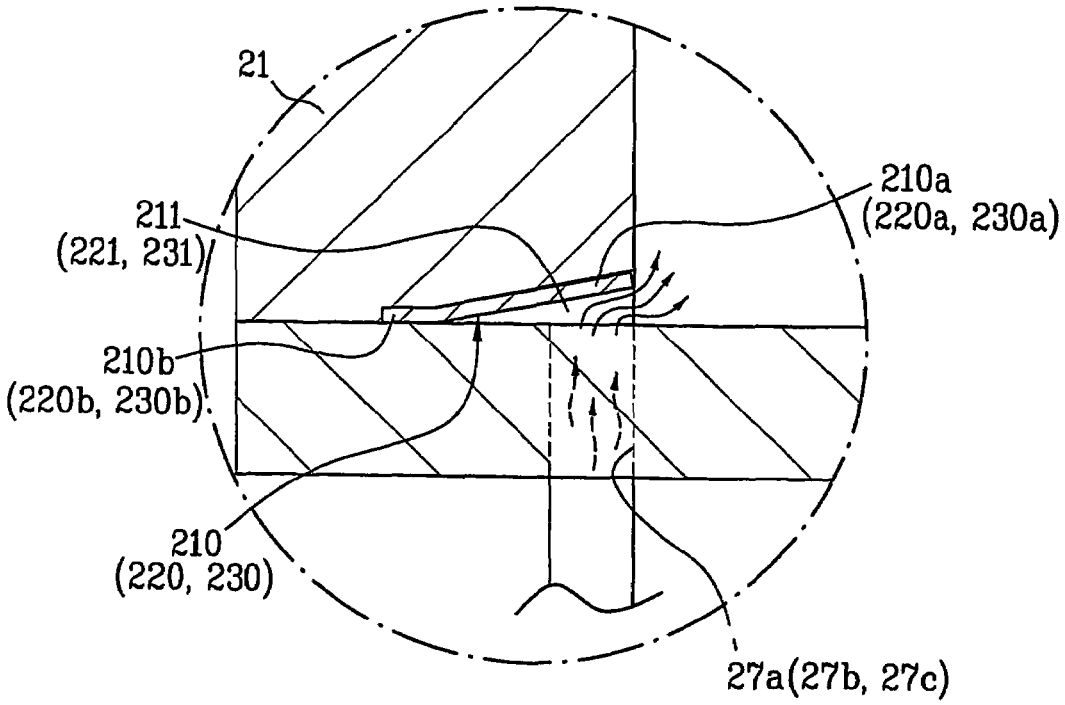

In the aforementioned valve assembly 200, as shown in FIG. 24A, if a positive pressure is generated in the chamber 29, the valves 210, 220 and 230 are deformed toward the lower bearing 25. However, the valves 210, 220 and 230 are confined by the upper bearing 24 and are not deformed, but close the suction ports 27*a*, 27*b* and 27*cb* more firmly on its behalf. Also, in case a relatively low negative pressure is generated in the cylinder 21, the suction ports 27*a*, 27*b* and 27*c* continue to be closed by the self-elasticity of the valves 210, 220 and 230. After that, if a negative pressure above a predetermined value, i.e., a negative pressure that is larger than the elasticity of the valves 210, 220 and 230 is generated, the valves 210, 220 and 230 are deformed toward the cylinder 21 as shown in FIG. 24B, so that the suction ports 27*a* and 27*b* are opened. Accordingly, the valves 210, 220 and 230 selectively open the suction ports 27*a*, 27*b* and 27*c* by using a pressure difference between the inside and the outside of the cylinder 21.

In more detail, as shown in FIG. 19, if the driving shaft 13 rotates any one direction (counterclockwise on the drawing), space 29*b* in front of the rotational direction is gradually reduced and thus the fluid is compressed. In the meanwhile, a negative pressure is formed in a space 29*a* formed at an opposite place to the rotational direction. Accordingly, as aforementioned, the first valve 210 opens the first suction port 27*a*. Likewise, if the driving shaft 13 rotates in other direction (clockwise on the drawing), a negative pressure is formed in the space 29*b*, and the second valve 220 opens the second suction port 27*b*. Like the second valve 220, the third valve 230 is influenced by the negative pressure to open the third suction port 27*c* in the clockwise rotation of the driving shaft 13. Resultantly, the first to third valves 210, 220 and 230 in the valve assembly 200 of the invention selectively open the corresponding suction ports 27*a*, 27*b* and 27*c* according to the rotational direction of the driving shaft 13.

Figure 25:
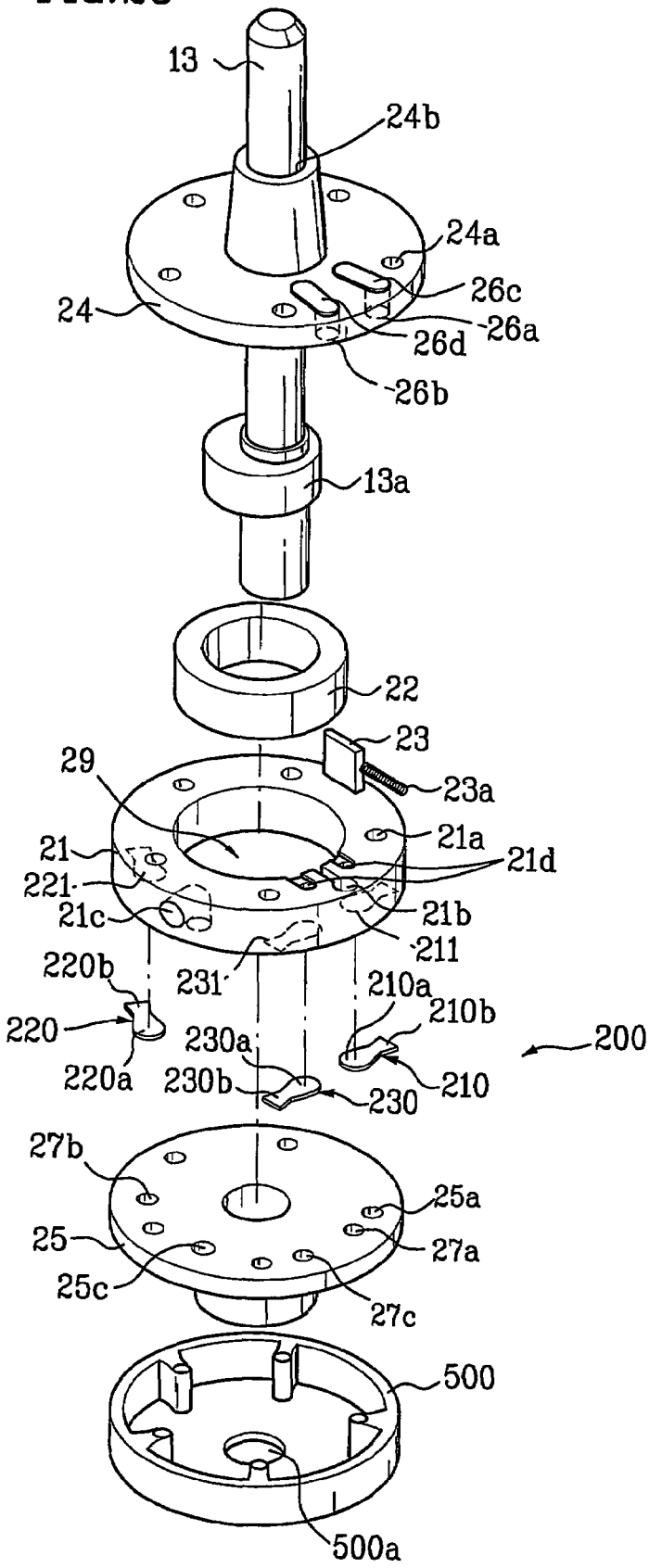
FIG. 25 is an exploded perspective view of a compressing unit of a rotary compressor including a suction plenum according to a second embodiment of the present invention.
Figure 26:
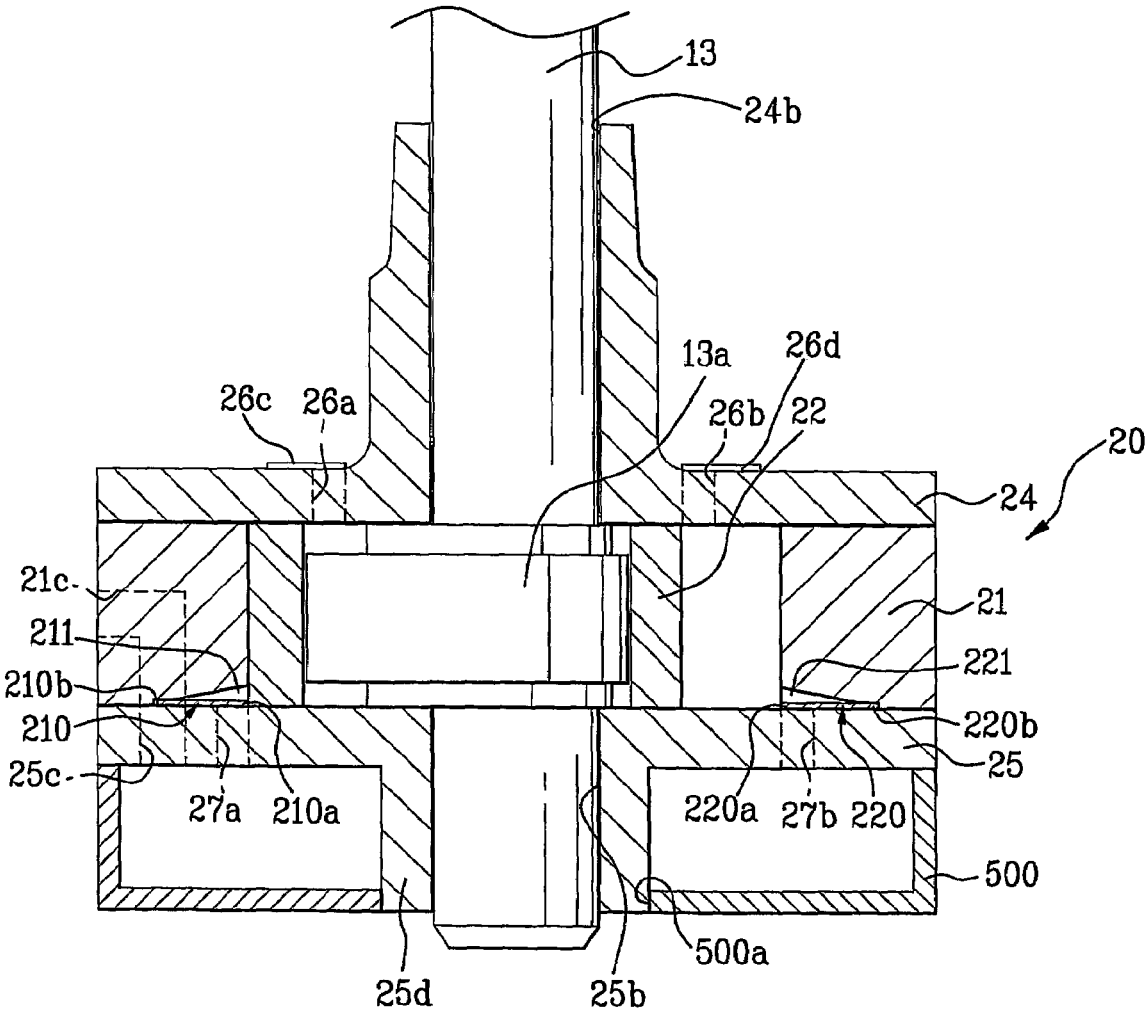
FIG. 26 is a cross-sectional view of the compressing unit shown in FIG. 25.

Meanwhile, as described above with reference to FIGS. 17 and 18, the suction ports 27*a*, 27*b* and 27*c* are individually connected with a plurality of suction pipes 7*a* so as to supply fluid to the fluid chamber 29 inside the cylinder 21. However, the number of parts increases due to these suction pipes 7*a*, thus making the structure complicated. In addition, fluid may not be properly supplied to the cylinder 21 due to a change in a compression state of the suction pipes 7*a* separated during operation. Accordingly, as shown in FIG. 25 and FIG. 26, it is desirable that the compressor includes a suction plenum 500 for preliminarily storing fluid to be sucked into the compressor.

The suction plenum 500 directly communicates with all of the suction ports 27*a*, 27*b* and 27*c* so as to supply the fluid. Accordingly, the suction plenum 500 is installed in a lower portion of the lower bearing 25 in the vicinity of the suction ports 27*a*, 27*b* and 27*c*. Although there is shown in the drawing that the suction ports 27*a*, 27*b* and 27*c* are formed at the lower bearing 25, they can be formed at the upper bearing 24 if necessary. In this case, the suction plenum 500 is installed in the upper bearing 24. The suction plenum 500 can be directly fixed to the bearing 25 by welding. In addition, a coupling member can be used to couple the suction plenum 500 with the cylinder 21, the upper and lower bearings 24 and 25 and the valve assembly 200. In order to lubricate the driving shaft 13, a sleeve 25*d* of the lower bearing 25 should be soaked into a lubricant which is stored in a lower portion of the case 1. Accordingly, the suction plenum 500 includes a penetration hole 500*a* for the sleeve 25*d* so that the sleeve 25*d* can reach the lubricant through the hole 500*a*. Preferably, the suction plenum 500 has 100-400% a volume as large as the fluid chamber 29 so as to supply the fluid stably. The suction plenum 500 is also connected with the suction pipe 7 so as to store the fluid. In more detail, the suction plenum 500 can be connected with the suction pipe 7 through a predetermined fluid passage. In this case, as shown in FIG. 26, the fluid passage penetrates the cylinder 21 and the lower bearing 25. In other words, the fluid passage includes a suction hole 21*c* of the cylinder 21 and a suction hole 25*c* of the lower bearing.

Such a suction plenum 500 forms a space in which a predetermined amount of fluid is always stored, so that a pressure variation of the sucked fluid is buffered to stably supply the fluid to the suction ports 27*a*, 27*b* and 27*c*. In addition, the suction plenum 500 can accommodate oil extracted from the stored fluid (for example, the lubricant included in the fluid) and thus assist or substitute for the accumulator 8.

Hereinafter, operation of a rotary compressor according to a second embodiment of the present invention will be described in more detail.

Figure 27A:
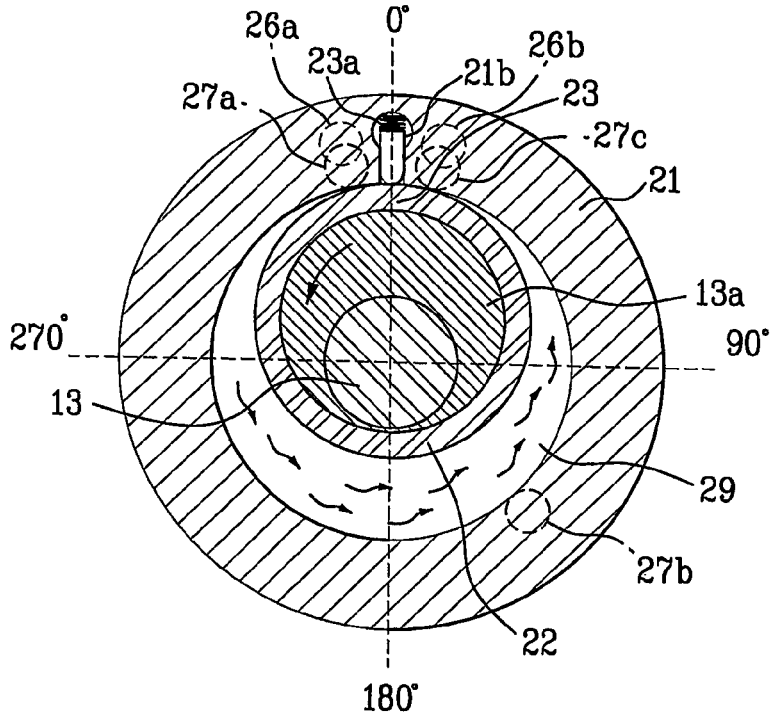
FIGS. 27A to 27C are cross-sectional views sequentially illustrating insides of the cylinder when the roller revolves in the counterclockwise direction in the rotary compressors according to a second embodiment of the present invention.
Figure 27B:
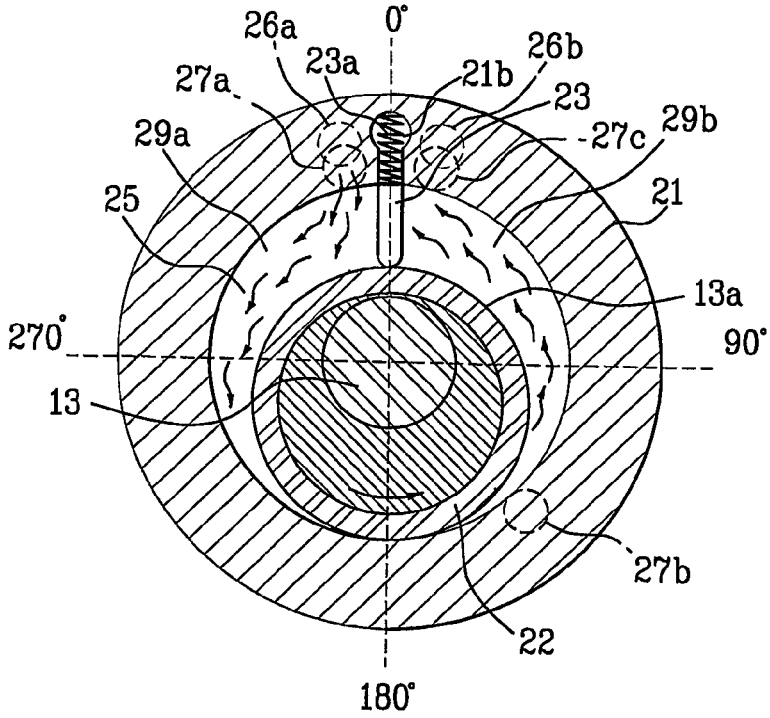
Figure 27C:
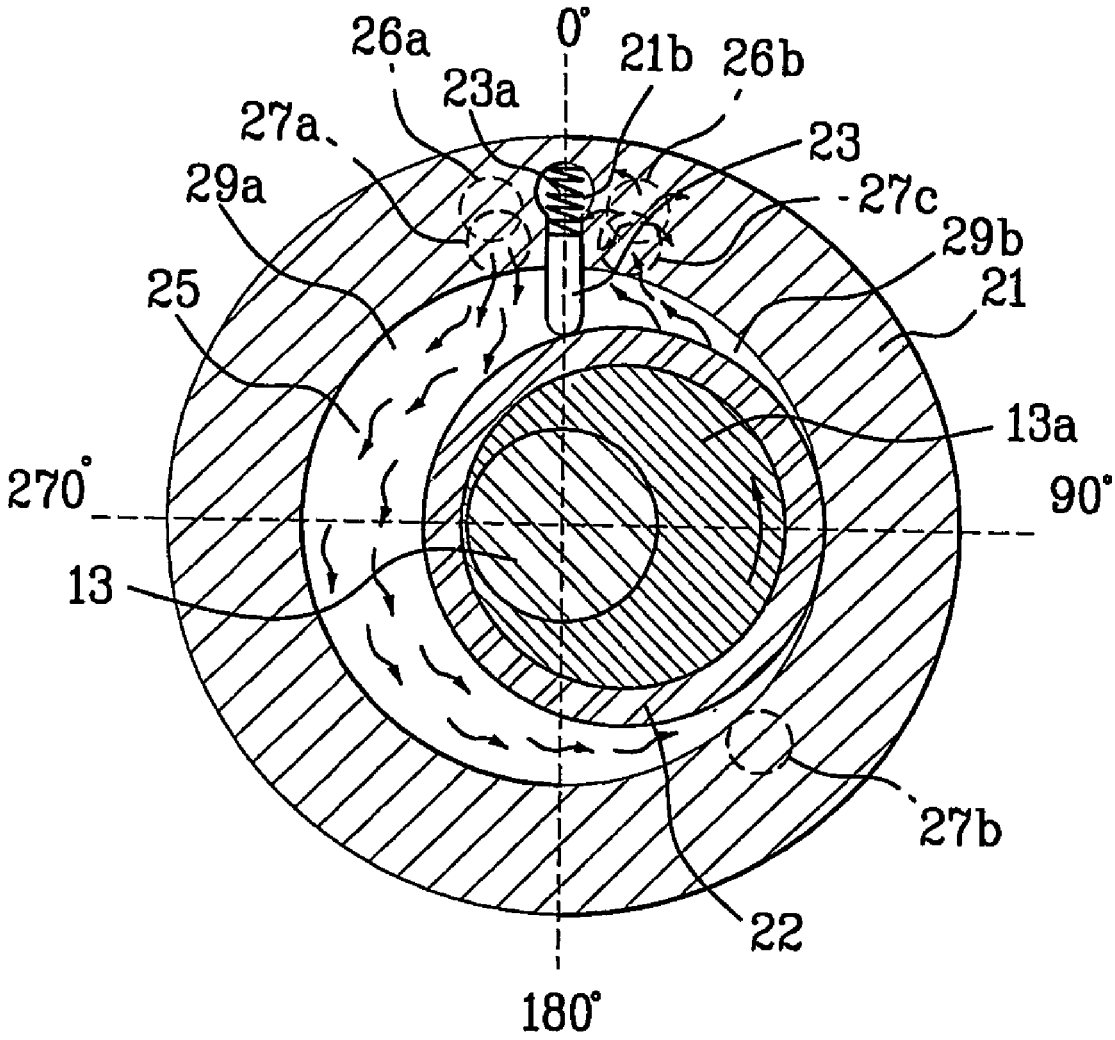

FIGS. 27A to 27C are cross-sectional views sequentially illustrating insides of the cylinder when the roller revolves in the counterclockwise direction in the rotary compressors according to a second embodiment of the present invention.

First, in FIG. 27A, there are shown states of respective elements inside the cylinder 21 when the driving shaft 13 begins to rotate in the counterclockwise direction. Since there is no pressure variation in the cylinder 21, the suction and discharge ports are closed by the respective valves. Since operations of the respective valves in the counterclockwise rotation have been described with reference to FIGS. 23A to 24B in the above, its detailed description will be omitted.

The roller 22 revolves counterclockwise with performing a rolling motion along the inner circumference of the cylinder 21 due to the rotation of the driving shaft 13. As the roller 22 continues to revolve, the size of the space 29*b* is reduced as shown in FIG. 27B and thus the fluid that has been sucked is compressed. Due to the compression, a positive pressure is generated in the space 29*b* and accordingly the second and third suction ports 27*b* and 27*c* are more firmly closed. At the same time, as a negative pressure is generated in the space 29*a*, the first suction port 27*a* is opened and the first discharge port 26*a* is closed. New fluid continues to be sucked into the space 29*a* through the first suction port 27*a* so as to be compressed in a next stroke. In this stroke, the vane 23 moves up and down elastically by the elastic member 23*a* to thereby hermetically partition the fluid chamber 29 into the two sealed spaces 29*a* and 29*b*.

When the fluid pressure in the space 29*b* is above a predetermined value, the second discharge port 26*b* is opened and as shown in FIG. 27C, the fluid is discharged through the second discharge port 26*b*. As the roller 22 continues to revolve, all the fluid in the space 29*b* is discharged through the second discharge port 26*b*. After the fluid is completely discharged, the second discharge valve 26*d* closes the second discharge port 26*b* by its self-elasticity.

Thus, after a single stroke is ended, the roller 22 continues to revolve counterclockwise and discharges the fluid by repeating the same stroke. In the counterclockwise stroke, the roller 22 compresses the fluid with revolving from the first suction port 27*a* to the second discharge port 26*b*. As aforementioned, since the first suction port 27*a* and the second discharge port 26*b* are positioned in the vicinity of the vane 23 to face each other, the fluid is compressed using the overall volume of the fluid chamber 29 in the counterclockwise stroke and thus a maximal compression capacity is obtained.

Figure 28A:
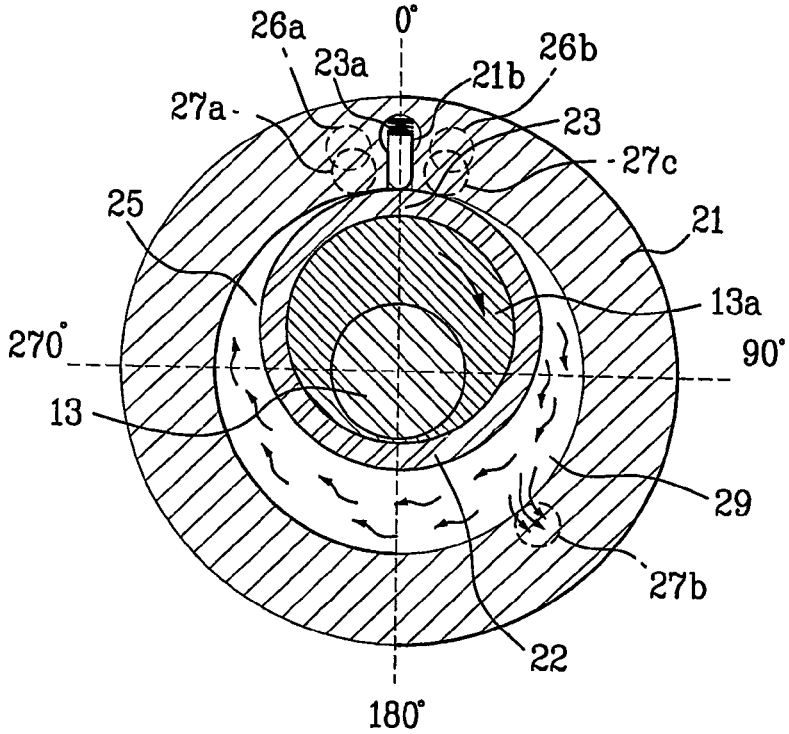
FIGS. 28A to 28C are cross-sectional views sequentially illustrating insides of the cylinder when the roller revolves in the clockwise direction in the rotary compressors according to a second embodiment of the present invention.
Figure 28B:
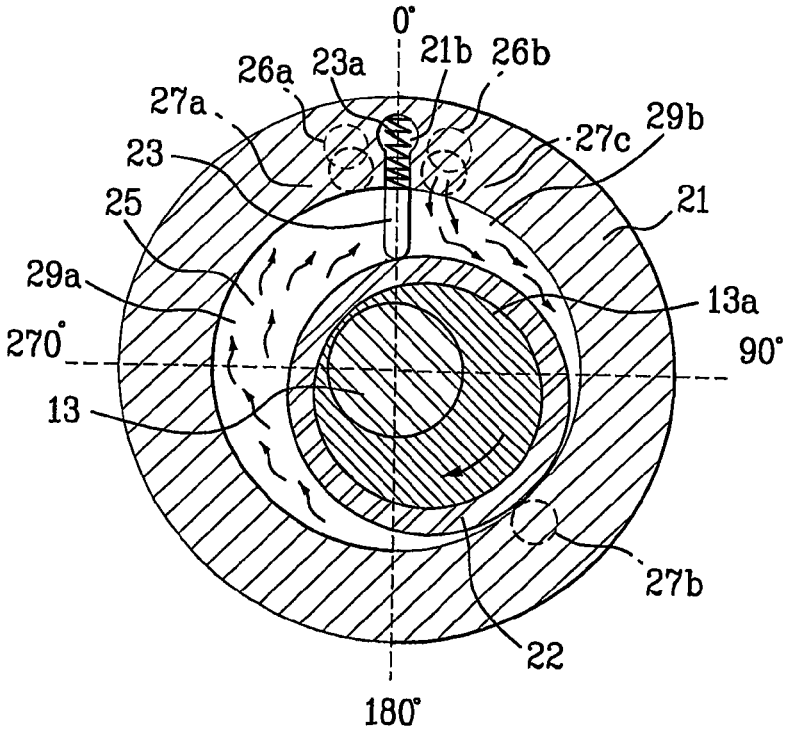
Figure 28C:
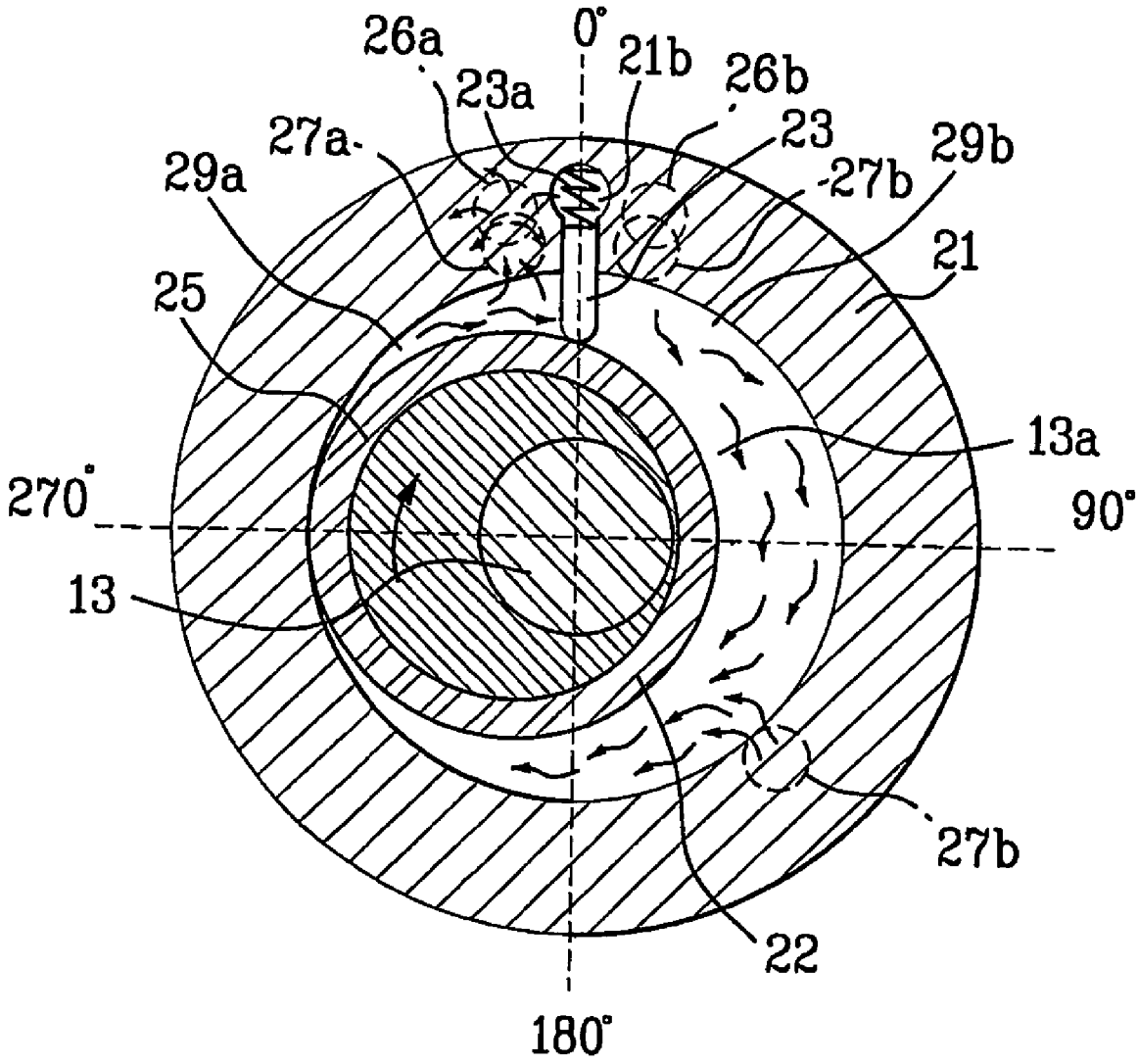
Figure 29:
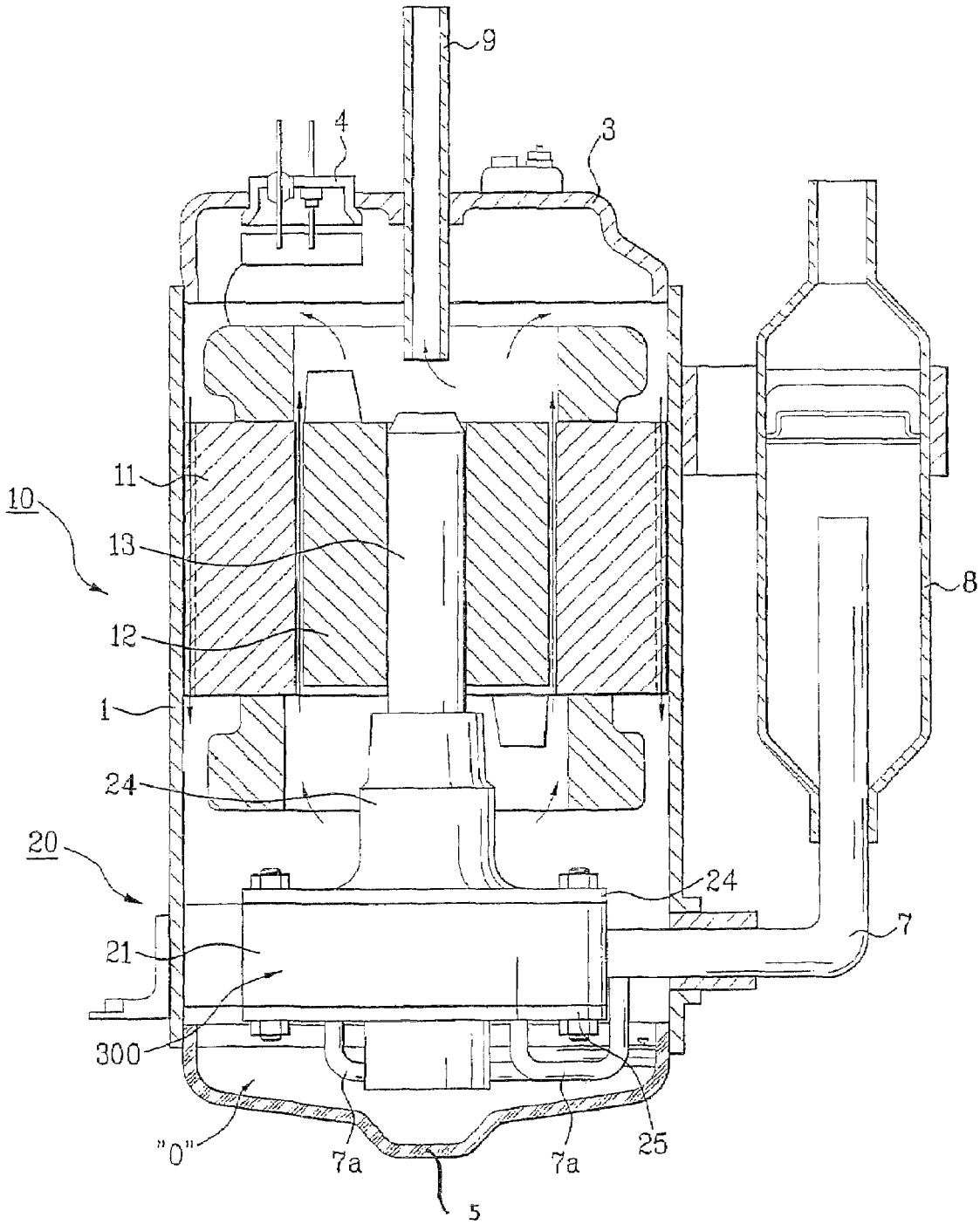
FIG. 29 is a partial longitudinal sectional view illustrating a rotary compressor according to a third embodiment of the present invention.

FIGS. 28A to 28C are cross-sectional views sequentially illustrating insides of the cylinder when the roller revolves in the clockwise direction in the rotary compressors according to a second embodiment of the present invention.

First, in FIG. 28A, there are shown states of respective elements inside the cylinder when the driving shaft 13 rotates in the clockwise direction. Since there is no pressure variation in the cylinder 21, the suction and discharge ports are closed by the respective valves as aforementioned. Since operations of the respective valves in the counterclockwise rotation have been described with reference to FIGS. 23A to 24B in the above, its detailed description will be omitted.

The roller 22 begins to revolve clockwise with performing a rolling motion along the inner circumference of the cylinder 21 due to the rotation of the driving shaft 13. In such an initial stage revolution, the fluid sucked until the roller 22 reaches the second suction port 27*b* is not compressed but is forcibly exhausted outside the cylinder 21 by the roller 22 through the second suction port 27*b* as shown in FIG. 28A. For this purpose, it is preferable that a predetermined clearance is always formed between the second valve 220 and the lower bearing 25. Before a relatively large positive pressure is applied, the fluid is leaked to the outside through the clearance and the second suction port 27*b*. If a large positive pressure is generated, the second valve 220 closes the second suction port 27*b* firmly such that the compressed fluid is not leaked. Accordingly, the fluid begins to be compressed as shown in FIG. 28B after the roller 22 passes through the second suction port 27*b*. At the same time, a space 29*b* between the second suction port 27*b* and the vane 23 becomes a negative pressure state, the second discharge port 26*b* is closed but the third suction port 27*c* is opened. Accordingly, the vacuum state in the space 29*b* is eliminated by the sucked fluid and thus occurrence of noise and loss of power are suppressed. Also, the space 29*a* is in a relatively positive pressure state and the first suction port 27*a* is closed such that the compressed fluid is not leaked.

As the roller 22 continues to revolve, the size of the space 29*a* is reduced and the fluid that has been sucked is further compressed. In this compression stroke, the vane 23 moves up and down elastically by the elastic member 23*a* to thereby partition the fluid chamber 29 into the two sealed spaces 29*a* and 29*b*. Also, while the negative pressure state of the space 29*b* is held, the second suction port 27*c* as well as the third suction port 27*b* is opened, so that new fluid is continuously sucked into the space 29*b* so as to be compressed in a next stroke.

When the fluid pressure in the space 29*a* is above a predetermined value, the first discharge port 26*a* is opened as shown in FIG. 28C and accordingly the fluid is discharged through the first discharge port 26*a*. After the fluid is completely discharged, the first discharge valve 26*c* closes the first discharge port 26*a* by its self-elasticity.

Thus, after a single stroke is ended, the roller 22 continues to revolve clockwise and discharges the fluid by repeating the same stroke. In the clockwise stroke, the roller 22 compresses the fluid with revolving from the second suction port 27*b* to the first discharge port 26*a*. Accordingly, the fluid is compressed using a part of the overall fluid chamber 29 in the counterclockwise stroke, so that a compression capacity that is smaller than that in the clockwise direction is obtained.

In the aforementioned strokes (i.e., the clockwise stroke and the counterclockwise stroke), the discharged compressive fluid moves upward through the space between the rotor 12 and the stator 11 inside the case 1 and the space between the stator 11 and the case 1. Finally, the compressed fluid is discharged through the discharge pipe 9 out of the compressor.

In the aforementioned second embodiment, the inventive rotary compressor has suction and discharge ports properly arranged, and valve assembly having the simple structure and for selectively opening the suction ports according to the rotational direction of the driving shaft using the pressure difference between the inside and the outside of the cylinder. Accordingly, although the driving shaft rotates in any one of the counterclockwise direction and clockwise direction, the fluid can be compressed. And, different sizes of compression spaces are formed depending on the rotational direction of the driving shaft such that different compression capacities are obtained in its operation. In particular, any one of the compression capacities is formed using the predesigned entire fluid chamber. In addition, the compressor of the present invention has the plenum for preliminarily storing the fluid so that the fluid could be stably provided to the cylinder.

Third Embodiment

Figure 30:
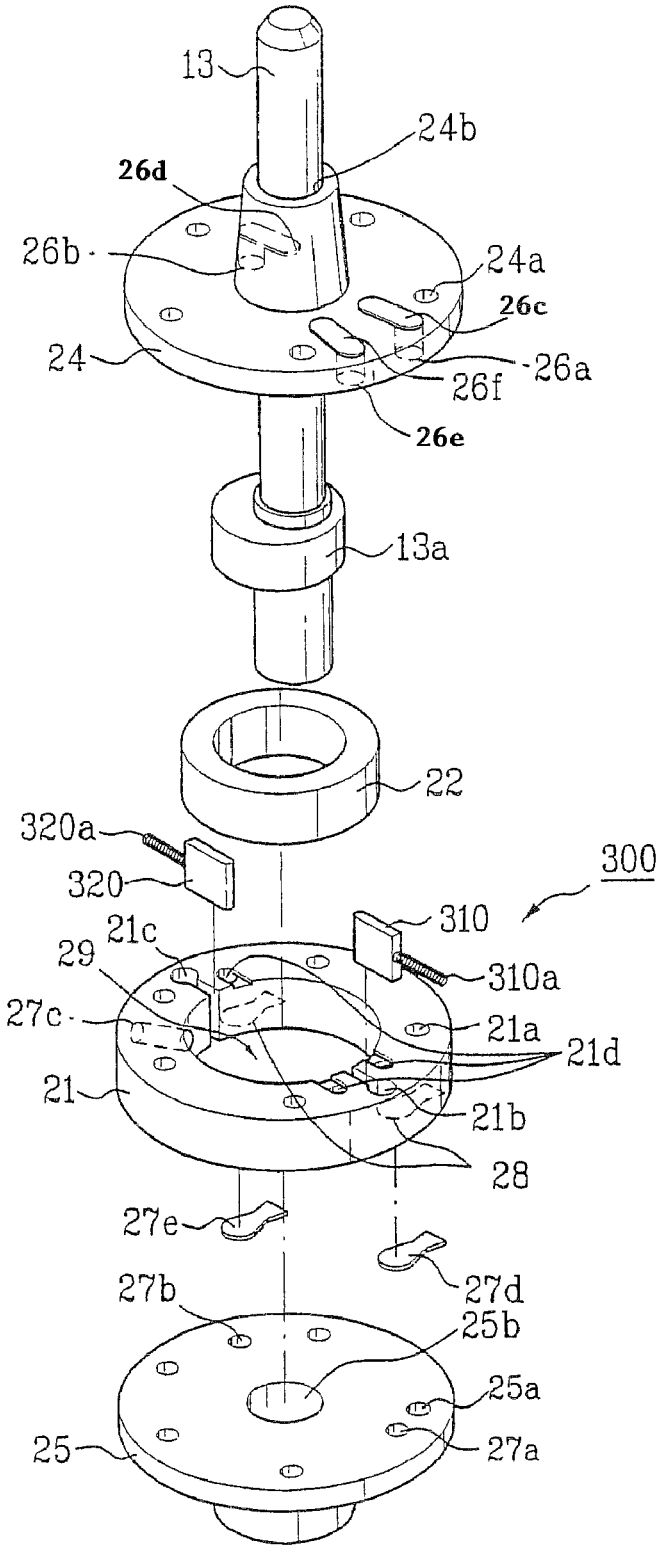
FIG. 30 is an exploded perspective view illustrating the compression unit of the rotary compressor according to a third embodiment of the present invention.
Figure 31:
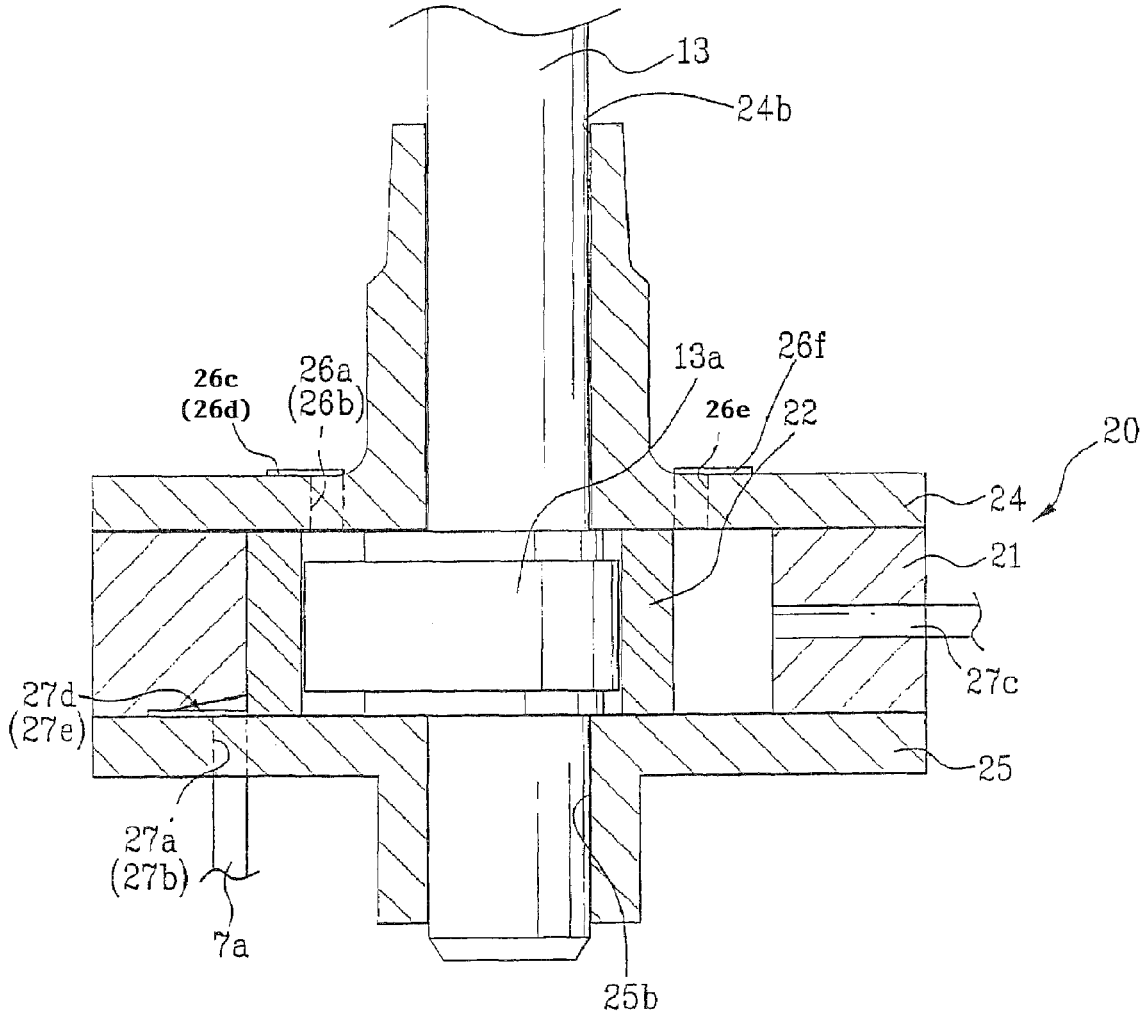
FIG. 31 is a sectional view illustrating the compressing unit according to a third embodiment of the present invention.

FIG. 30 is an exploded perspective view illustrating the compression unit of the rotary compressor according to a third embodiment of the present invention and FIG. 31 is a sectional view illustrating the compressing unit according to a third embodiment of the present invention.

In the third embodiment, the cylinder 21 has a predetermined inner volume and the strength enough to endure the pressure of the fluid to be compressed. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* and a groove 21*c* extending by a predetermined depth from its inner circumference to accommodate a vane assembly 300. Vanes 310 and 320 to be described below are installed in the grooves 21*b* and 21*c*. The grooves 21*b* and 21*c* are long enough to accommodate the vanes 310 and 320 completely.

Figure 32:
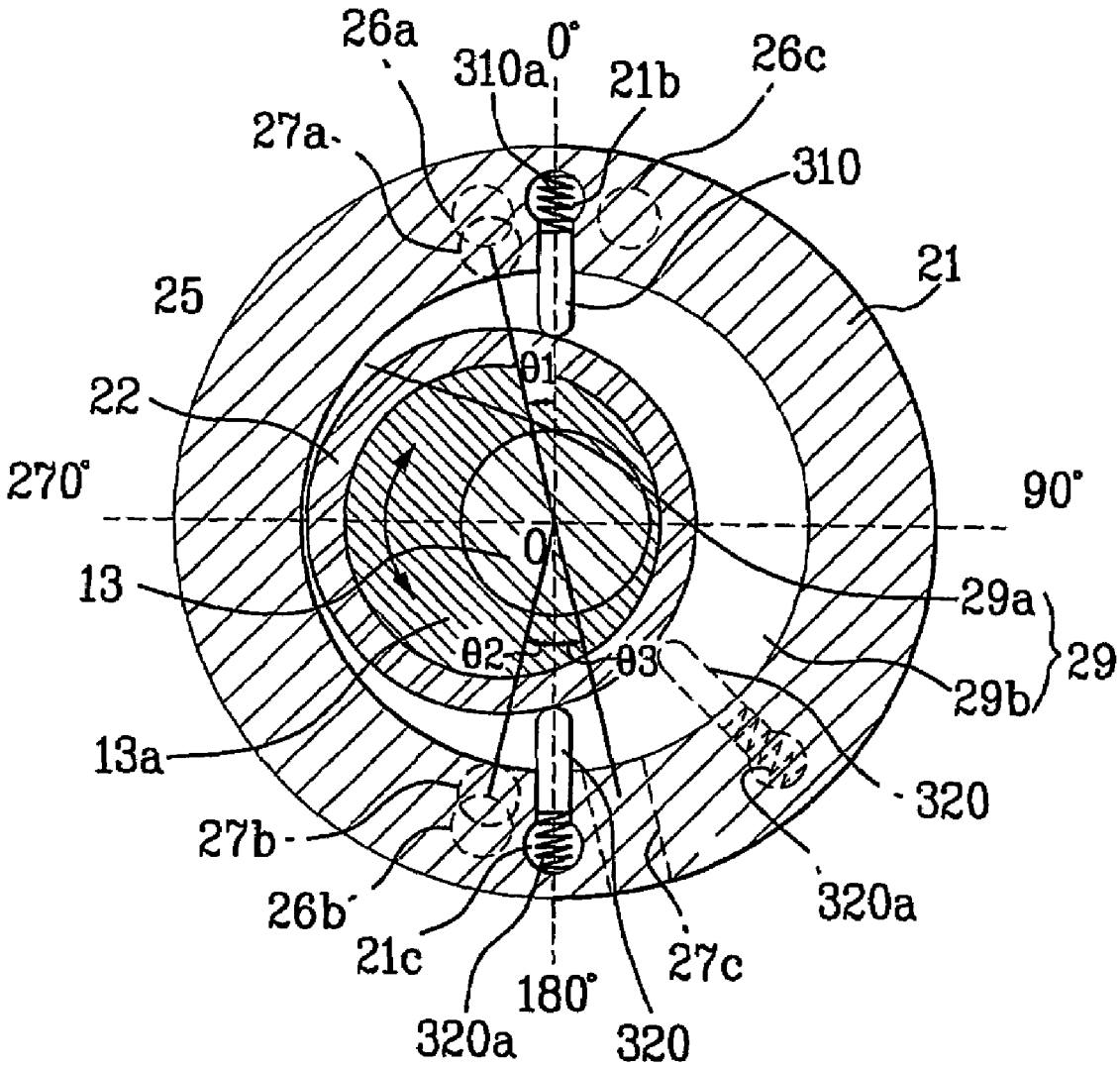
FIG. 32 is a cross-sectional view illustrating the inside of the cylinder according to a third embodiment of the present invention.

The roller 22 is a ring member that has an outer diameter less than the inner diameter of the cylinder 21. As shown in FIG. 32, the roller 22 contacts, the inner circumference of the cylinder 21 and rotatably coupled with the eccentric portion 13*a*. Accordingly, the roller 22 performs rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder 21 form a separate fluid chamber 29 in the inner volume. The fluid chamber 29 is used to suck and compress the fluid in the rotary compressor.

The upper bearing 24 and the lower bearing 25 are, as shown in FIGS. 30 and 31, installed on the upper and lower portions of the cylinder 21 respectively, and rotatably support the driving shaft 12 using a sleeve and the penetrating holes 24*b* and 25*b* formed inside the sleeve. In more detail, the upper bearing 24, the lower bearing 25 and the cylinder 21 include a plurality of coupling holes 24*a*, 25*a* and 21*a* formed to correspond to each other respectively. The cylinder 21, the upper bearing 24 and the lower bearing 25 are firmly coupled with one another to seal the cylinder inner volume, especially the fluid chamber 29 using coupling members such as bolts and nuts.

The vane assembly 300 includes two first and second vanes 310 and 320 installed in the cylinder 21. As aforementioned, the first and second vanes 310 and 320 are installed within the grooves 21*b* and 21*c* of the cylinder 21. Elastic members 310*a* and 320*a* are also installed in the grooves 21*b* and 21*c* to elastically support the vanes 310 and 320. The vanes 310 and 320 continuously contact the roller 22. In other words, the elastic members 310*a* and 320*a* have one ends fixed to the cylinder 21 and the other ends coupled with the vanes 310 and 320, and pushes the vanes 310 and 320 toward the roller 22.

Accordingly, the vanes 310 and 320 divide the fluid chamber 29 into two separate first and second spaces 29*a* and 29*b* as shown in FIG. 32. Since the vanes 310 and 320 are always in contact with the roller 22, the first and second spaces 29*a* and 29*b* are separated completely independently with the revolution direction (the rotational direction of the driving shaft 13) of the roller 22. In other words, the first and second spaces 29*a* and 29*b* can suck, compress and discharge independently. Thus, since the first and second spaces 29*a* and 29*b* are independent from each other, the compression in the first and second spaces 29*a* and 29*b* in each rotational direction of the driving shaft 13 can be adjusted so as to change the compression capacity of the compressor. In other words, the first space 29*a* is configured to compress the fluid in both of the clockwise direction and the counterclockwise direction, whereas the second space 29*b* is configured to compress the fluid in any one of the clockwise direction and the counterclockwise direction of the driving shaft. Accordingly, according to the rotational direction of the driving shaft 13, the compression capacity is varied, so that the vane 300 acts as the predefined compression mechanism of the invention.

In more detail, for the compression of the fluid in bidirections of the driving shaft 13, discharge and suction ports 26*a*, 26*b*, 27*a*, 27*b* to suck and discharge the fluid depending on the rotational direction of the driving shaft 13 are provided in the first space 29*a*.

First, discharge ports 26*a* and 26*b* are formed on the upper bearing 24. The discharge ports 26*a* and 26*b* communicate with the first space 29*a* such that the compressed fluid is discharged. The discharge ports 26*a* and 26*b* can communicate directly with the first space 29*a*, and can communicate with the fluid chamber 29 through a predetermined length of passage 21*d* formed on the cylinder 21 and the upper bearing 24.

As specifically shown in FIG. 32, the inventive compressor includes at least two first and second discharge ports 26*a* and 26*b*. Although the roller 22 revolves any one of the clockwise direction and the counterclockwise direction within the first space 29*a*, it is required that one discharge port should be provided between the suction port and the vane assembly 300 located within the revolution path so as to discharge the compressed fluid. Accordingly, one discharge port is needed every rotational direction (clockwise direction and the counterclockwise direction). For this purpose, the respective first and second discharge ports 26*a* and 26*b* are located so as to discharge the fluid in the corresponding rotational direction. The aforementioned first and second discharge ports 26*a* and 26*b* allow the inventive compressor to discharge the fluid regardless of the revolution direction (i.e., rotational direction of the driving shaft 13) of the roller 22. In other words, in the first space 29*a*, the fluid is discharged from the first discharge port 26*a* while the driving shaft rotates in any one direction (clockwise direction on the drawing) and is discharged from the second discharge port 26*b* while the driving shaft 13 rotates in other directional rotation (counterclockwise direction on the drawing). Also, the discharge ports 26*a* and 26*b* are preferably formed in the vicinity of the vane assembly 300 to discharge the maximum compressed fluid in each rotational direction of the driving shaft 13. In other words, as shown in the drawings, the first discharge port 26*a* is located in the vicinity of the first vane 310 and the second discharge port 26*b* is located in the vicinity of the second vane 320. The discharge ports 26*a* and 26*b* are preferably positioned in the vicinity of the vanes 310 and 320 if possible.

Suction ports 27*a* and 27*b* communicating with the first space 29*a* are formed on the lower bearing 25. The suction ports 27*a* and 27*b* guide the fluid to be compressed to the first space 29*a*. The suction ports 27*a* and 27*b* are connected to the suction pipe 7 so that the fluid outside the compressor can be introduced into the chamber 29. More specifically, the suction pipe 7 is branched into a plurality of auxiliary pipes 7*a* and the auxiliary pipes 7*a* are connected to suction ports 27*a* and 27*b* respectively. If necessary, the discharge ports 26*a* and 26*b* may be formed on the lower bearing 25 and the suction ports 27*a* and 27*b* may be formed on the upper bearing 24.

As shown in detail in FIG. 32, the suction ports 27*a* and 27*b* are positioned properly so that the fluid can be compressed between the discharge ports 26*a* and 26*b* and the roller 22. Actually, the fluid is compressed from any one of the suction ports to any one of the discharge ports positioned in the revolution path of the roller 22. Accordingly, in order to obtain a compression capacity from the first space 29*a* in all rotational directions (clockwise and counterclockwise directions) of the driving shaft 13, at least one suction port for corresponding discharge port in each rotational direction of the driving shaft 13 is requested. To this end, the compression of the present invention has first and second suction ports 27*a* and 27*b* corresponding to two discharge ports 26*a* and 26*b* respectively and for sucking the fluid into the first space 29*a* in a corresponding rotational direction of the driving shaft 13.

Figure 33:
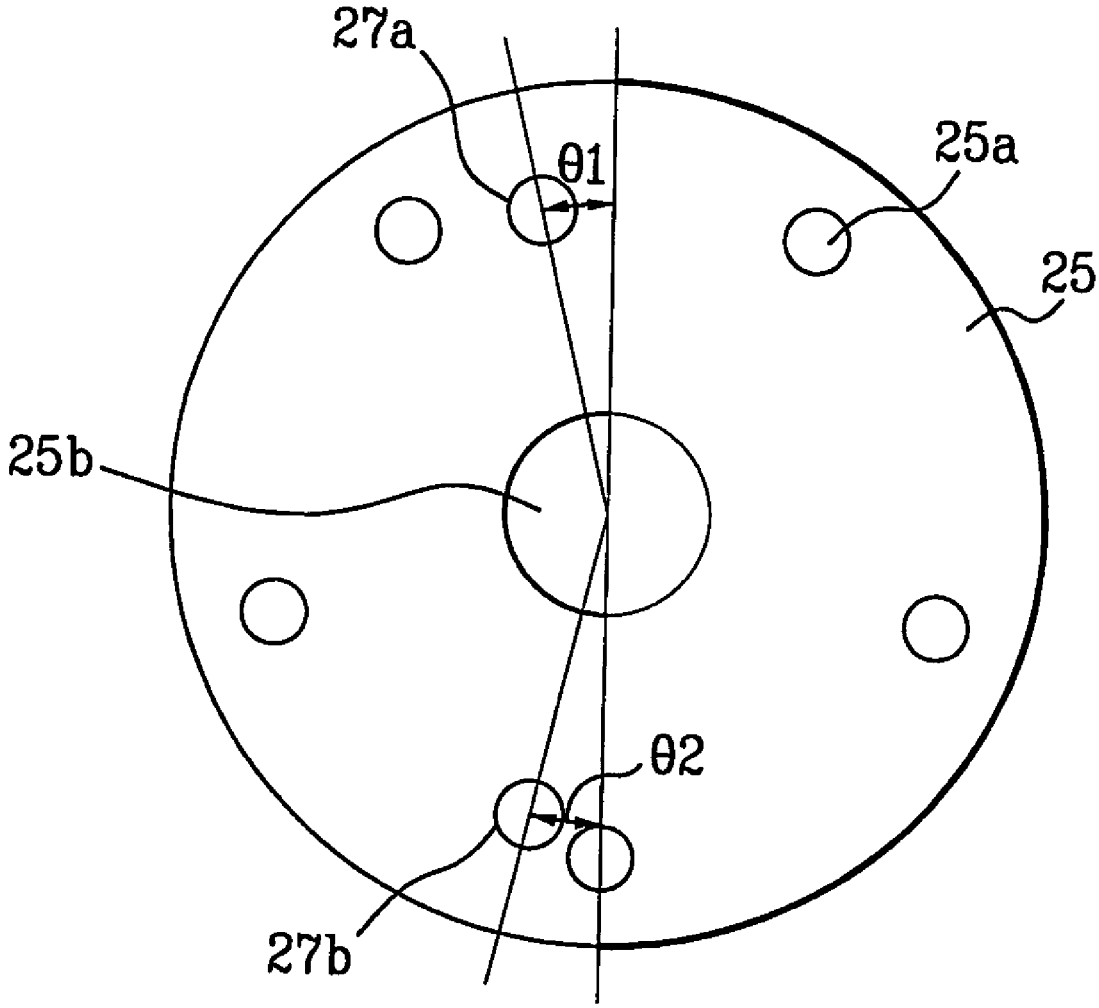
FIG. 33 is a plan view illustrating a lower bearing of the rotary compressor according to a third embodiment of the present invention.

Also, as described above, since the fluid is compressed between the suction port and the discharge port that are operably linked while the driving shaft 13 rotates in any one direction, relative position of the suction port to the corresponding discharge port determines the compression capacity. In other words, once the position of the discharge valve is determined, the position of the suction port determines the compression capacity. Accordingly, in order to secure a compression capacity as large as possible in each directional rotation of the driving shaft 13, it is preferable that the first and second suction ports 26*a* and 26*b* are located in the vicinity of the vane assembly 300. In other words, as shown in the drawings, like the discharge ports 26*a* and 26*b*, the suction ports 27*a* and 27*b* are respectively located in the vicinity of the first and second vanes 310 and 320. In more detail, as shown in FIGS. 32 and 33, the first suction port 27*a* is actually spaced apart by an angle θ1 of 10° clockwise or counterclockwise from the first vane 310. In the drawings of the present invention, there is shown the first suction port 27*a* spaced apart by the angle θ1 counterclockwise. Similarly to the first suction port 27*a*, the second suction port 27*b* is spaced apart by an angle θ1 of 10° clockwise or counterclockwise from the second vane 320. The second suction port 27*b* is located communicating with the first space 29*a*, i.e., spaced apart from the second vane 320 clockwise on the drawings such that the fluid is compressed in all rotational directions in the first space 29*a*. These suction ports are generally a circular shape and preferably have a diameter 6-15 mm. In order to increase a suction amount of fluid, the suction ports 27*a* and 27*b* can also be provided in several shapes, including a rectangle. Resultantly, the roller 22 compresses the fluid from the first suction port 27*a* to the second discharge port 26*b* in any one directional rotation (counterclockwise direction on the drawing). And, the roller 22 compresses the fluid from the second suction port 27*b* to the first discharge port 26*a* in any other directional rotation (clockwise direction on the drawing). By the aforementioned discharge and suction ports, compression is carried out in the first space 29*a* while the driving shaft 13 rotates bidirectionally. Also, the roller 22 compresses the fluid in the first space 29*a* by using the entire portion of the fluid chamber 29. In other words, refrigerant of an amount corresponding to the entire volume of the fluid chamber 29 can be compressed.

Also, in the second space 29*b*, there are provided discharge and suction ports 26*e* and 27*c* for sucking and discharging the fluid to be compressed only in any one direction of the driving shaft 13.

As shown in FIGS. 30, 31 and 32, the discharge port 26*e* and the suction port 27*c* are respectively formed on the upper bearing 24 and the lower bearing 25 so as to communicate with the second space 29*b*. The discharge port 26*c* can communicate directly with the second space 29*b* or can communicate with the second space 29*b* through a predetermined fluid passage 21*d* formed on the upper bearing 24. The suction port 27*c* can be connected directly with the suction pipe 7 or be connected with one of a plurality of auxiliary pipes 7*a* branched from the suction pipe 7 like the suction ports 27*a* and 27*b*. If necessary, the discharge port 26 may be formed on the lower bearing 25 and the suction port 27*c* may be formed on the upper bearing 24.

As aforementioned, compression capacity in any one directional rotation of the driving shaft 13 in a rotary compressor is obtained between one suction port and one discharge port that are located on the revolution path of the roller 22. Since the second space 29*b* is for compressing the fluid in any one direction of the driving shaft 13, only one suction port and one discharge port that are functionally linked with each other so as to be able to compress the fluid are requested. Owing to the aforementioned reason, in the inventive compressor, the second space 29*b* has a third discharge port 26*e* and a third suction port 27*c*.

As shown in FIG. 32, these third discharge and suction ports 26*e* and 27*c* are spaced apart by a predetermined distance within the second space 29*b* such that the fluid can be compressed therebetween. First, the third discharge port 26*e* is preferably formed in the vicinity of one of the vanes 310 and 320 within the range of the second space 29*b* so as to discharge the fluid compressed to the maximum. In FIG. 32, there is shown the third discharge port 26*e* arranged in the vicinity of the first vane 310 and accordingly the fluid compressed while the driving shaft 13 rotates counterclockwise is discharged. The third discharge port 26*e* is preferably located as close as possible. Also, as aforementioned, once the location of the discharge valve is determined, the location of the suction port determines the compression capacity. Accordingly, in order to secure a compression capacity as large as possible in the second space 29*b*, the third suction port 27*c* is preferably located in the vicinity of any one of the vanes 310 and 320. Here, the third suction port 27*c* should be spaced apart by a predetermined angle from the third discharge port 26*e* for the compression of the fluid. Accordingly, since the third discharge port 26*e* is placed in the vicinity of the first vane 310 in FIG. 32, the third suction port 27*c* is placed in the vicinity of the second vane 320. In more detail, the third suction port 27*c* is substantially spaced apart by an angle θ3 of 10° clockwise or counterclockwise from the second vane 320. In the drawings of the invention, there is shown the first suction port 27*a* spaced apart by the angel θ3 of 10° clockwise or counterclockwise so as to be placed within the second space 29*b*. Like the suction ports 27*a* and 27*b*, this suction port 27*c* is generally a circular shape and preferably has a diameter 6-15 mm. Also, in order to increase a suction amount of fluid, the suction port 27*c* can also be provided in several shapes, including a rectangle. Resultantly, the roller 22 compresses the fluid from the third suction port 27*c* to the third discharge port 26*e* in any one directional rotation (counterclockwise direction on the drawing). On the contrary, since the roller 22 rotates from the third discharge port 26*e* to the third suction port 27*c* in any other directional rotation (clockwise direction on the drawing) of the driving shaft 13, the fluid is not compressed. By the aforementioned discharge and suction ports, compression is carried out in the second space 29*b* while the driving shaft 13 rotates only in any one direction. However, since the suction and discharge ports 27*c* and 26*e* are placed in the vicinity of the vanes 310 and 320, the roller 22 compresses the fluid by using the entire portion of the second space 29*b* while the driving shaft 13 rotates only in any one direction. In other words, refrigerant of an amount corresponding to the entire volume of the second space 29*b* can be compressed.

Consequently, in the third embodiment, the suction and discharge ports selectively supply the first and second spaces 29*a* and 29*b* with fluid and discharge the fluid from the first and second spaces 29*a* and 29*b* such that each of compressions in the first and second spaces 29*a* and 29*b* is independently performed depending on the rotational direction of the driving shaft 13. Accordingly, the suction and discharge ports substantially and auxiliary assist the function of the vane assembly 300 that is the compression mechanism.

Figure 34A:
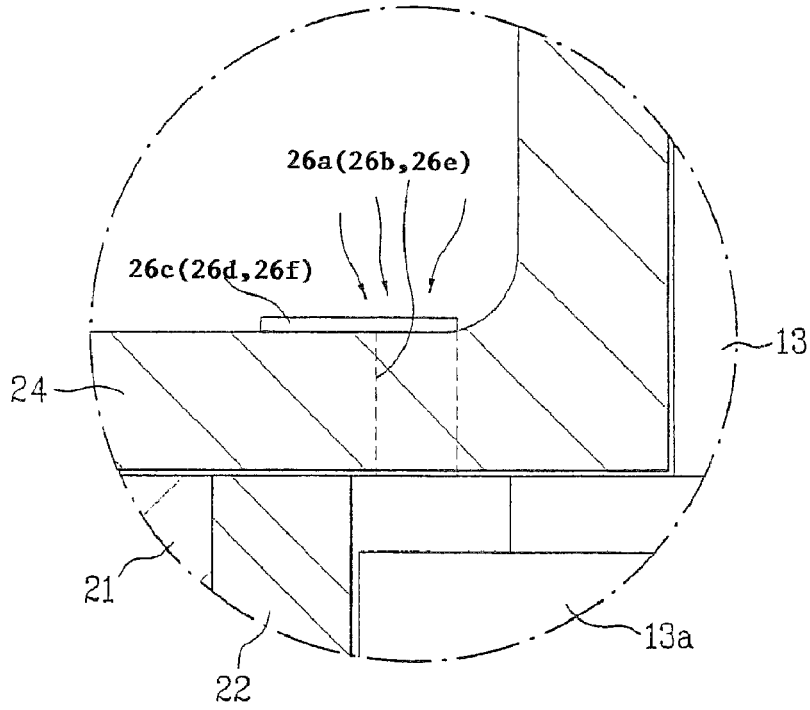
FIGS. 34A and 34B are sectional views illustrating operation of discharge valves of a rotary compressor according to a third embodiment of the present invention.
Figure 34B:
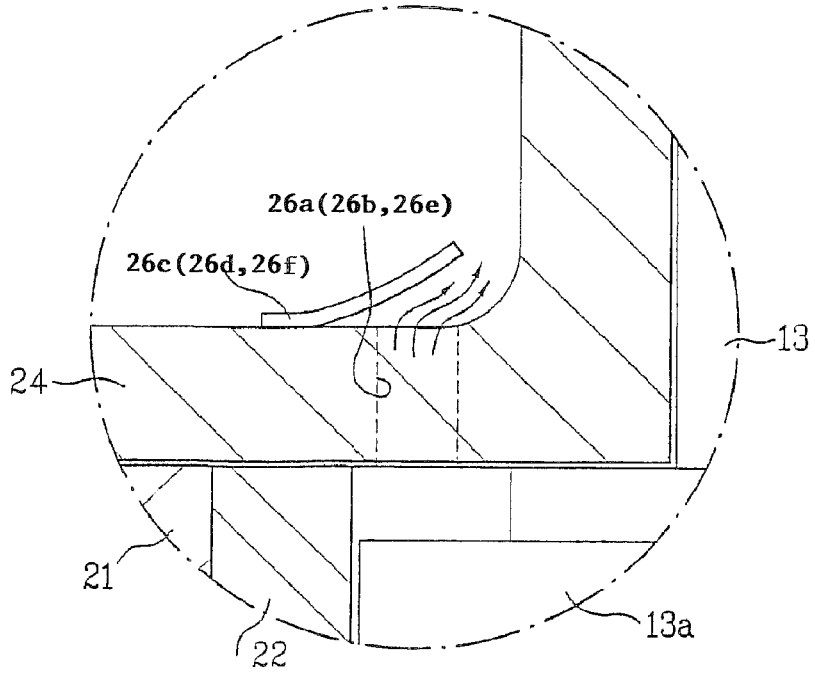

In order to open and close these discharge ports 26*a*, 26*b* and 26*e*, discharge valves 26*c*, 26*d* and 26*f* are installed on the upper bearing 24 as shown in FIGS. 30 and 31. The first discharge valve 26*c* opens and closes the first discharge port 26*a*, the second discharge valve 26*d* opens and closes the second discharge port 26*b*, and the third discharge valve 26*f* opens and closes the third discharge port 26*e*, respectively. FIGS. 34A and 34B are sectional views illustrating operations of these discharge valves 26*c*, 26*d* and 26*f*. The discharge valves 26*c*, 26*d* and 26*f* are configured to open the discharge ports 26*a*, 26*b* and 26*e* when a positive pressure which is greater than or equal to a predetermined pressure is generated in the inside of the cylinder 21. To achieve this, it is desirable that the discharge valves 26*c*, 26*d* and 26*f* are a check valve allowing only a flow of fluid to the outside of the cylinder 21. Also, the discharge valves 26*c*, 26*d* and 26*f* may be a plate valve of which one end is fixed in the vicinity of the discharge ports 26*a*, 26*b* and 26*e* and the other end can be deformed freely. Then, in case a relatively high pressure is generated outside the cylinder 21, the discharge valves 26*c*, 26*d* and 26*f* functioning as a plate valve are installed to be confined by the upper bearing 24. In more detail, as shown in FIG. 34A, if a negative pressure is generated inside the first space 29*a* or the second space 29*b*, the discharge valves 26*c*, 26*d* and 26*f* are deformed toward the cylinder 21 due to the pressure (atmospheric pressure) outside the cylinder 21 that is relatively high. However, the discharge valves 26*c*, 26*d* and 26*f* are confined by the upper bearing 24 and are not deformed but are placed closely around the discharge ports 26*a*, 26*b* and 26*e* on its behalf to close the discharge ports 26*a*, 26*b* and 26*e* more firmly. Also, in case a relatively low positive pressure is generated in the cylinder 21, the discharge ports 26*a*, 26*b* and 26*e* continue to be closed by the self-elasticity of the discharge valves. After that, if a positive pressure above a predetermined value, i.e., a positive pressure that is larger than the elasticity of the discharge valves 26*c*, 26*d* and 26*f* is generated, the discharge valves 26*c*, 26*d* and 26*f* are deformed so as to open the discharge ports 26*a*, 26*b* and 26*e* as shown in FIG. 34B. Accordingly, only when the pressures of the first and second spaces 29*a* and 29*b* are above a predetermined positive pressure, the discharge valves 26*c*, 26*d* and 26*f* selectively open the discharge ports 26*a*, 26*b* and 26*e*. Although not shown in the drawings, a retainer for restricting the deformable amount of the valves may be installed on the upper portion of the discharge valves 26*c*, 26*d* and 26*f* so that the valves can operate stably. In addition, a muffler (not shown) may be installed on the upper portion of the upper bearing 24 to reduce a noise generated when the compressed fluid is discharged.

In order to close the suction ports 27*a* and 27*b*, suction valves 27*d* and 27*e* are installed between the cylinder 21 and the lower bearing 25 as shown in FIGS. 30 and 31. In other words, the first suction valve 27*d* is installed to open and close the first suction port 27*a*, and the second suction valve 27*e* is installed to open and close the second suction port 27*b*. If the suction ports 27*a* and 27*b* are formed on the upper bearing 24, the first and second suction valves 27*d* and 27*e* are installed between the cylinder and the upper bearing 24. In the meanwhile, since the fluid compression does not occur in the second space 29*b* in the other directional rotation (clockwise direction on FIG. 32) of the driving shaft 13, the third suction port 27*c* is not necessarily closed to prevent the fluid from being leaked outside the cylinder 21 during such a rotation. Accordingly, it is preferable for a simple structure that the suction valve such as the first and second suction valves 27*d* and 27*e* are not installed in the third suction port 27*c*. By the same reason, the third suction port 27*c* may be formed to penetrate a sidewall of the cylinder 21 instead of the lower bearing 25 as shown in the drawings.

Basically, so as for the fluid to be sucked into the inside of the cylinder 21, i.e., into the first and second spaces 29*a* and 29*b*, the inner pressure of the cylinder 21 should be lower than the outer pressure (atmospheric pressure) of the cylinder 21. Accordingly, the suction valves 27*d* and 27*e* are configured to open the suction ports 27*a* and 27*b* when a pressure difference between the inside and the outside of the cylinder 21, more precisely, a negative pressure above a predetermined pressure is generated in the cylinder 21. To achieve this, the suction valves 27*d* and 27*e* may be a check valve allowing one directional flow due to a pressure difference, i.e., fluid flow into the inside of the cylinder 21. In the meanwhile, the suction valves 27*d* and 27*e* may be a plate valve similarly with the discharge valves 26*c*, 26*d* and 26*f*. In the invention, the plate valve is preferable since it can perform the same function with more simple and higher response. The suction valves 27*d* and 27*e* are deformable by the external pressure of the cylinder 21 that is relatively high only in case a negative pressure is generated within the cylinder 21. On the contrary, in case a positive pressure is generated inside the cylinder 21, the suction valves 27*d* and 27*e* are confined by the lower bearing 25 so as not to be deformed. Also, the suction valves 27*d* and 27*e* may be provided with a retainer for restricting deformation of the second ends. In the present invention, the retainer may be an independent member, but is preferably simple structured grooves 28 formed in the cylinder 21. The grooves 28 extend with a slope in the length direction of the valves 27*d* and 27*e*, and the valves, more accurately, the second ends are received in the grooves 28 as deformed. Accordingly, the grooves 28 restrict an excessive deformation of the valves 27*d* and 27*e* due to an abrupt pressure variation to thereby allow the valves 27*d* and 27*e* to operate stably.

Figure 35A:
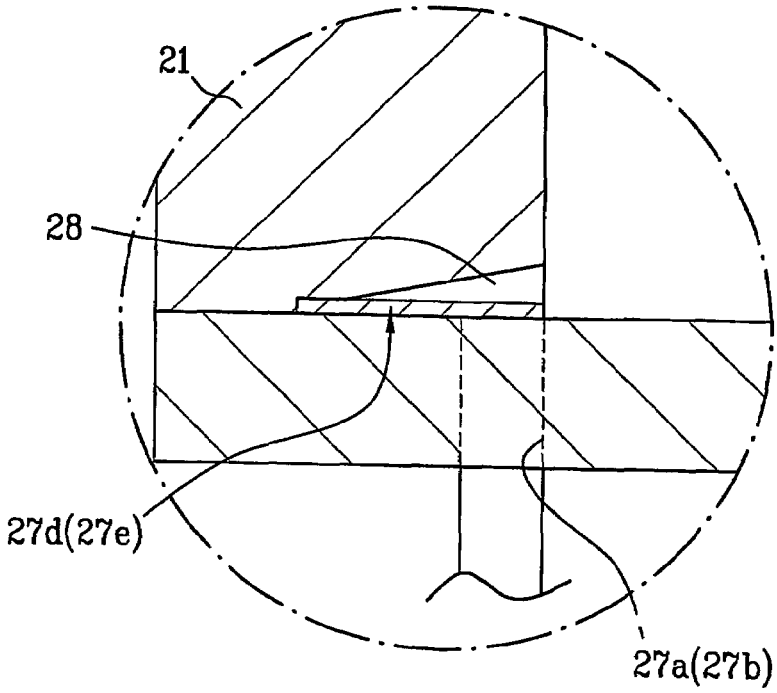
FIGS. 35A and 35B are sectional views illustrating operation of suction valves of a rotary compressor according to a third embodiment of the present invention.
Figure 35B:
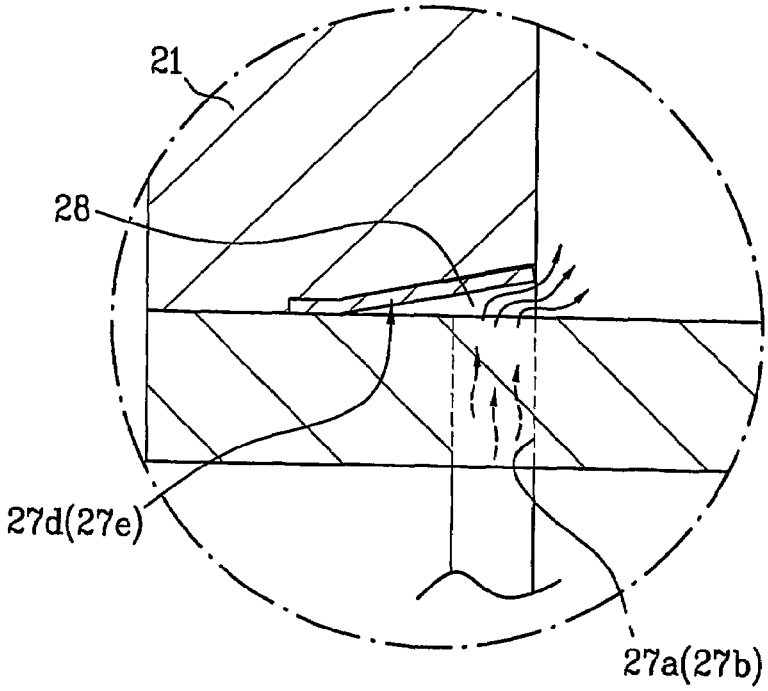

As shown in FIG. 35A, if a positive pressure is generated inside the first space 29*a*, the valves 27*d* and 27*e* are deformed toward the lower bearing 25. However, the valves 27*d* and 27*e* are confined by the upper bearing 24 and are not deformed, but close the suction ports 27*a* and 27*b* more firmly. Also, in case a relatively low negative pressure is generated in the cylinder 21, the suction ports 27*a* and 27*b* continue to be closed by the self-elasticity of the suction valves 27*d* and 27*e*. After that, if a negative pressure above a predetermined value, i.e., a negative pressure that is larger than the elasticity of the valves 27*d* and 27*e* is generated, the valves 27*d* and 27*e* are deformed toward the cylinder 21 as shown in FIG. 35B such that the suction ports 27*a* and 27*b* are opened to suck fluid. Resultantly, the suction valves 27*d* and 27*e* open the suction ports 27*a* and 27*b* by using the negative pressure of the inside of the cylinder 21.

Figure 36:
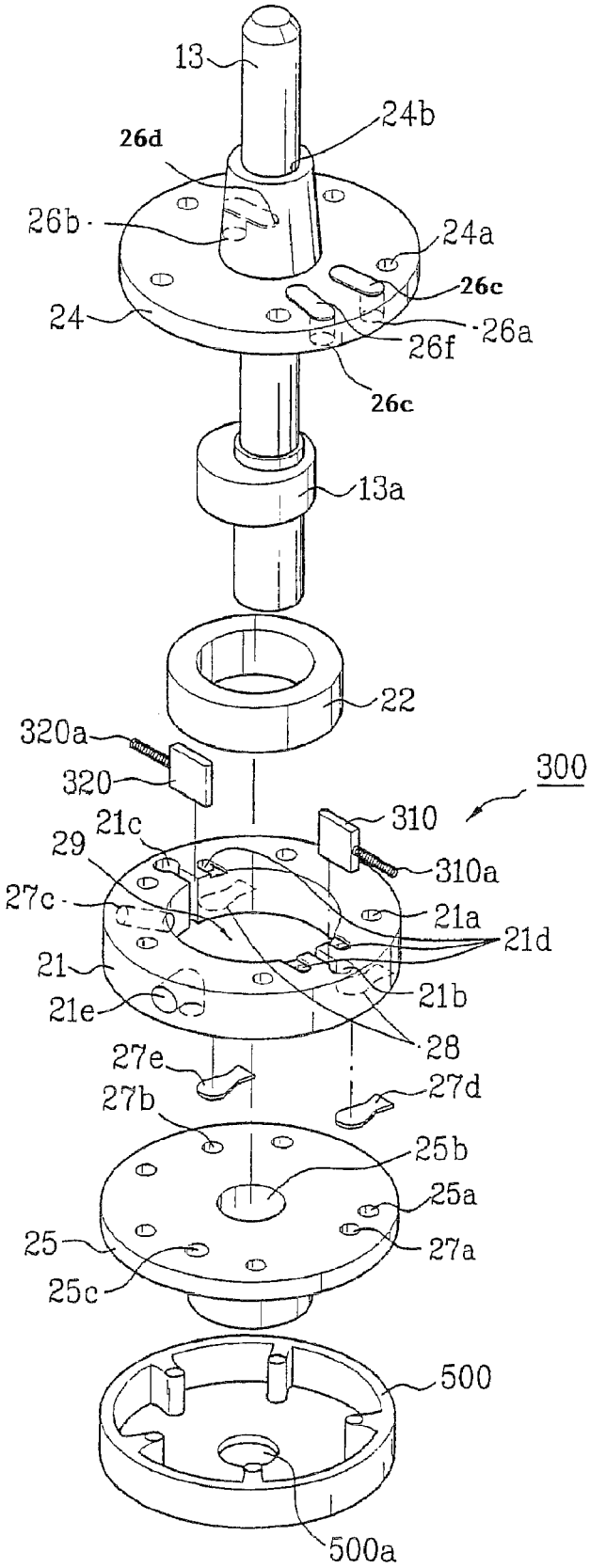
FIG. 36 is an exploded perspective view of a compressing unit of a rotary compressor including a suction plenum according to a third embodiment of the present invention.
Figure 37:
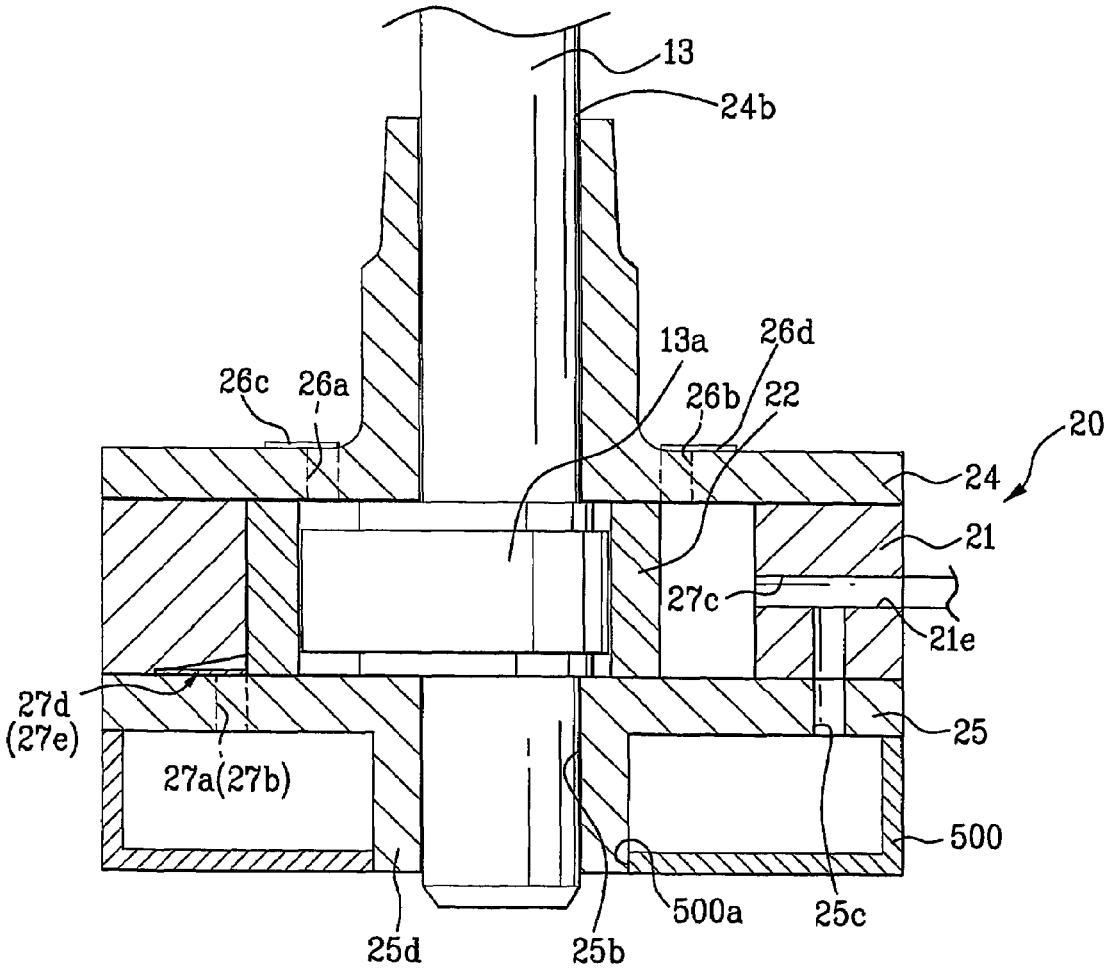
FIG. 37 is a cross-sectional view of the compressing unit shown in FIG. 36.

Meanwhile, as described above with reference to FIGS. 30 and 31, the suction ports 27*a*, 27*b* and 27*c* are individually connected with a plurality of suction pipes 7*a* so as to supply fluid to the fluid chamber 29 inside the cylinder 21. However, the number of parts increases due to these suction pipes 7*a*, thus making the structure complicated. In addition, fluid may not be properly supplied to the cylinder 21 due to a change in a compression state of the suction pipes 7*a* separated during operation. Accordingly, as shown in FIG. 36 and FIG. 37, it is desirable that the compressor includes a suction plenum 500 for preliminarily storing fluid to be sucked by the compressor.

The suction plenum 500 directly communicates with all of the suction ports 27*a* and 27*b* so as to supply the fluid. Accordingly, the suction plenum 500 is installed in a lower portion of the lower bearing 25 in the vicinity of the suction ports 27*a* and 27*b*. Although there is shown in the drawing that the suction ports 27*a* and 27*b* are formed at the lower bearing 25, they can be formed at the upper bearing 24 if necessary. In this case, the suction plenum 500 is installed in the upper bearing 24. The suction plenum 500 can be directly fixed to the bearing 25 by welding. In addition, a coupling member can be used to couple the suction plenum 500 with the cylinder 21, the upper and lower bearings 24 and 25 and the valve assembly 300. In order to lubricate the driving shaft 13, a sleeve 25*d* of the lower bearing 25 should be soaked into a lubricant which is stored in a lower portion of the case 1. Accordingly, the suction plenum 500 includes a penetration hole 500*a* for the sleeve so that the sleeve 25*d* reach the lubricant through the hole 500*a*. Preferably, the suction plenum 500 has 100-400% a volume as large as the fluid chamber 29 so as to supply the fluid stably. The suction plenum 500 is also connected with the suction pipe 7 so as to store the fluid. In more detail, the suction plenum 500 can be connected with the suction pipe 7 through a predetermined fluid passage. In this case, as shown in FIG. 36, the fluid passage penetrates the cylinder 21 and the lower bearing 25. In other words, the fluid passage includes a suction hole 21*e* of the cylinder 21 and a suction hole 25*c* of the lower bearing. Further, if the third suction port 27*c* is formed in the cylinder 21, this suction port 27*c* may diverge from the suction hole 21*e* so as to communicate with the inner space of the cylinder 21, as shown in FIG. 37. It is preferable that such a suction hole 21*e* is formed near the vane 320 so that the suction port 27*c* diverging therefrom is located near the vane 320. With such suction port 27*c*, the fluid in the suction pipe 7 could be simultaneously provided to the cylinder 21 and the suction plenum 500 through the suction port 27*c* and the suction holes 21*e*/25*c*. Alternatively, the fluid in the suction plenum 500 could be provided to the cylinder 21, serially passing through the suction hole 25*c* and the suction port 27*c*. Therefore, the fluid could be more stably provided with the cylinder 21. Also, such a suction port 27*c* is advantageous, as it simplifies the structure of the compressor of the present invention and does not reduce the strength of the cylinder 21.

The suction plenum 500 as described above, forms a space in which a predetermined amount of fluid is always stored, so that a pressure variation of the sucked fluid is buffered to stably supply the fluid to the suction ports 27*a*, 27*b* and 27*c*. In addition, the suction plenum 500 can accommodate oil extracted from the stored fluid (for example, the lubricant included in the fluid) and thus assist or substitute for the accumulator 8.

Hereinafter, operation of a rotary compressor according to a third embodiment of the present invention will be described in more detail.

FIGS. 38A to 38D are cross-sectional views sequentially illustrating insides of the cylinder when the roller revolves in the counterclockwise direction in the rotary compressors according to a third embodiment of the present invention.

Figure 38A:
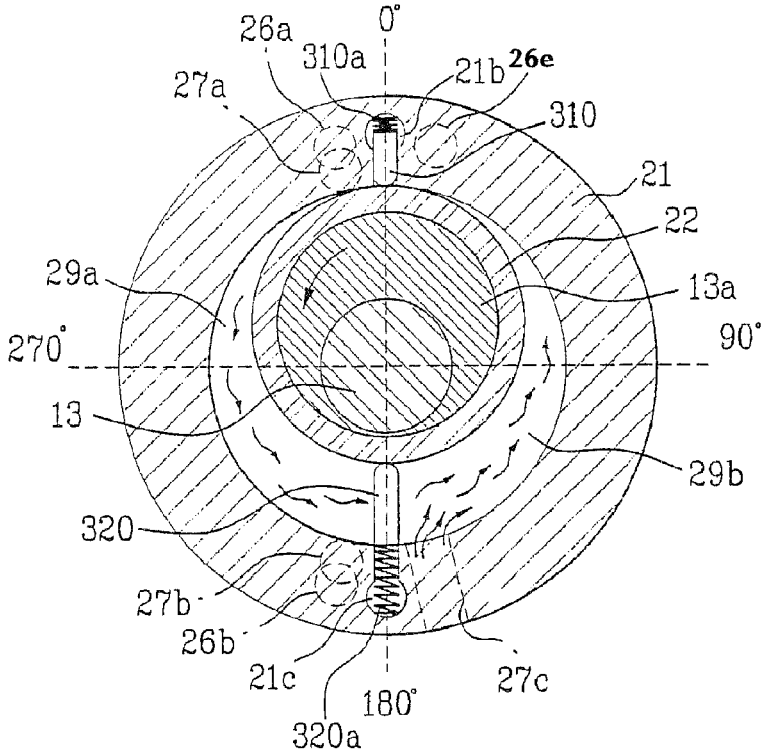
FIGS. 38A to 38D are cross-sectional views sequentially illustrating insides of the cylinder when the roller revolves in the counterclockwise direction in the rotary compressors according to a third embodiment of the present invention.

First, in FIG. 38A, there are shown states of respective elements inside the cylinder when the driving shaft 13 begins to rotate in the counterclockwise direction. Since there is no pressure variation in the cylinder 21, the suction and discharge ports are closed by the respective valves. Since operations of the respective valves in the counterclockwise rotation have been described with reference to FIGS. 34A to 35B in the above, its detailed description will be omitted.

Figure 38B:
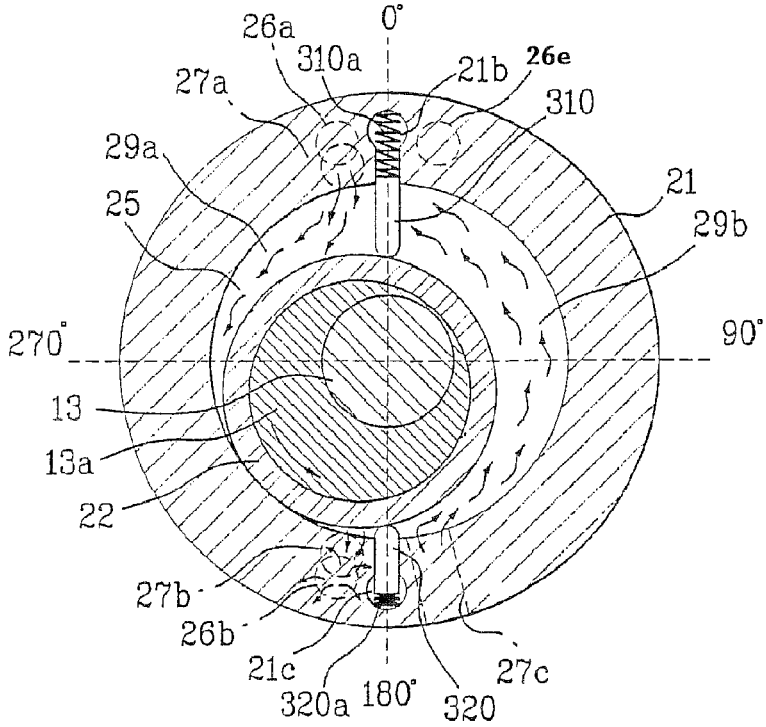

The roller 22 revolves counterclockwise with performing a rolling motion along the inner circumference of the cylinder 21 due to the rotation of the driving shaft 13. As the roller 22 continues to revolve, the size of the space 29*b* is reduced as shown in FIG. 38B and thus the fluid that has been sucked is compressed. Due to the compression, a positive pressure is generated in the space 29*b* around the second discharge and suction ports 26*b* and 27*b* and accordingly the second suction port 27*b* is more firmly closed. At the same time, as a negative pressure is generated in the space 29*a* around the first discharge and suction ports 26*a* and 27*a*, the first suction port 27*a* is opened and the first discharge port 26*a* is closed. New fluid continues to be sucked into the space 29*a* through the first suction port 27*a* so as to be compressed in a next stroke.

When the fluid pressure in the space 29*a* is above a predetermined value, the second discharge port 26*b* is opened and as shown in FIG. 38B, the fluid is discharged through the second discharge port 26*b*. After the fluid is completely discharged, the second discharge valve 26*d* closes the second discharge port 26*b* by its self-elasticity.

Figure 38C:
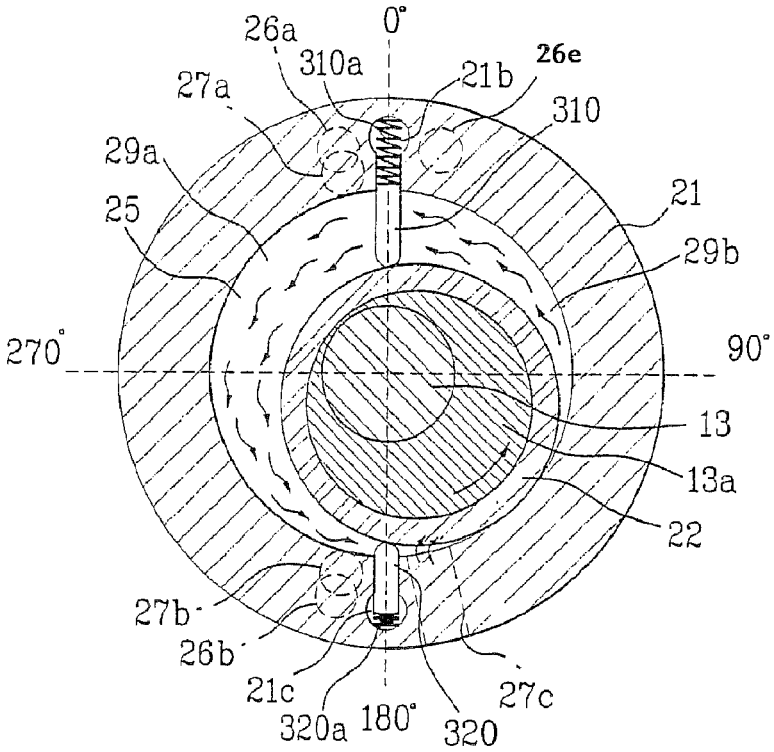

As the roller 22 continues to revolve, the size of the space 29*b* is reduced as shown in FIG. 38C and thus the fluid that has been sucked into the second space 29*b* begins to be compressed. Due to the compression, a positive pressure is generated in the second space 29*b* around the third discharge port 26*e*. At the same time, as a negative pressure is generated in the second space 29*b* around the third suction port 27*c*, new fluid continues to be sucked into the second space 29*b* through the opened third suction port so as to be compressed in a next stroke.

Figure 38D:
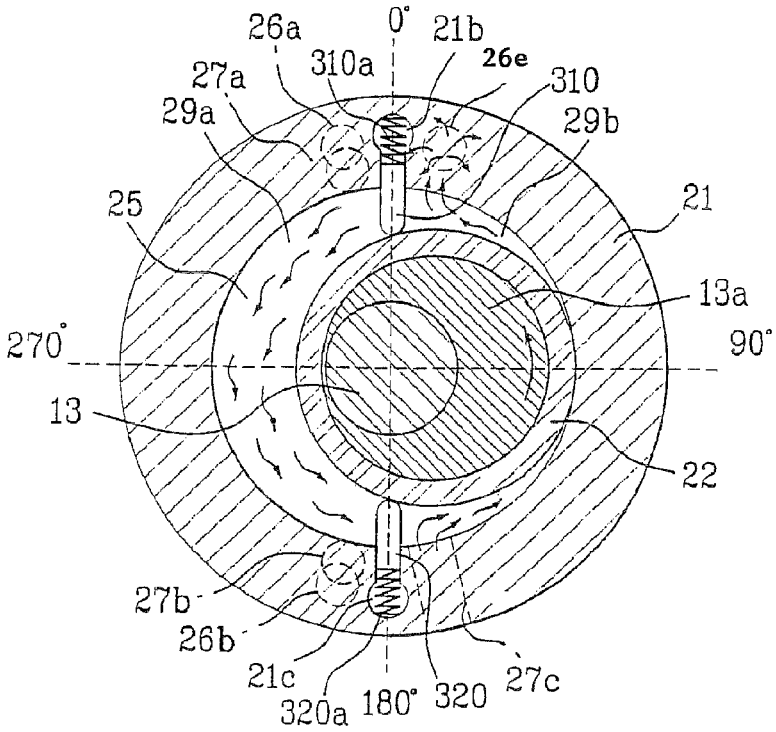

When the fluid pressure in the space 29*b* is above a predetermined value, the third discharge port 26*e* is opened and as shown in FIG. 38D, the fluid is discharged through the third discharge port 26*e*. As the roller 22 continues to revolve, all the fluid in the space 29*b* is discharged through the third discharge port 26*e*. After the fluid is completely discharged, the third discharge valve 26*f* closes the third discharge port 26*e* by its self-elasticity. In the series of steps, the first and second vanes 310 and 320 moves up and down elastically by the elastic members 310*a* and 320*a* to thereby partition the fluid chamber 29 into the two sealed spaces 29*a* and 29*b*. Accordingly, the suction and compression of the fluid in the first and second spaces 29*a* and 29*b* are performed independently.

Thus, after a single stroke is ended, the roller 22 continues to revolve counterclockwise and discharges the fluid by repeating the same stroke. In the counterclockwise stroke, the roller 22 compresses the fluid with revolving from the first suction port 27*a* to the second discharge port 26*b* in the first space 29*a*. In the second space 29*b*, the roller 22 compresses the fluid with revolving from the third suction port 27*c* to the third discharge port 26*e*. Also, as aforementioned, the first and third suction ports 27*a* and 27*c* and the second and third discharge ports 26*b* and 26*e* are positioned in the vicinity of the corresponding vanes 310 and 320. Accordingly, the fluid is substantially compressed using the overall volume of the fluid chamber 29 in the counterclockwise stroke and thus a maximal compression capacity is obtained.

FIGS. 39A to 39D are cross-sectional views sequentially illustrating insides of the cylinder when the roller revolves in the clockwise direction in the rotary compressors according to a third embodiment of the present invention.

Figure 39A:
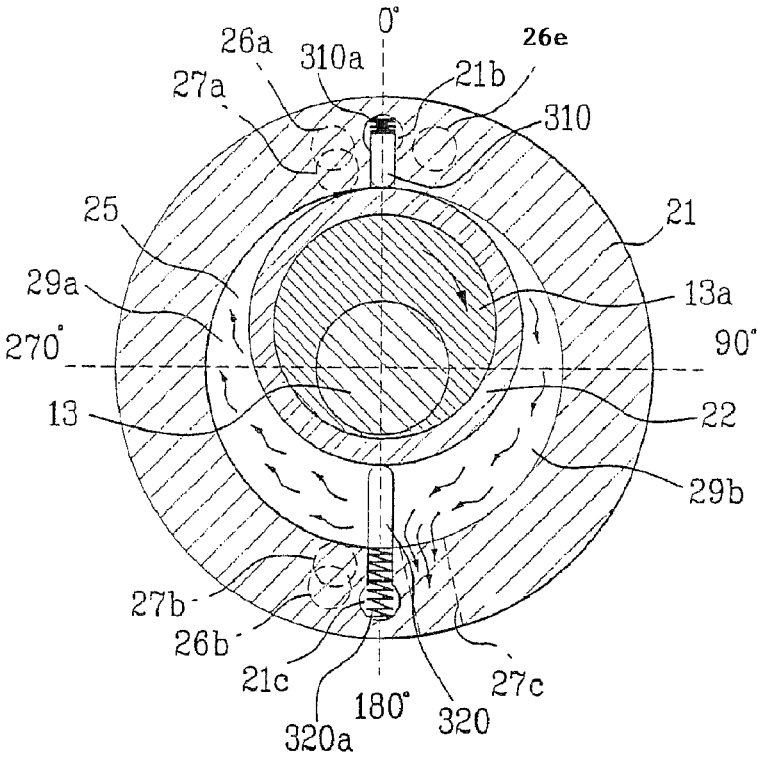
FIGS. 39A to 39D are cross-sectional views sequentially illustrating insides of the cylinder when the roller revolves in the clockwise direction in the rotary compressors according to a third embodiment of the present invention.

First, in FIG. 39A, there are shown states of respective elements inside the cylinder when the driving shaft 13 rotates in the clockwise direction. Since there is no pressure variation in the cylinder 21, the suction and discharge ports are closed by the respective valves as aforementioned. Since operations of the respective valves in the counterclockwise rotation have been described with reference to FIGS. 34A to 35B in the above, its detailed description will be omitted.

Figure 39B:
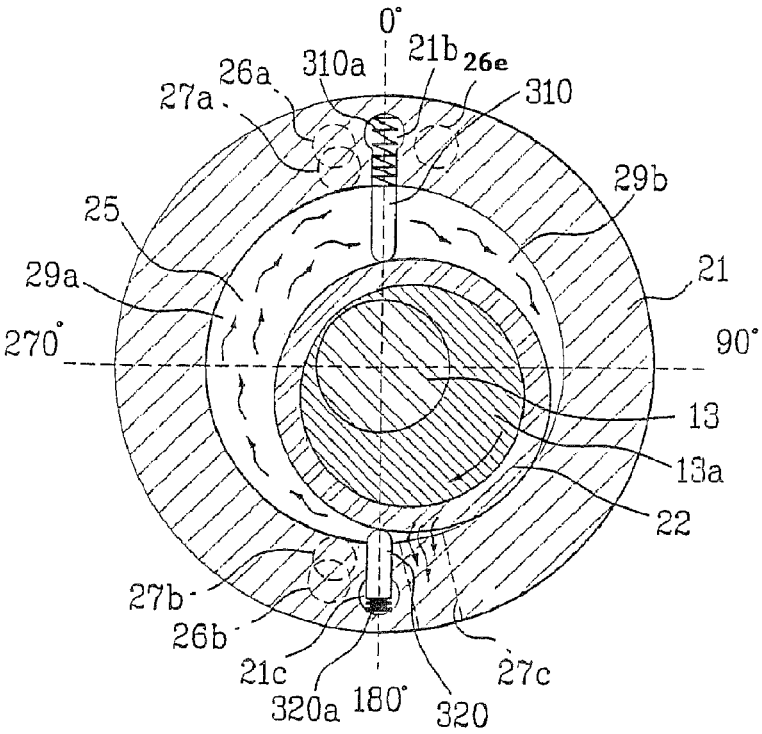

The roller 22 begins to revolve clockwise with performing a rolling motion along the inner circumference of the cylinder 21 due to the rotation of the driving shaft 13. In such a revolution, the fluid that has been sucked into the second space 29*b* is not compressed but is forcibly exhausted outside the cylinder 21 by the roller 22 through the opened second suction port 27*b* as shown in FIG. 39B. Accordingly, the fluid cannot be compressed in the second space 29*b*.

Figure 39C:
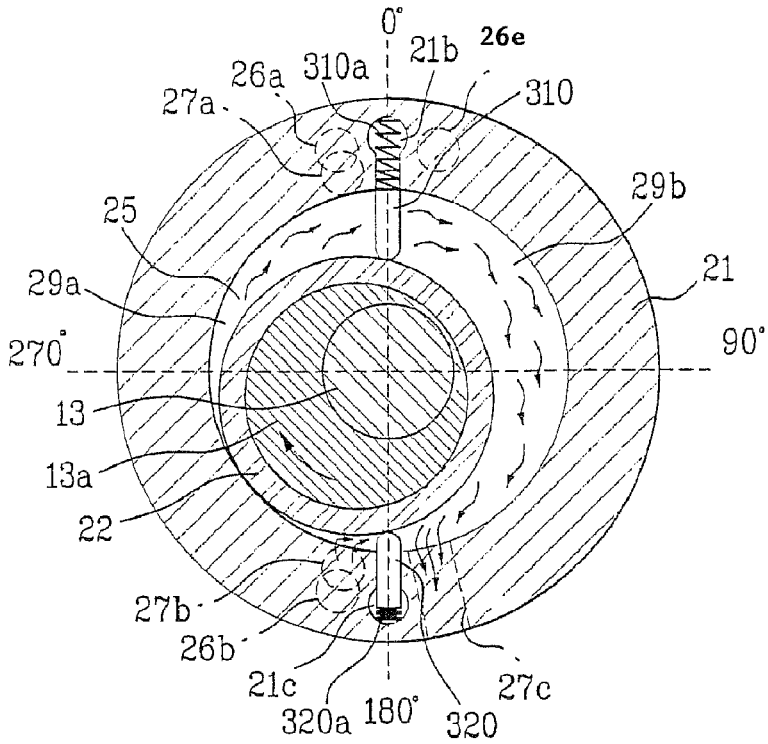

As the roller 22 continues to revolve, the fluid that has been sucked into the first space 29*a* is compressed, as shown in FIG. 39C. Due to the compression, a positive pressure is generated in the first space 29*a* around the first discharge and suction ports 26*a* and 27*a*. Accordingly, the first suction port 27*a* is closed more firmly. At the same time, a negative pressure is generated in the first space 29*a* around the second discharge and suction ports 26*b* and 27*b*, so that the second suction port 27*b* is opened and the second discharge port 26*b* is closed more firmly. New fluid continues to be sucked into the first space 29*a* through the opened second suction port 27*b* so as to be compressed in a next stroke.

Figure 39D:
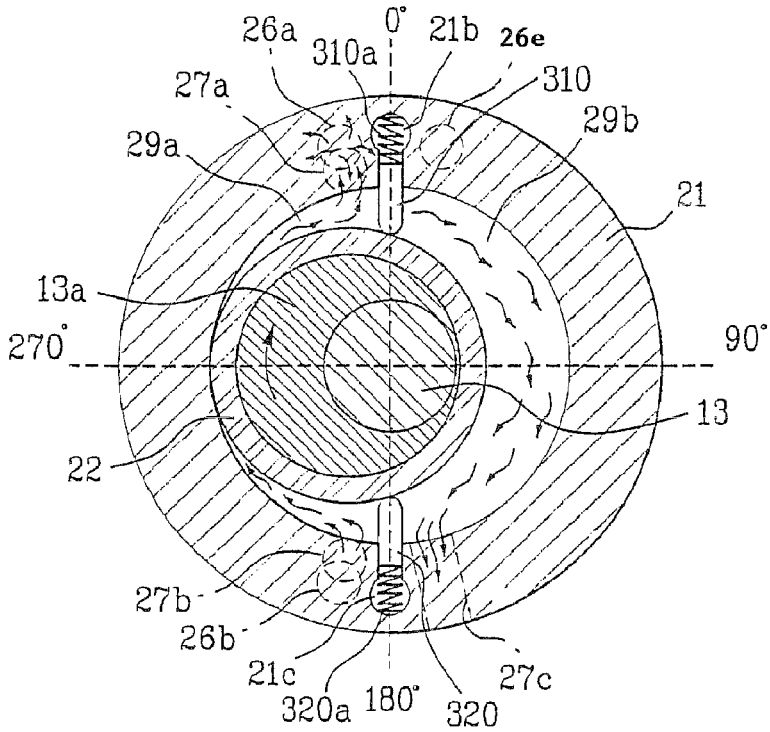
Figure 40:
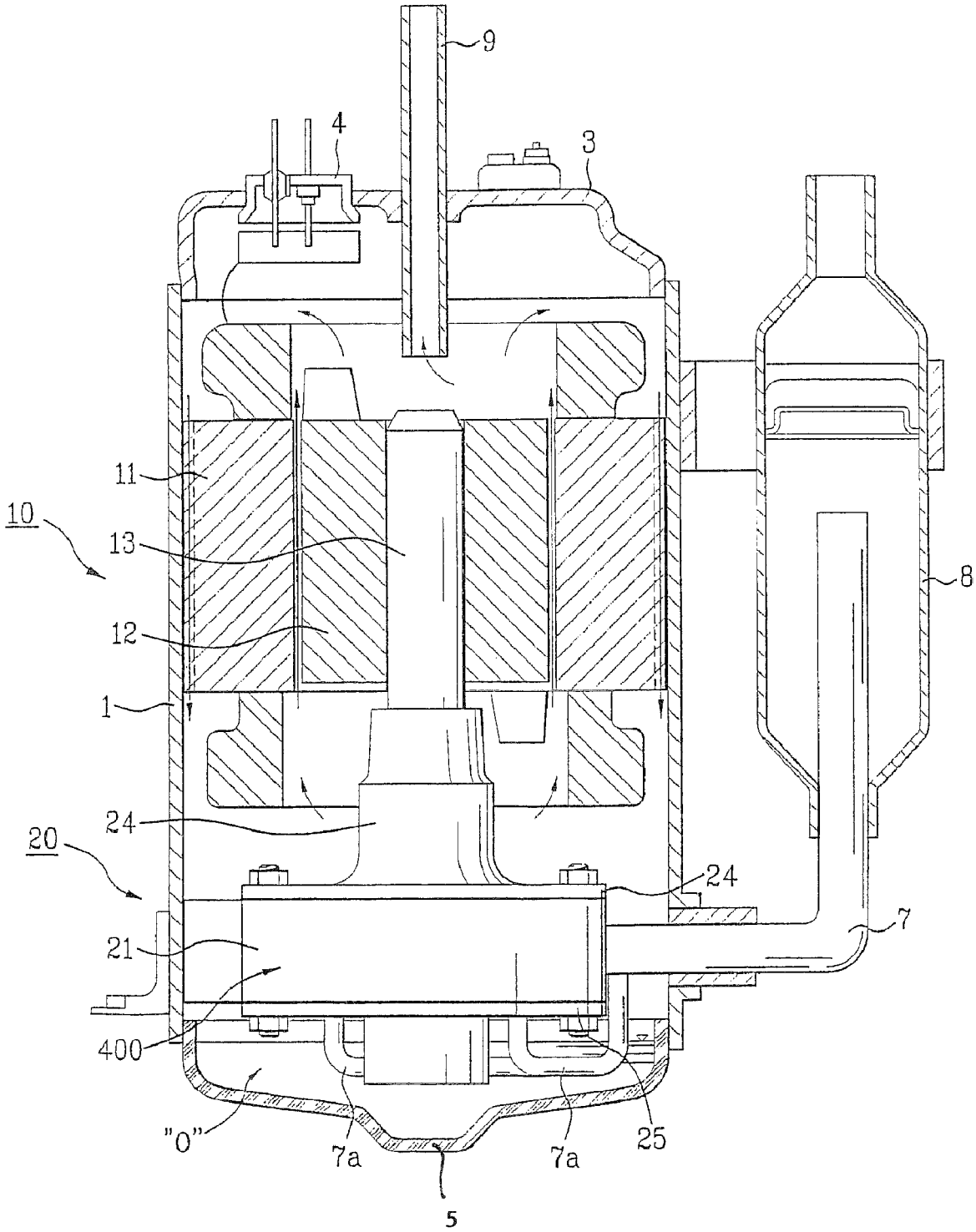
FIG. 40 is a partial longitudinal sectional view illustrating a rotary compressor according to a fourth embodiment of the present invention.

When the fluid pressure in the space 29*b* is above a predetermined value, the first discharge port 26*a* is opened and as shown in FIG. 39D, the fluid is discharged through the first discharge port 26*a*. As the roller 22 continues to revolve, all the fluid in the space 29*a* is discharged through the first discharge port 26*a*. After the fluid is completely discharged, the first discharge valve 26*c* closes the first discharge port 26*a* by its self-elasticity.

In the series of steps, the first and second vanes 310 and 320 moves up and down elastically by the elastic members 310*a* and 320*a* to thereby partition the fluid chamber 29 into the two sealed spaces 29*a* and 29*b*. Accordingly, the suction and compression of the fluid in the first and second spaces 29*a* and 29*b* are performed independently.

Thus, after a single stroke is ended, the roller 22 continues to revolve clockwise and discharges the fluid by repeating the same stroke. In the clockwise stroke, the roller 22 compresses the fluid with revolving from the second suction port 27*b* to the first discharge port 26*a* in the first space 29*a*. On the contrary, the fluid compression in the second space 29*a* does not occur. Accordingly, the fluid is compressed using a part (i.e., first space 29*a*) of the overall fluid chamber 29 in the clockwise stroke, so that a compression capacity that is smaller than that in the clockwise direction is obtained. In the meanwhile, since the second vane 320 is located spaced apart by an angle of 180° so as to face the first vane 310, the sizes of the first space 29*a* and the second space 29*b* are equal to each other. Thus, since the second space 29*b* is used for the compression in the clockwise rotation, the compression capacity in the clockwise direction corresponds to half a compression capacity in the counterclockwise direction. However, as indicated by a dotted line on FIG. 32, if the second vane 320 is spaced apart by a predetermined angle (less than 180°) from the first vane 310 clockwise or counterclockwise along with the second and third suction ports 27*b* and 27*c* and the second discharge port 26*b*, the size of the second space 29*b* increases or decreases. Accordingly, since the compression capacity in the clockwise rotation is in inverse proportional to the size of the second space 29*b*, it becomes small or large. Resultantly, by controlling the relative position of the second vane 320 to the first vane 310, it is possible to adjust the compression capacity in the clockwise direction.

In the aforementioned strokes (i.e., the clockwise stroke and the counterclockwise stroke), the discharged compressive fluid moves upward through the space between the rotor 12 and the stator 11 inside the case 1 and the space between the stator 11 and the case 1. Finally, the compressed fluid is discharged through the discharge pipe 9 out of the compressor.

In the third embodiment described above, the inventive rotary compressor has two vanes partitioning the fluid chamber and suction and discharge ports for selectively sucking and discharging the fluid into the partitioned spaces according to the rotational direction of the driving shaft. Accordingly, although the driving shaft rotates in any one of the counterclockwise direction and clockwise direction, the fluid can be compressed. And, different sizes of compression spaces are formed depending on the rotational direction of the driving shaft such that different compression capacities are obtained in its operation. In particular, any one of the compression capacities is formed using the predesigned entire fluid chamber. In addition, the rotary compressor of the present invention has the plenum for preliminarily storing the fluid such that the fluid could be stably provided to the cylinder.

Fourth Embodiment

Figure 41:
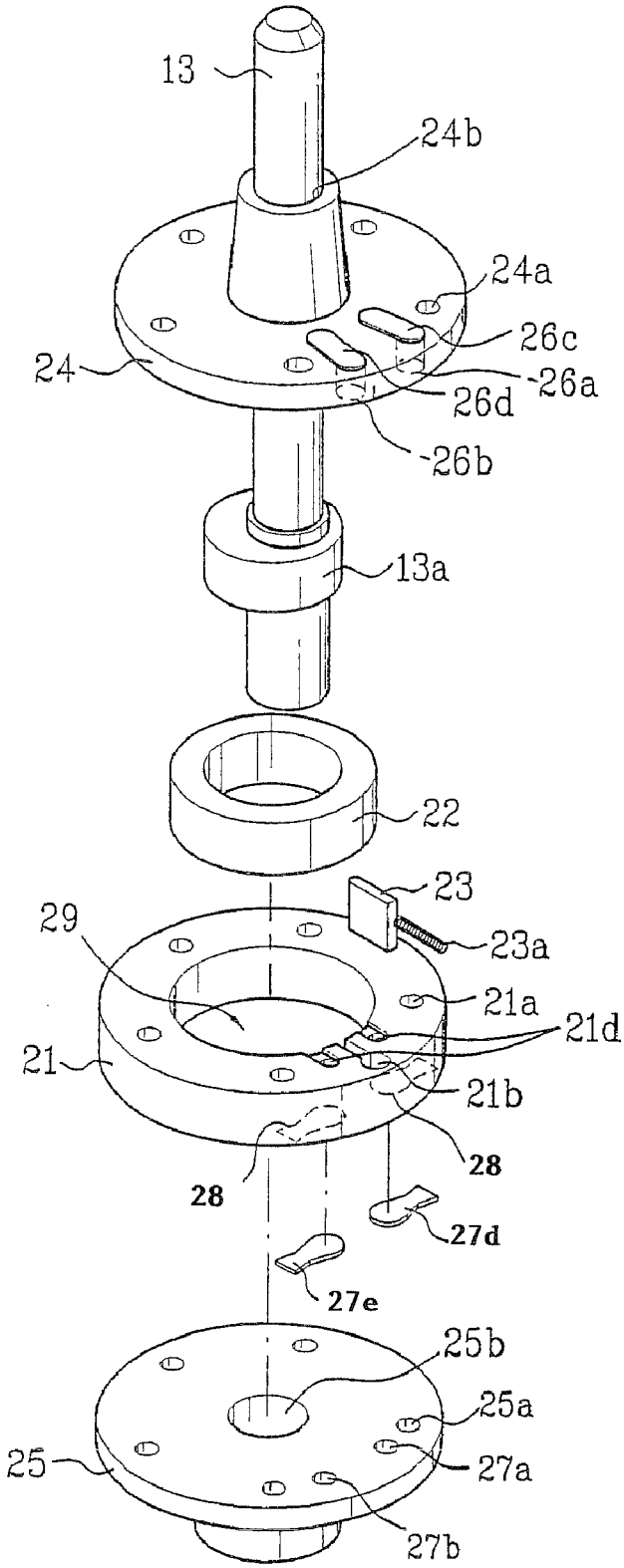
FIG. 41 is an exploded perspective view illustrating the compression unit of the rotary compressor according to a fourth embodiment of the present invention.
Figure 42:
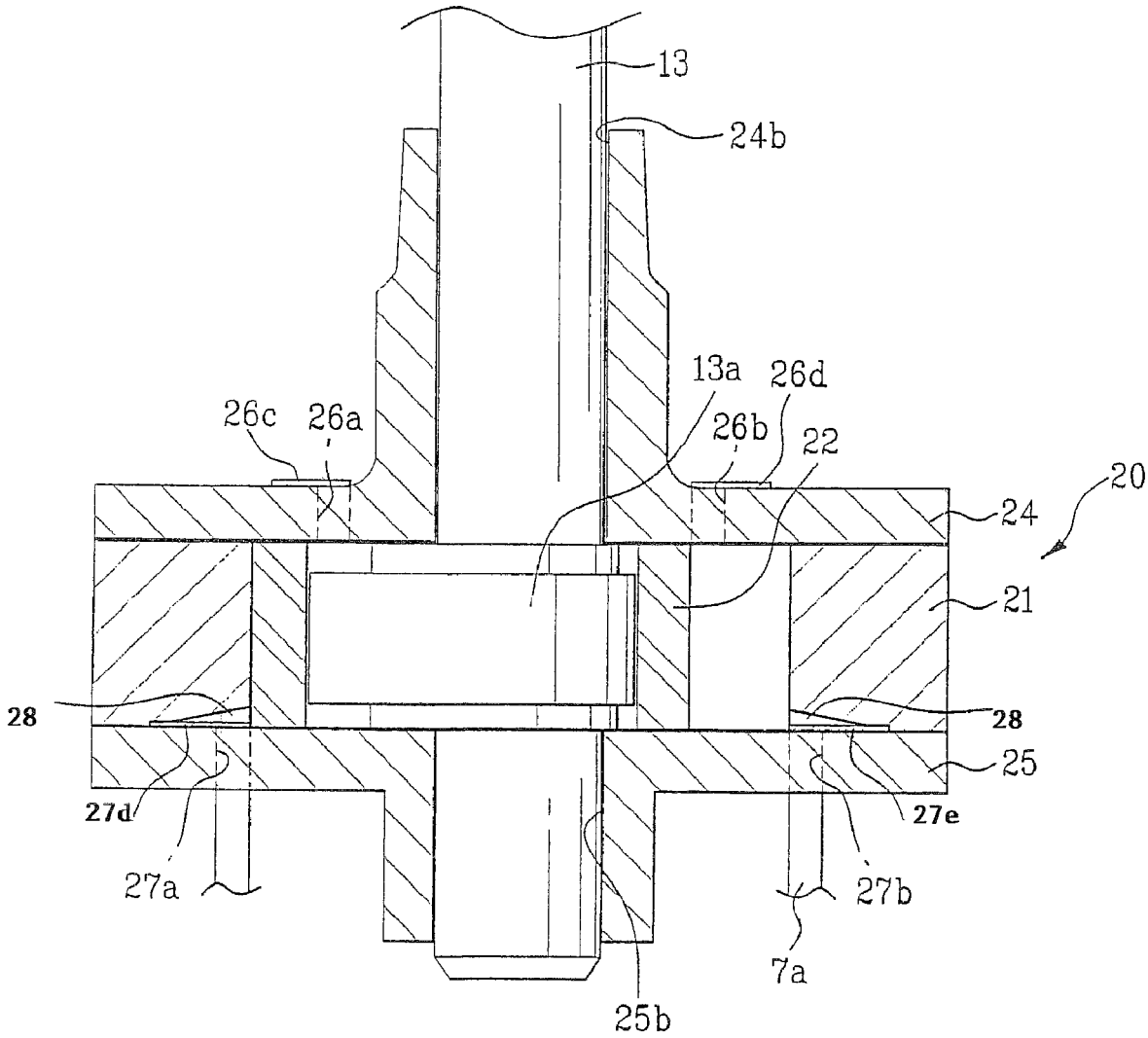
FIG. 42 is a sectional view illustrating the compressing unit according to a fourth embodiment of the present invention.

FIG. 41 is an exploded perspective view illustrating the compression unit of the rotary compressor according to a fourth embodiment of the present invention and FIG. 42 is a sectional view illustrating the compressing unit according to a fourth embodiment of the present invention.

In the fourth embodiment, the cylinder 21 has a predetermined inner volume and a strength enough to endure the pressure of the fluid to be compressed. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* extending by a predetermined depth from its inner circumference. A vane 23 to be described below is installed in the groove 21*b*. The groove 21*b* is long enough to accommodate the vane 23 completely.

Figure 43:
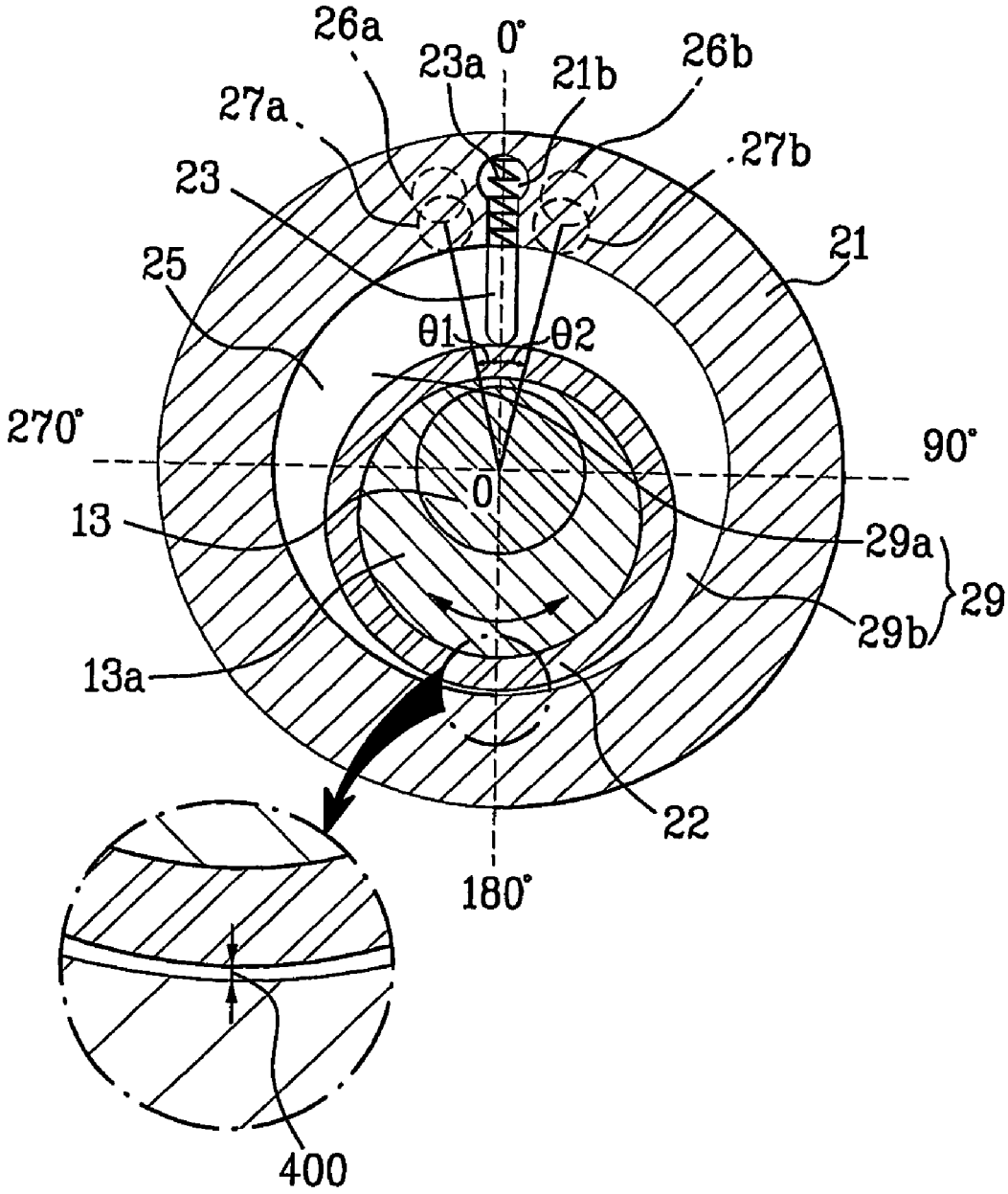
FIG. 43 is a cross-sectional view illustrating the inside of the cylinder according to a fourth embodiment of the present invention.

The roller 22 is a ring member that has an outer diameter less than the inner diameter of the cylinder 21. As shown in FIG. 43, the roller 22 contacts the inner circumference of the cylinder 21 and rotatably coupled with the eccentric portion 13*a*. Accordingly, the roller 22 performs a rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder 21 form a separate fluid chamber 29 in the inner volume. The fluid chamber 29 is used to suck and compress the fluid in the rotary compressor.

The vane 23 is installed in the groove 21*b* of the cylinder 21 as described above. An elastic member 23*a* is installed in the groove 21*b* to elastically support the vane 23. The vane 23 continuously contacts the roller 22. In other words, the elastic member 23*a* has one end fixed to the cylinder 21 and the other end coupled with the vane 23, and pushes the vane 23 to the side of the roller 22. Accordingly, the vane 23 divides the fluid chamber 29 into two separate spaces 29*a* and 29*b* as shown in FIG. 43. While the driving shaft 13 rotates or the roller 22 revolves, the volumes of the spaces 29*a* and 29*b* are changed complementarily. In other words, if the roller 22 rotates clockwise, the space 29*a* gets smaller but the other space 29*b* gets larger. However, the total volume of the spaces 29*a* and 29*b* is constant and approximately same as that of the predetermined fluid chamber 29. One of the spaces 29*a* and 29*b* works as a suction chamber for sucking the fluid and the other one works as a compression chamber for compressing the fluid relatively when the driving shaft 13 rotates in one direction (clockwise or counterclockwise). Accordingly, as described above, the compression chamber of the spaces 29*a* and 29*b* gets smaller to compress the previously sucked fluid and the suction chamber expands to suck the new fluid relatively according to the rotation of the roller 22. If the rotational direction of the roller 22 is reversed, the functions of the spaces 29*a* and 29*b* are exchanged. In the other words, if the roller 22 revolves counterclockwise, the right space 29*b* of the roller 22 becomes a compression space, but if the roller 22 revolves clockwise, the left space 29*a* of the roller 22 becomes the compression space.

The upper bearing 24 and the lower bearing 25 are, as shown in FIG. 41, installed on the upper and lower portions of the cylinder 21 respectively, and rotatably support the driving shaft 12 using a sleeve and the penetrating holes 24*b* and 25*b* formed inside the sleeve. In more detail, the upper bearing 24, the lower bearing 25 and the cylinder 21 include a plurality of coupling holes 24*a*, 25*a* and 21*a* formed to correspond to each other respectively. The cylinder 21, the upper bearing 24 and the lower bearing 25 are coupled with one another to seal the cylinder inner volume, especially the fluid chamber 29 using coupling members such as bolts and nuts.

Discharge ports 26*a* and 26*b* are formed on the upper bearing 24. The discharge ports 26*a* and 26*b* communicate with the fluid chamber 29 such that the compressed fluid can be discharged. The discharge ports 26*a* and 26*b* can communicate directly with the fluid chamber 29 or can communicate with the fluid chamber 29 through a predetermined fluid passage 21*d* formed in the cylinder 21 and the upper bearing 24.

As shown more detail in FIG. 43, the compressor of the present invention includes at least two discharge ports 26*a* and 26*b*. Even if the roller 22 revolves in any direction, a discharge port should exist between the suction port and vane 23 positioned in the revolution path to discharge the compressed fluid. Accordingly, one discharge port is necessary for each rotational direction (clockwise and counterclockwise). To achieve this, the first and second discharge ports 26*a* and 26*b* are positioned to discharge the fluid in the corresponding rotational direction. These first and second discharge ports 26*a* and 26*b* cause the compressor of the present invention to discharge the fluid regardless of the revolution direction of the roller 22 (that is, the rotational direction of the driving shaft 13). In other words, the fluid is discharged from the first discharge port 26*a* when rotating in any one direction (clockwise in the drawing) of the driving shaft 13. Meanwhile, as described above, the compression chamber of the spaces 29*a* and 29*b* gets smaller to compress the fluid as the roller 22 approaches the vane 23. Accordingly, the discharge ports 26*a* and 26*b* are preferably formed facing each other in the vicinity of the vane 23 to discharge the maximum compressed fluid. In other words, as shown in the drawings, the discharge ports 26*a* and 26*b* are positioned on both sides of the vane 23 respectively. The discharge ports 26*a* and 26*b* are preferably positioned in the vicinity of the vane 23 if possible.

Referring to FIGS. 41 and 42 again, the suction ports 27*a* and 27*b* communicating with the fluid chamber 29 are formed on the lower bearing 25. The suction ports 27*a* and 27*b* guide the fluid to be compressed to the fluid chamber 29. The suction ports 27*a* and 27*b* are connected to the suction pipe 7 so that the fluid outside of the compressor can flow into the chamber 29. More particularly, the suction pipe 7 is branched into a plurality of auxiliary pipes 7*a* and the branched auxiliary pipes 7*a* are connected to the suction ports 27 respectively. If necessary, the discharge ports 26*a* and 26*b* may be formed on the lower bearing 25 and the suction ports 27*a* and 27*b* may be formed on the upper bearing 24.

As shown in FIG. 43 in detail, these suction ports 27*a* and 27*b* are positioned properly so that the fluid can be compressed between the discharge ports 26*a* and 26*b* and the roller 22. Actually, the fluid is compressed from a suction port to a discharge port positioned in the revolution path of the roller 22. Accordingly, to obtain compression capacity in all rotational directions (clockwise and counterclockwise) of the driving shaft 13, at least one suction port is required for the corresponding discharge port in each rotational direction of the driving shaft 13. For the same reasons, the compressor of the present invention includes the first and second suction ports 27*a* and 27*b* for sucking the fluid in the corresponding rotational direction of the driving shaft 13 for each of the two discharge ports 26*a* and 26*b*.

As described above, since the fluid is compressed between the suction port and the discharge port functionally connected with each other in rotation of the driving shaft in one direction, the relative position of the suction port for the corresponding discharge port determines the compression capacity. In other words, once the position of the discharge valve is determined, the position of the suction port determines compression capacity. To obtain large compression capacity as possible in the rotation of the driving shaft in each direction, the first and second suction ports 27*a* and 27*b* are preferably positioned in the vicinity of the vane 23. In other words, as shown in drawings, the suction ports 27*a* and 27*b* are positioned on both sides of the vane 23. More particularly, the first suction port 27*a* is actually spaced apart by an angle θ1 of 10° clockwise or counterclockwise from the vane 23 as shown in FIG. 43. The drawings of the present invention illustrates the first suction port 27*a* spaced apart by the angle θ1 counterclockwise. The second suction port 27*b* is spaced apart by an angle θ2 of 10° clockwise or counterclockwise from the vane 23 as the first suction port 27*a*. The second suction port 27*b* is preferably positioned facing the first suction port 27*a* or separated from the vane 23 on drawings clockwise so that the fluid can be compressed for each rotational direction. The suction ports 27*a* and 27*b* are generally circular shapes whose diameters are, preferably, 6-15 mm. In order to increase a suction amount of fluid, the suction ports 27*a* and 27*b* can also be provided in several shapes, including a rectangle. As a result, the roller 22 compresses the fluid from the first suction port 27*a* to the second discharge port 26*b* positioned across the vane 23 in its rotation in one direction (counterclockwise in the drawing). The roller 22 compresses the fluid from the second discharge port 26*b* to the first suction port 27*a* positioned across the vane 23 in its rotation in the other direction (clockwise in the drawing). The roller 22 compresses the fluid due to the first and second suction ports 27*a* and 27*b* by using the overall chamber 29 in rotations of the driving shaft in both directions. In other words, the refrigerant as much as overall volume of the chamber 29 is compressed.

As shown in FIG. 41 and FIG. 42, the discharge valves 26*c* and 26*d* are installed on the upper bearing 24 so as to open and close the discharge ports 26*a* and 26*b*. The discharge valves 26*c* and 26*d* are configured to open the discharge ports 26*a* and 26*b* when a positive pressure which is greater than or equal to a predetermined pressure is generated in the inside of the cylinder 21. To achieve this, it is desirable that the discharge valves 26*c* and 26*d* are plate valves one end of which is fixed in the vicinity of the discharge ports 26*a* and 26*b* and the other end of which can be deformed freely. The discharge valves 26*c* and 26*d* may be check valves allowing fluid flow to the outside of the cylinder 21. When a relatively high pressure is generated outside the cylinder 21 as shown in the drawing, the discharge valves 26*c* and 26*d* are confined to the upper bearing 24 in order not to be deformed. In more detail, as shown in FIG. 42, if a negative pressure is generated inside the chamber 29, the discharge valves 26*c* and 26*d* are deformed toward the cylinder 21 due to the relatively high pressure (atmospheric pressure) outside the cylinder 21. However, the discharge valves 26*c* and 26*d* are confined to the upper bearing 24 and are not deformed but close the discharge ports 26*a* and 26*b* more firmly on its behalf. Also, when a relatively low positive pressure is generated in the cylinder 21, the discharge ports 26*a* and 26*b* continue to be closed by the self-elasticity of the discharge valves 26*c* and 26*d*. After that, if a positive pressure higher than a predetermined value, i.e., the positive pressure that is larger than the elasticity of the discharge ports 26*a* and 26*b* is generated, the discharge valves 26*c* and 26*d* are deformed so as to open the discharge ports 26*a* and 26*b*. Accordingly, only when the pressure of the chamber 29 is higher than a predetermined positive pressure, the discharge valves 26*c* and 26*d* selectively open the discharge ports 26*a* and 26*b*. Although not shown in the drawings, a retainer for limiting the deformable amount may be installed on the upper portion of the discharge valves 26*c* and 26*d* so that the valves can operate stably. In addition, a muffler (not shown) may be installed on the upper portion of the upper bearing 24 to reduce a noise generated when the compressed fluid is discharged.

The first and second suction valves 27*d* and 27*e* are installed between the cylinder 21 and the lower bearing 25 so as to open and close the suction ports 27*a* and 27*b*. If the suction ports 27*a* and 27*b* are formed on the upper bearing 24, the first and second suction valves 27*d* and 27*e* are installed between the cylinder 21 and the upper bearing 24.

Basically, so as for the fluid to be sucked into the inside of the cylinder 21, i.e., into the inside of the fluid chamber 29, the pressure inside the cylinder 21 should be lower than the pressure (atmospheric pressure) outside the cylinder 21. Accordingly, the suction valves 27*d* and 27*e* are configured to open the suction ports 27*a* and 27*b* when a pressure difference between the inside and the outside of the cylinder 21, more precisely, a negative pressure higher than a predetermined pressure is generated in the cylinder 21. To achieve this, the suction valves 27*d* and 27*e* may be check valves allowing one directional flow due to a pressure difference, i.e., fluid flow into the inside of the cylinder 21. In the meanwhile, the suction valves 27*d* and 27*e* may be plate valves similarly with the discharge valves 26*c* and 26*d*. In the present invention, the plate valve is preferable since it can perform the same function with more simple and higher response. The suction valves 27*d* and 27*e* as shown in the drawings have first ends fixed around the suction ports 27*a* and 27*b* and second ends that are freely deformable. The suction valves 27*d* and 27*e* can be deformed due to a relatively high external pressure of the cylinder 21 only when a negative pressure is generated inside the cylinder 21. On the contrary, in case a positive pressure is generated inside the cylinder 21, the suction valves 27*d* and 27*e* are confined to the lower bearing 25 so as not to be deformed. Also, the suction valves 27*d* and 27*e* may be provided with a retainer for restricting deformation of the second ends. In the present invention, the retainer may be an independent member but is preferably simple structured grooves 28 formed in the cylinder 21. The grooves 28 extend with a slope in the length direction of the valves 27*d* and 27*e*, and the valves, more precisely, the second ends are received in the grooves 28 as deformed. Accordingly, the grooves 27*e* and 27*f* restrict an excessive deformation of the valves 27*d* and 27*e* due to an abrupt pressure variation to thereby allow the valves 210 and 220 to operate stably.

In the aforementioned suction valves 27*d* and 27*e*, if a positive pressure is generated in the cylinder 21, the suction valves 27*d* and 27*e* are deformed toward the lower bearing 25. However, the valves 27*d* and 27*e* are confined to the lower bearing 25 and are not deformed, but close the suction ports 27*a* and 27*b* more firmly on its behalf. Also, when a relatively low negative pressure is generated in the cylinder 21, the suction ports 27*a* and 27*b* continue to be closed by the self-elasticity of the suction valves 27*d* and 27*e*. After that, if a negative pressure higher than a predetermined value, i.e., a negative pressure that is larger than the elasticity of the valves 27*d* and 27*e* is generated, the valves 27*d* and 27*e* are deformed toward the cylinder 21 and the suction ports 27*a* and 27*b* are opened to suck the fluid. Accordingly, the suction valves 27*d* and 27*e* selectively open the suction ports 27*a* and 27*b* by using a pressure difference between the inside and the outside of the cylinder 21, that is, a predetermined negative pressure.

Figure 44:
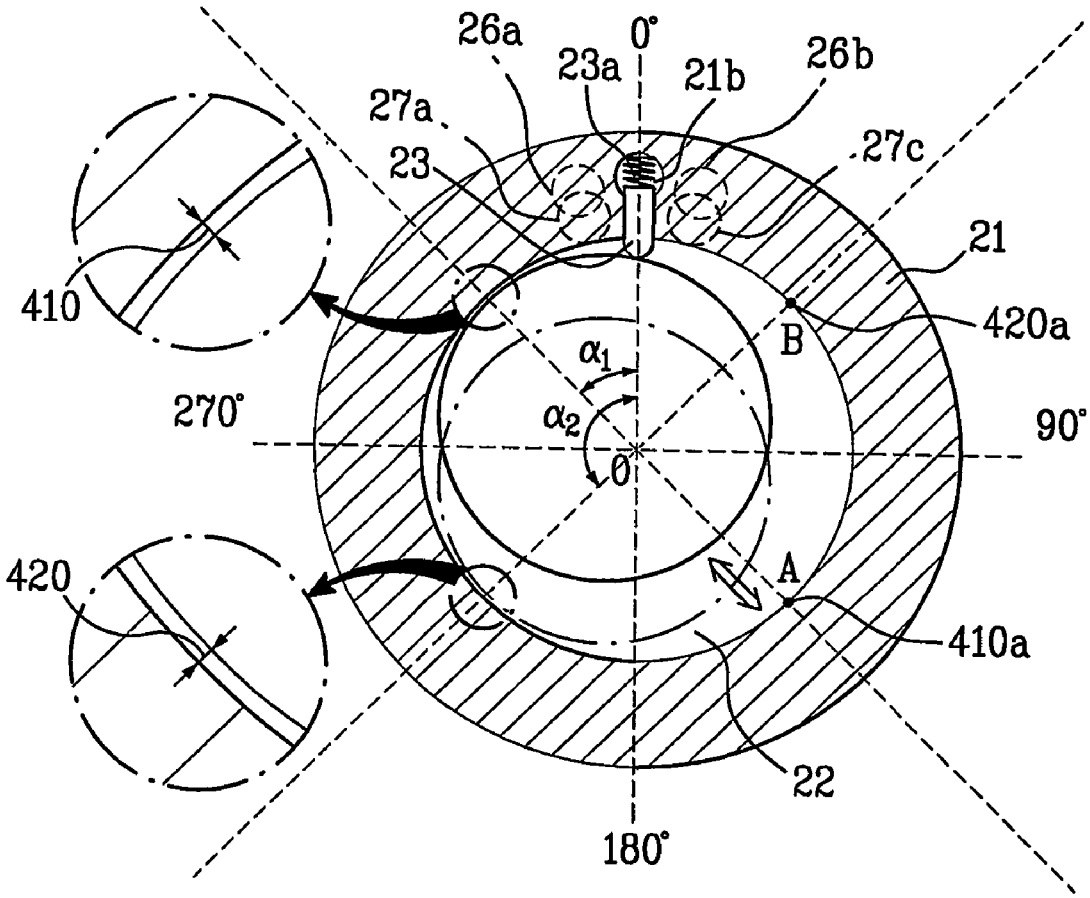
FIG. 44 is a plan view illustrating clearances between the roller and the cylinder in a rotary compressor according to a fourth embodiment of the present invention.

Using the ports and valves, the fluid can be compressed in both clockwise direction and counterclockwise direction of the driving shaft 13 of the compressor of the present invention. However, the same compression capacities are created in the both rotational directions. Accordingly, as shown in FIG. 44, for different compression capacities in each direction, clearances 400 between the inner surface of the cylinder 21 and the roller 22 are formed different from each other according to the rotational direction of the driving shaft. In the present invention, the amounts of the fluid leaked in compression are different from each other according to the rotational direction due to the clearances 400 and accordingly the compression capacities results in getting different from each other. This different leakage amount brings the substantially same results in which compression space is made differently according to the rotational direction in the fluid chamber 29. As a result, the clearances 400 act as the compression mechanism of the present invention previously defined.

As shown in FIG. 43, in the rotary compressor, a predetermined clearance 400 is formed between the roller 22 and cylinder 21 to prevent excessive friction between the inner surfaces of the roller 22 and cylinder 21 in operation. The clearance 400 is continuously varied between the roller 22 and the cylinder 21 so that the fluid is leaked more. It is actually difficult to form a continuous clearance and such a continuous clearance can cause malfunction of the rotary compressor. The clearance 400 is preferably varied when the roller 22 is positioned at a predetermined position of the cylinder 21. More particularly, the clearance 400 of the present invention is a first clearance 410 formed to be comparatively wide at a predetermined position so as for the fluid to be leaked. When the roller 13 contacts a predetermined position of the cylinder 21, the first clearance 410 can adjust to move the driving shaft 13 towards or away from the position (depicted by an arrow mark). As described above, as the roller 22 approaches to the discharge ports 26*a* and 26*b* (that is, vane 23), the fluid is compressed and its pressure gets higher. Accordingly, the first clearance 410 is preferably formed in the vicinity of any one of the discharge ports 26*a* and 26*b* so as to effectively leak the compressed fluid in rotation of the driving shaft 13 in any one direction. Substantially, if the first clearance 410 is spaced apart by an angle $\alpha 1$ in the range of 60°-90° from the vane 23 clockwise or counterclockwise, it is proper to leak the fluid. FIG. 44 shows the first clearance 410 spaced apart by the angle $\alpha 1$ counterclockwise. In addition, the first clearance 410 depends a little on the specification of the compressor and is preferably 90-100 μm.

Meanwhile, since the cylinder 21 has a circular inner circumference, the sum of clearances at the positions facing each other, i.e., the positions spaced apart by 180° from each other is constant. Accordingly, the sum of the first clearance 410 and the first facing clearance 410*a* formed at the position (A) facing the first clearance is also constant. As a result, the first facing clearance 410*a* is formed to be narrow and the first clearance 410 is formed to be large as about five times as the first facing clearance 410*a*. It is preferable that the first facing clearance 410*a* is substantially 20-30 μm. The entire clearance of about 120 μm is formed with the first clearance 410.

In addition, the clearance 400 to assist the first clearance 410 can further a second clearance 420 formed to be comparatively wide. The second clearance 420 is spaced apart by a predetermined angle from the first clearance 410 and actually spaced apart by the angle $\alpha 2$ in the range of 150'-180' from the vane 23. The second clearance 420 depends a little on the specification of the compressor and is preferably 90-100 μm similar to the first clearance. Similarly, the second clearance 420 has the second facing clearance 420*a* formed on the position B facing the second clearance 420 and the characteristics of the second facing clearance 420*a* is substantially the same as the first facing clearance 410*a*. So, the detailed description on the second facing clearance 420*a* will be omitted. Except for these clearances 410, 420, 410*a* and 420*a*, the other clearances are formed to be the same as their facing clearances.

Due to the clearances 410, 420, 410*a* and 420*a*, the clearances 400 vary along the inner circumference of the cylinder 21 and differ from each other at especially the vane 23, that is, around discharge ports 26*a* and 26*b*. More particularly, the clearance 400 is partially wide (clearances 410 and 420) at initial of the counterclockwise rotation of the driving shaft 13 and is partially narrow (clearances 410*a* and 420*a*) at last of the counterclockwise rotation of the driving shaft 13. The clearance 400 is partially narrow (clearances 410*a* and 420*a*) at initial of the clockwise rotation of the driving shaft 13 and is partially wide (clearances 410 and 420) at last of the clockwise rotation of the driving shaft 13. In view of the foregoing reasons, the clearances 400 are resultantly varied depending on the rotational direction of the driving shaft 13.

Figure 45:
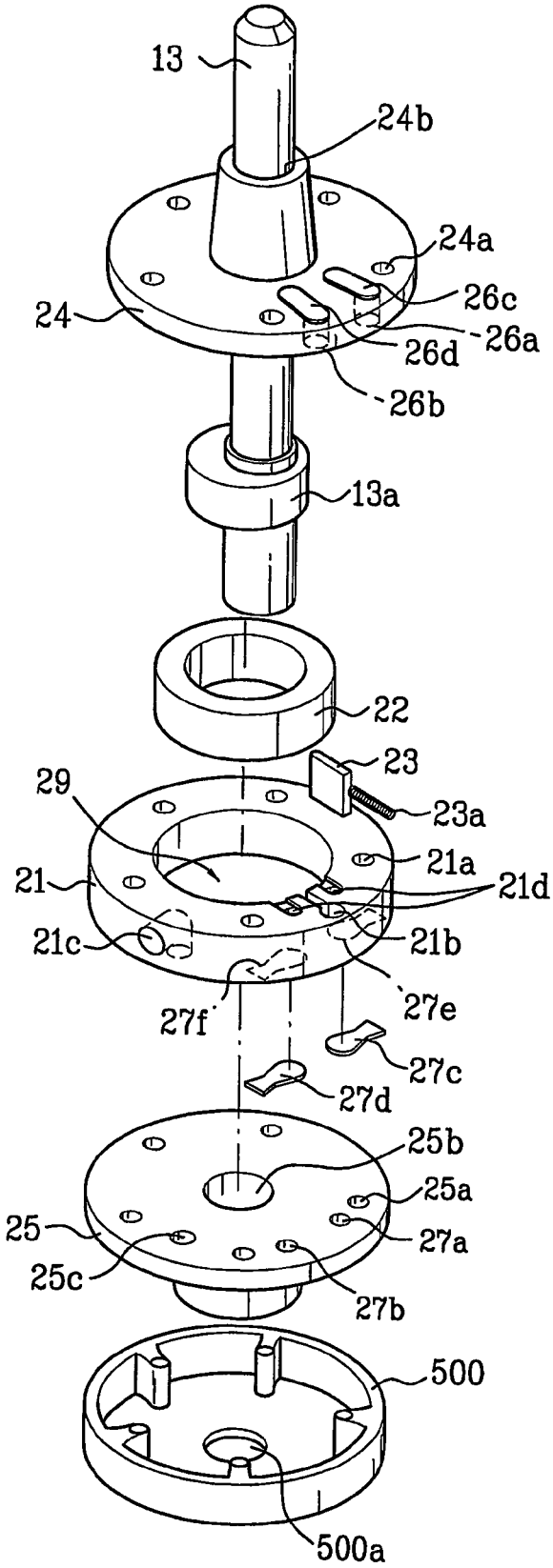
FIG. 45 is an exploded perspective view of a compressing unit of a rotary compressor including a suction plenum according to a fourth embodiment of the present invention.
Figure 46:
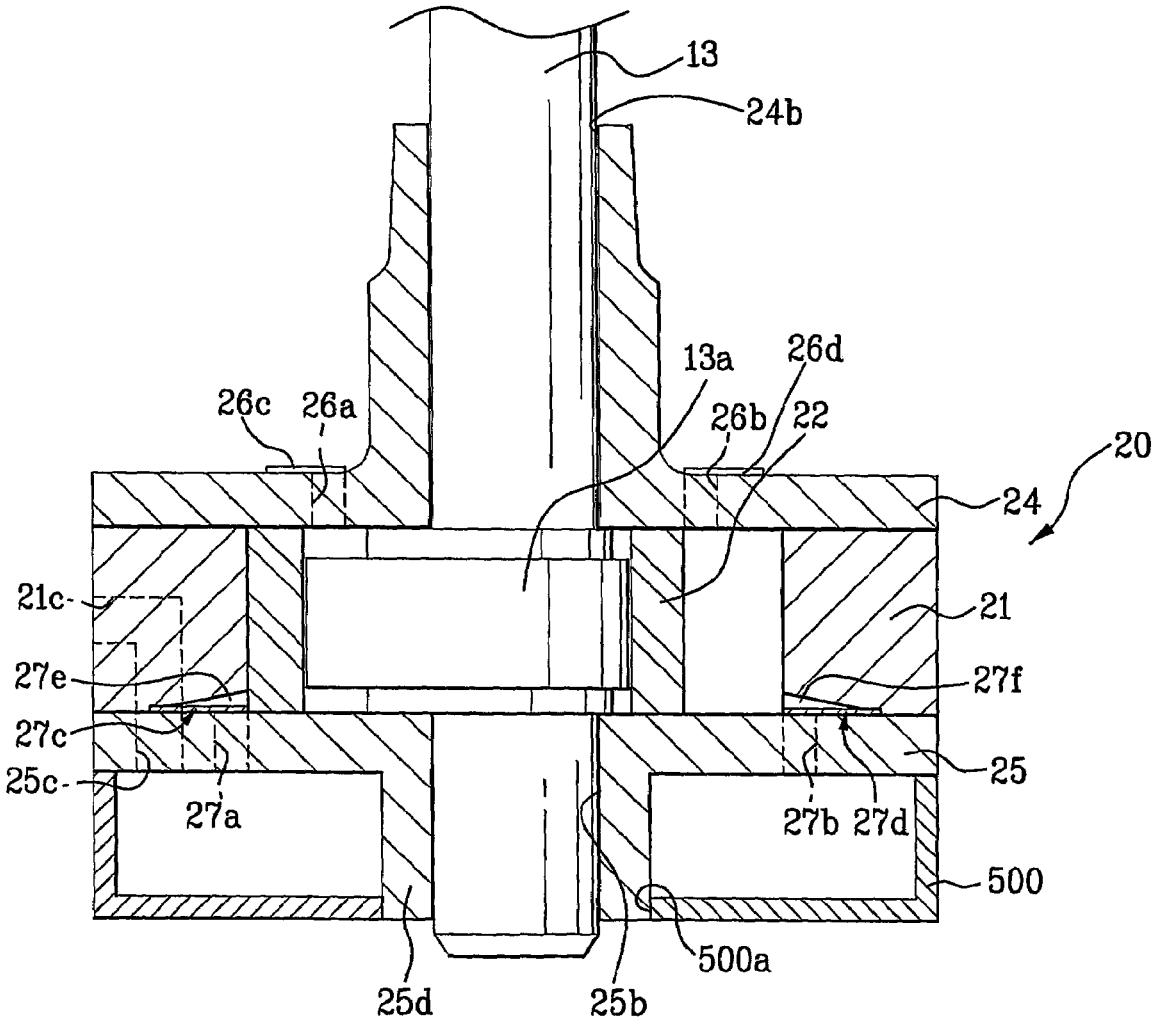
FIG. 46 is a cross-sectional view of the compressing unit shown in FIG. 45.

Meanwhile, as described above with reference to FIGS. 41 and 42, the suction ports 27*a* and 27*b* are individually connected with a plurality of suction pipes 7*a* so as to supply fluid to the fluid chamber 29 inside the cylinder 21. However, these suction pipes 7*a* increase the number of parts, thus making the structure complicated. Also, fluid may not be properly supplied to the cylinder 21 due to a change in a compression state of the suction pipes 7*a* separated during operation. Accordingly, as shown in FIG. 45 and FIG. 46, it is desirable that the compressor includes a suction plenum 500 for preliminarily storing fluid to be sucked by the compressor.

The suction plenum 500 directly communicates with all of the suction ports 27*a* and 27*b* so as to supply the fluid. Accordingly, the suction plenum 500 is installed in a lower portion of the lower bearing 25 in the vicinity of the suction ports 27*a* and 27*b*. Although there is shown in the drawing that the suction ports 27*a* and 27*b* are formed at the lower bearing 25, they can be formed at the upper bearing 24 if necessary. In this case, the suction plenum 500 is installed in the upper bearing 24. The suction plenum 500 can be directly fixed to the bearing 25 by welding. In addition, a coupling member can be used to couple the suction plenum 500 with the cylinder 21, the upper and lower bearings 24 and 25 and the valve assembly 400. In order to lubricate the driving shaft 13, a sleeve 25*d* of the lower bearing 25 should be soaked into a lubricant which is stored in a lower portion of the case 1. Accordingly, the suction plenum 500 includes a penetration hole 500*a* for the sleeve so that the sleeve 25*d* reach the lubricant through the hole 500*a*. Preferably, the suction plenum 500 has 100-400% a volume as large as the fluid chamber 29 so as to supply the fluid stably. The suction plenum 500 is also connected with the suction pipe 7 so as to store the fluid. In more detail, the suction plenum 500 can be connected with the suction pipe 7 through a predetermined fluid passage. In this case, as shown in FIG. 46, the fluid passage penetrates the cylinder 21 and the lower bearing 25. In other words, the fluid passage includes a suction hole 21*c* of the cylinder 21 and a suction hole 25*c* of the lower bearing.

Such a suction plenum 500 forms a space in which a predetermined amount of fluid is always stored, so that a pressure variation of the sucked fluid is buffered to stably supply the fluid to the suction ports 27*a* and 27*b*. In addition, the suction plenum 500 can accommodate oil extracted from the stored fluid (for example, the lubricant included in the fluid) and thus assist or substitute for the accumulator 8.

Hereinafter, operation of a rotary compressor according to a fourth embodiment of the present invention will be described in more detail.

Figure 47A:
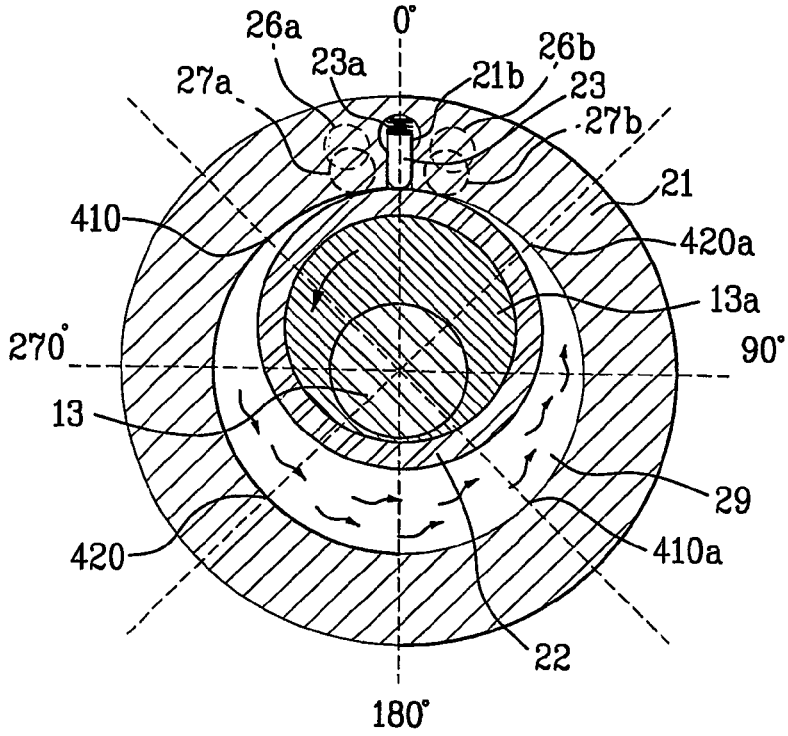
FIGS. 47A to 47C are cross-sectional views sequentially illustrating insides of the cylinder when the roller revolves in the counterclockwise direction in the rotary compressors according to a fourth embodiment of the present invention.
Figure 47B:
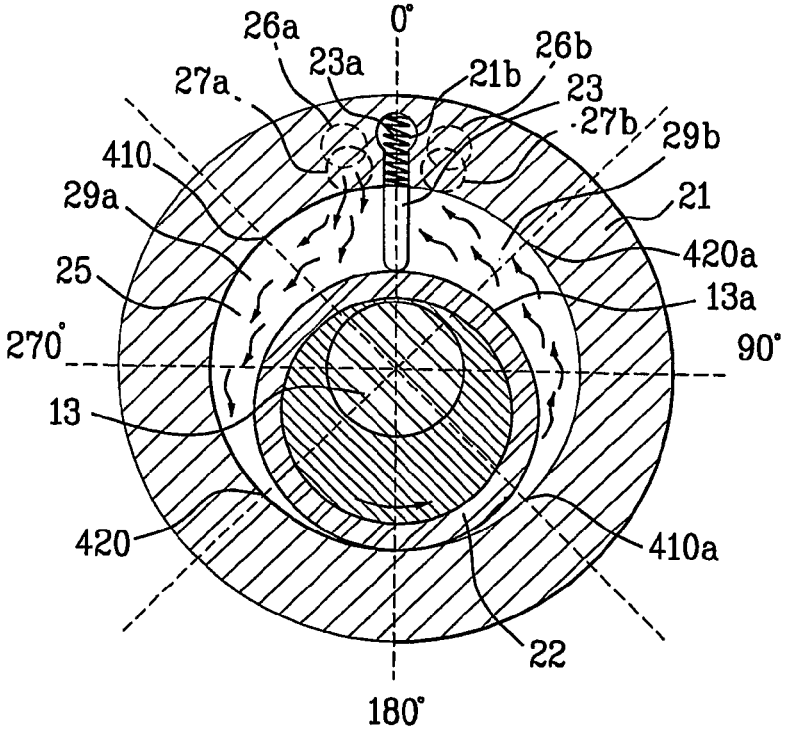
Figure 47C:
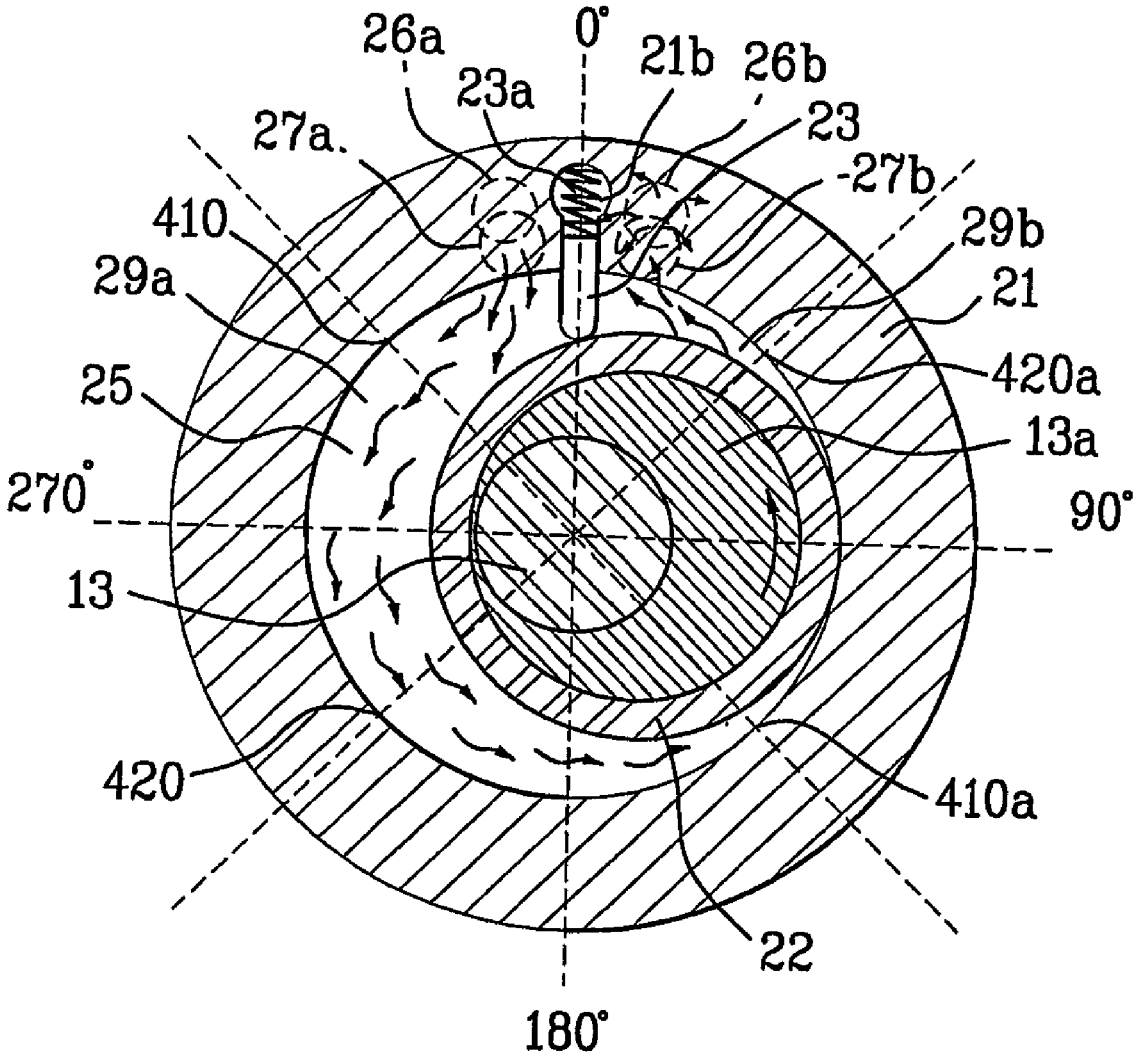

FIGS. 47A to 47C are cross-sectional views sequentially illustrating insides of the cylinder when the roller revolves in the counterclockwise direction in the rotary compressors according to a fourth embodiment of the present invention.

First, in FIG. 47A, there are shown states of respective elements inside the cylinder when the driving shaft 13 begins to rotate in the counterclockwise direction. Since there is no pressure variation in the cylinder 21, the suction and discharge ports are closed by the respective valves. Since operations of the respective valves in the counterclockwise rotation have been described in the above, its detailed description will be omitted.

The roller 22 revolves counterclockwise with performing a rolling motion along the inner circumference of the cylinder 21 due to the rotation of the driving shaft 13. As the roller 22 continues to revolve, the size of the space 29*b* is reduced as shown in FIG. 47B and thus the fluid that has been sucked is compressed. Due to the compression, a positive pressure is generated in the space 29*b* and accordingly the second port 27*b* is more firmly closed. At the same time, as a negative pressure is generated in the space 29*a*, the first suction port 27*a* is opened and the first discharge port 26*a* is closed. New fluid continues to be sucked into the space 29*a* through the first suction port 27*a* so as to be compressed in a next stroke. In this stroke, the vane 23 moves up and down elastically by the elastic member 23*a* to thereby hermetically partition the fluid chamber 29 into the two sealed spaces 29*a* and 29*b*. Also, since the first facing clearance 410*a* is formed narrower than other surrounding clearances, the compressed fluid having a high pressure can be continuously compressed without being leaked to the clearance.

When the fluid pressure in the space 29*b* is above a predetermined value, the second discharge port 26*b* is opened and as shown in FIG. 47C, the fluid is discharged through the second discharge port 26*b*. As the roller 22 continues to revolve, all the fluid in the space 29*b* is discharged through the second discharge port 26*b*. Herein, the pressure of the fluid shows the highest value but since the second facing clearance 420*a* is narrower than other surrounding clearances, the fluid can be discharged stably. After the fluid is completely discharged, the second discharge valve 26*d* closes the second discharge port 26*c* by its self-elasticity.

Thus, after a single stroke is ended, the roller 22 continues to revolve counterclockwise and discharges the fluid by repeating the same stroke. In the counterclockwise stroke, the roller 22 compresses the fluid with revolving from the first suction port 27*a* to the second discharge port 26*b*. As aforementioned, since the first suction port 27*a* and the second discharge port 27*b* are positioned in the vicinity of the vane 23 to face each other, the fluid is compressed using the overall volume of the fluid chamber 29 in the counterclockwise stroke and thus a maximal compression capacity is obtained.

Figure 48A:
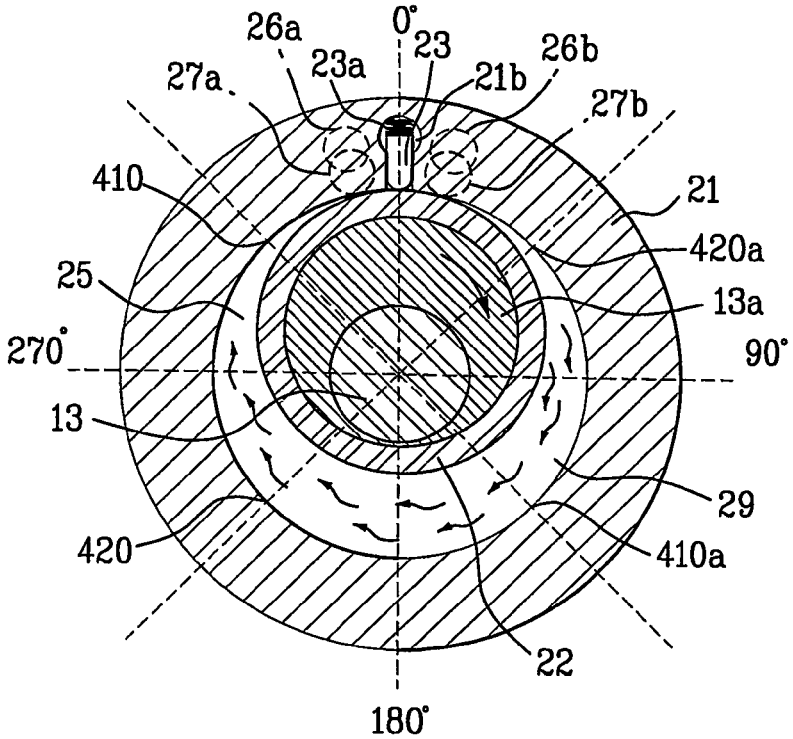
FIGS. 48A to 48C are cross-sectional views sequentially illustrating insides of the cylinder when the roller revolves in the clockwise direction in the rotary compressors according to a fourth embodiment of the present invention.
Figure 48B:
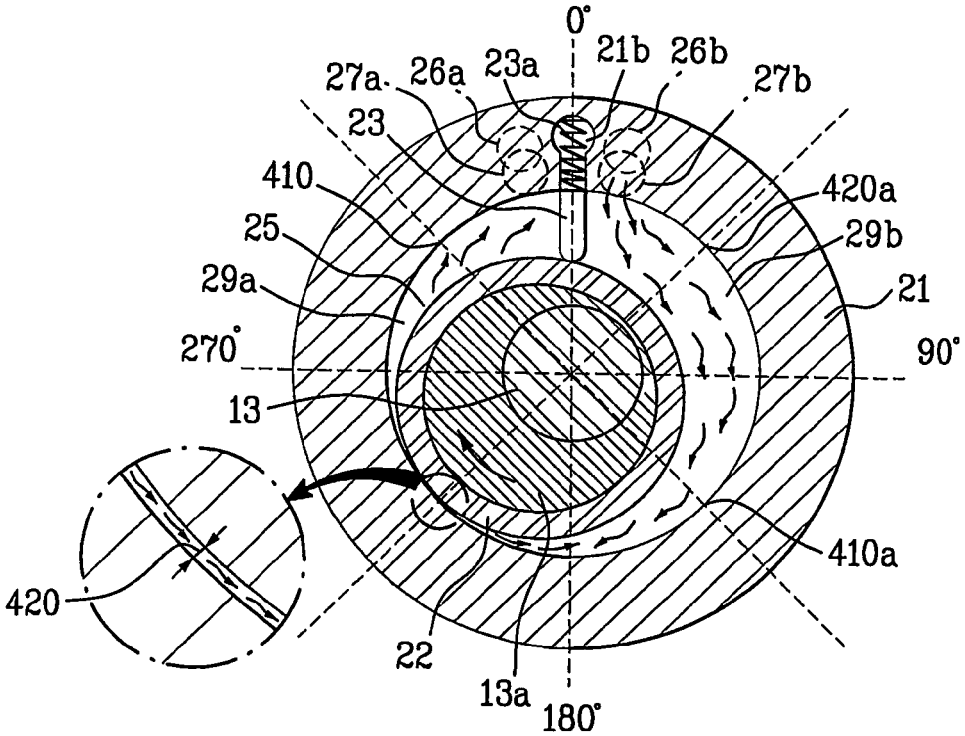
Figure 48C:
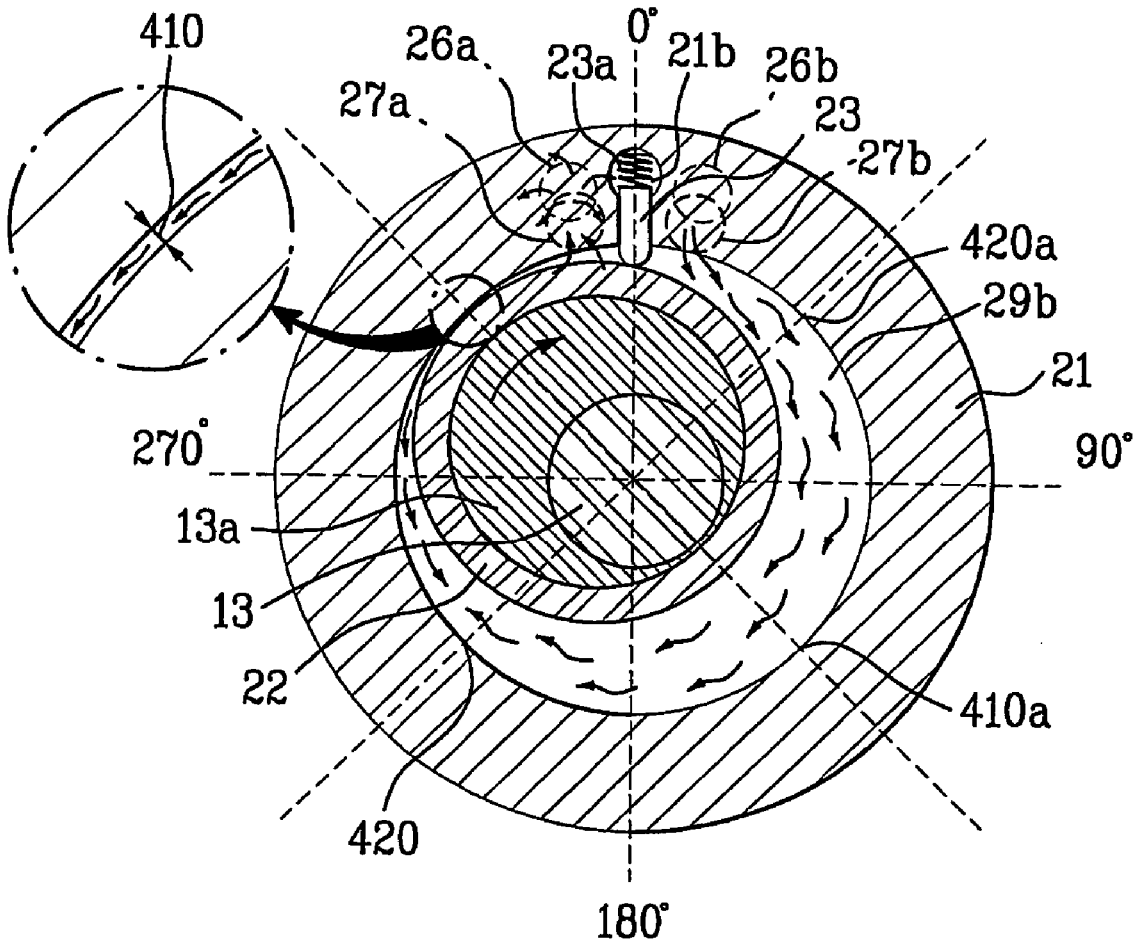

FIGS. 48A to 48C are cross-sectional views sequentially illustrating insides of the cylinder when the roller revolves in the clockwise direction in the rotary compressors according to a fourth embodiment of the present invention.

First, in FIG. 48A, there are shown states of respective elements inside the cylinder when the driving shaft 13 rotates in the clockwise direction. Since there is no pressure variation in the cylinder 21, the suction and discharge ports are closed by the respective valves as aforementioned. Since operations of the respective valves in the counterclockwise rotation have been described in advance in the above, its detailed description will be omitted.

The roller 22 begins to revolve clockwise with performing a rolling motion along the inner circumference of the cylinder 21 due to the rotation of the driving shaft 13. By such an initial stage revolution, the size of the space 29*a* is reduced and the fluid in the space 29*a* is gradually compressed such that pressure is elevated. In this compression stroke, the vane 23 moves up and down elastically by the elastic member 23*a* to thereby partition the fluid chamber 29 into the two sealed spaces 29*a* and 29*b*. At the same time, the space 29*a* becomes a positive pressure state relatively and accordingly, the first suction port 27*a* is closed such that the compressed fluid is not leaked. However, as shown in FIG. 48B, since the first clearance 410 is formed wider than other surrounding clearances while the roller 22 revolves, a part of the fluid which compression is initiated is leaked through the clearance 410. Accordingly, pressure as well as fluid amount in the space 29*a* decreases considerably.

When the fluid pressure in the space 29*a* is above a predetermined value, the first discharge port 26*a* is opened as shown in FIG. 48C and accordingly the fluid is discharged through the first discharge port 26*a*. Herein, the fluid shows the highest pressure value but since the first clearance 410 is formed wider than other surrounding clearances, the leakage of the fluid is generated more seriously than in the second clearance 420. After the fluid is completely discharged, the first discharge valve 26*c* closes the first discharge port 26*a* by its self-elasticity.

Thus, after a single stroke is ended, the roller 22 continues to revolve clockwise and discharges the fluid by repeating the same stroke. In the clockwise stroke, the roller 22 compresses the fluid with revolving from the second suction port 27*b* to the first discharge port 26*a*. Accordingly, like the counterclockwise stroke, the fluid in the clockwise stroke is compressed using the entire portion of the fluid chamber 29. However, much fluid is leaked due to the first and second clearances 410 and 420. Accordingly, in the counterclockwise stroke, a compression capacity that is smaller than that in the clockwise direction is obtained, which brings the same result as that of when the fluid is compressed only using a part of the entire fluid chamber 29.

In the aforementioned strokes (i.e., the clockwise stroke and the counterclockwise stroke), the discharged compressive fluid moves upward through the space between the rotor 12 and the stator 11 inside the case 1 and the space between the stator 11 and the case 1. Finally, the compressed fluid is discharged through the discharge pipe 9 out of the compressor.

In the fourth embodiment, the inventive rotary compressor has suction and discharge ports for sucking and discharging fluid in bidirectional rotation of the driving shaft, and clearances located between the roller and the cylinder and varied with the rotational direction of the driving shaft. Accordingly, due to these clearances, fluid may be leaked while the fluid is compressed in a specific rotational direction, which causes a result that the fluid is compressed using the entire portion of the fluid chamber in any one directional rotation and is compressed using a part of the fluid chamber in other directional rotation. Accordingly, the fluid can be compressed although the driving shaft rotates in any one of the counterclockwise direction and clockwise direction. Also, different sizes of compression spaces are formed depending on the rotational direction of the driving shaft such that different compression capacities are obtained in its operation. In particular, any one of the compression capacities is formed using the predesigned entire fluid chamber. Further, the rotary compressor of the present invention has the plenum for preliminarily storing the fluid so that the fluid could be stably supplied to the cylinder.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

The rotary compressor according to each embodiment as above provides following advantages.

First, according to the related art, several devices are combined in order to achieve the dual-capacity compression. For example, an inverter and two compressors having different compression capacities are combined in order to obtain the dual compression capacities. In this case, the structure becomes complicated and the cost increases. However, according to the present invention, the dual-capacity compression can be achieved using only one compressor. Particularly, the present invention can achieve the dual-capacity compression by changing parts of the conventional rotary compressor to the minimum.

Second, the conventional compressor having a single compression capacity cannot provide the compression capacity that is adaptable for various operation conditions of air conditioner or refrigerator. In this case, power consumption may be wasted unnecessarily. However, the present invention can provide a compression capacity that is adaptable for the operation conditions of equipments.

Third, the rotary compressor of the present invention uses the entire portion of the predesigned fluid chamber in producing a dual-compression capacity. This means that the compressor of the present invention has at least the same compression capacity as the conventional rotary compressor having the same sized cylinder and fluid chamber. In other words, the inventive rotary compressor can substitute for the conventional rotary compressor without modifying designs of basic parts, such as cylinder size or the like. Accordingly, the inventive rotary compressor can be freely applied to required systems without any consideration of the compression capacity and any increase in unit cost of production.

Fourth, the rotary compressor of the present invention has the suction plenum for constantly storing a predetermined amount of fluid. This plenum buffers a pressure variation of the sucked fluid and stably supplies the fluid to the cylinder. Therefore, the reliability and stability of the compressor are greatly improved.

The invention claimed is:

1. A rotary compressor; comprising:

a driving shaft that is rotatable clockwise and counterclockwise directions, and that has an eccentric portion of a predetermined size;

a cylinder having a predetermined inner volume;

a roller rotatably installed on an outer circumferential surface of the eccentric portion so as to contact an inner circumferential surface of the cylinder, wherein the roller performs a rolling motion along the inner circumferential surface of the cylinder and forms a fluid chamber therewith in which fluid is compressed;

a vane elastically installed in the cylinder so as to contact the roller;

upper and lower bearings respectively installed at upper and lower portions of the cylinder, the upper and lower bearings rotatably supporting the driving shaft and hermetically sealing the inner volume of the cylinder;

a plurality of suction ports and a plurality of discharge ports that each communicate with the fluid chamber so as to suction and discharge fluid;

a suction plenum that communicates with at least one of the plurality of suction ports, and that stores fluid therein; and a compression mechanism configured to form compressive spaces of different sizes in the fluid chamber based on a rotational direction of the driving shaft, wherein the compression mechanism provides a first compression capacity in a clockwise rotational direction and a second compression capacity in a counterclockwise rotational direction.

2. The rotary compressor of claim 1, wherein the compression mechanism compresses fluid using a full capacity of the fluid chamber when the driving shaft rotates in one of the clockwise direction or the counterclockwise direction.

3. The rotary compressor of claim 1, wherein the compression mechanism compresses the fluid using a portion of the fluid chamber when the driving shaft rotates in the other of the clockwise direction or the counterclockwise direction.

4. The rotary compressor of claim 1, wherein the plurality of suction ports are configured to suction fluid into the fluid chamber in all the rotational directions of the driving shaft.

5. The rotary compressor of claim 1, wherein the plurality of discharge ports are configured to discharge fluid, which is introduced into the fluid chamber from a corresponding one of the plurality of suction ports and compressed in the fluid chamber, while the driving shaft rotates clockwise or counterclockwise.

6. The rotary compressor of claim 1, wherein the plurality of suction ports are spaced apart from each other by a predetermined angle.

7. The rotary compressor of claim 1, wherein the plurality of discharge ports are spaced apart from each other by a predetermined angle.

8. The rotary compressor of claim 1, wherein plurality of suction ports comprises at least two suction ports, and the plurality of discharge ports comprises at least two discharge ports.

9. The rotary compressor of claim 1, wherein the compression mechanism comprises a valve assembly, wherein the valve assembly rotates based on a rotational direction of the driving shaft to selectively open at least one of the plurality of suction ports.

10. The rotary compressor of claim 9, wherein the plurality of discharge ports comprise a first discharge port and a second discharge port which are positioned facing each other with respect to the vane.

11. The rotary compressor of claim 9, wherein the plurality of suction ports comprise a first suction port located in the vicinity of the vane and a second suction port spaced apart from the first suction port by a predetermined angle.

12. The rotary compressor of claim 11, wherein the first and second suction ports are circular.

13. The rotary compressor of claim 12, wherein the first and second suction ports have diameters in a range of approximately 6 mm to 15 mm.

14. The rotary compressor of claim 11, wherein the first and second suction ports are rectangular.

15. The rotary compressor of claim 14, wherein the first and second suction ports have a predetermined curvature.

16. The rotary compressor of claim 11, wherein the first suction port is positioned approximately 10° from the vane in a clockwise or counterclockwise direction.

17. The rotary compressor of claim 11, wherein the second suction port is positioned in a range of 90-180° from the vane so as to face the first suction port.

18. The rotary compressor of claim 9, further comprising a plurality of discharge valves that open and close the plurality of discharge ports so as to discharge compressed fluid through the plurality of suction ports.

19. The rotary compressor of claim 9, wherein the valve assembly comprises:

a first valve rotatably installed between the cylinder and the lower bearing; and a second valve that guides a rotary motion of the first valve.

20. The rotary compressor of claim 19, wherein the first valve comprises a disc member that contacts the eccentric portion of the driving shaft, and that rotates in the rotational direction of the driving shaft.

21. The rotary compressor of claim 20, wherein an outer diameter of the first valve is greater than an inner diameter of the cylinder.

22. The rotary compressor of claim 20, wherein the first valve is 0.5-5 mm thick.

23. The rotary compressor of claim 19, wherein the first valve comprises:

a first opening that communicates with the first suction port when the driving shaft rotates in one of the clockwise direction or the counterclockwise direction; and a second opening that communicates with the second suction port when the driving shaft rotates in the other of the clockwise direction or the counterclockwise direction.

24. The rotary compressor of claim 23, wherein the plurality of suction ports further comprises a third suction port positioned between the second suction port and the vane.

25. The rotary compressor of claim 24, wherein the third suction port is spaced apart by 10° in a clockwise or counterclockwise direction from the vane so as to face the first suction port.

26. The rotary compressor of claim 24, wherein the first valve further comprises a third opening that opens the third suction port simultaneously with an opening of the second suction port.

27. The rotary compressor of claim 24, wherein the first valve comprises a first opening that opens the third suction port simultaneously with an opening of the second suction port.

28. The rotary compressor of claim 19, wherein the first valve comprises a single opening that communicates with the first suction port when the driving shaft rotates in one of the clockwise direction or the counterclockwise direction, and that communicates with the second suction port when the driving shaft rotates in the other of the clockwise direction or the counterclockwise direction.

29. The rotary compressor of claim 19, wherein the valve assembly further comprises means for controlling a rotation angle of the first valve such that corresponding suction ports of the plurality of suction ports are opened accurately.

30. The rotary compressor of claim 29, wherein the control means comprises:

a curved groove formed in the first valve and having a predetermined length; and a stopper formed on the lower bearing and inserted into the curved groove.

31. The rotary compressor of claim 30, wherein the curved groove is positioned near a center of the first valve.

32. The rotary compressor of claim 30, wherein a thickness of the stopper is substantially equal to a thickness of the first valve.

33. The rotary compressor of claim 30, wherein a width of the stopper is substantially equal to a width of the curved groove.

34. The rotary compressor of claim 30, wherein opposite ends of the curved groove form an angle therebetween of 30-120°.

35. The rotary compressor of claim 29, wherein the control means comprises:

a projection that projects outward in a radial direction from the first valve; and a groove formed on the second valve so as to movably receive the projection movably.

36. The rotary compressor of claim 29, wherein the control means comprises:

a projection that projects outward in a radial direction from the second valve; and a groove formed on the first valve so as to movably receive the projection.

37. The rotary compressor of claim 29, wherein the control means comprises:

a projection formed on the second valve and that projects toward a center of the second valve; and a cut-away portion formed on the first valve so as to movably receive the projection.

38. The rotary compressor of claim 37, wherein the projection and the cut-away portion form a clearance therebetween, wherein the clearance opens the first suction port or the third suction port based on a rotational direction of the driving shaft.

39. The rotary compressor of claim 37, wherein opposite side surfaces of the projection form an angle therebetween of 10-90°.

40. The rotary compressor of claim 37, wherein opposite ends of the cut-away portion form an angle therebetween of 30-120°.

41. The rotary compressor of claim 1, wherein the compression mechanism comprises a valve assembly that selectively opens at least one of the plurality of suction ports using a pressure difference between inner and outer portions of the cylinder based on a rotational direction of the driving shaft.

42. The rotary compressor of claim 1, wherein the compression mechanism comprises a first vane and a second vane that divide the fluid chamber into a first space configured such that fluid is compressed while the driving shaft rotates bidirectionally, and a second space configured such that fluid is compressed while the driving shaft rotates in none direction.

43. The rotary compressor of claim 1, wherein the suction plenum accommodates oil separated from the stored fluid.

44. The rotary compressor of claim 1, wherein the suction plenum is installed at a lower portion of the lower bearing, near the plurality of suction ports.

45. The rotary compressor of claim 1, wherein a volume of the suction plenum is 100-400% of a volume of the fluid chamber.

46. The rotary compressor of claim 1, further comprising a suction pipe that is connected to the suction plenum through a predetermined fluid passage, the suction pipe supplying fluid to be compressed.

47. The rotary compressor of claim 46, wherein the fluid passage penetrates the cylinder and the lower bearing.

48. The rotary compressor of claim 1, wherein the suction plenum further comprises a penetration hole through which a sleeve of the lower bearing passes.

* * * * *